US010494136B2

(12) United States Patent
Bressan et al.

(10) Patent No.: US 10,494,136 B2
(45) Date of Patent: Dec. 3, 2019

(54) CONTAINER AND PROCESS OF MAKING THE SAME

(71) Applicant: I.G.B. S.r.l., Milan (IT)

(72) Inventors: Michel Bressan, Induno Olona (IT); Alberto Gandolla, Induno Olona (IT); Alessio Bressan, Varese (IT)

(73) Assignee: I.G.B. S.r.l., Milan (IT)

( * ) Notice: Subject to any disclaimer, the term of this patent is extended or adjusted under 35 U.S.C. 154(b) by 98 days.

(21) Appl. No.: 15/455,607

(22) Filed: Mar. 10, 2017

(65) Prior Publication Data

US 2017/0259953 A1 Sep. 14, 2017

(30) Foreign Application Priority Data

Mar. 11, 2016 (IT) ..... 102016000026083

(51) Int. Cl.
*B65D 5/20* (2006.01)
*B65D 75/36* (2006.01)
(Continued)

(52) U.S. Cl.
CPC ..... *B65D 5/2052* (2013.01); *B65D 5/4208* (2013.01); *B65D 5/4266* (2013.01);
(Continued)

(58) Field of Classification Search
CPC .. B65D 5/2052; B65D 5/4208; B65D 5/4266; B65D 5/6608; B65D 65/466;
(Continued)

(56) References Cited

U.S. PATENT DOCUMENTS 4,770,338 A * 9/1988 Tatusch ..... B65B 51/023 206/807
5,029,713 A * 7/1991 Lisiecki ..... B65D 5/062 229/169

(Continued)

FOREIGN PATENT DOCUMENTS

DE 202014001622 U1 5/2014
EP 2805895 U1 11/2014
WO WO2015170203 U1 11/2015

OTHER PUBLICATIONS

Search Report for Italian Application No. ITUA20161599, dated Nov. 11, 2016, 8 pages.

*Primary Examiner* — Christopher R Demeree
(74) *Attorney, Agent, or Firm* — Fish & Richardson P.C.

(57) ABSTRACT

A container has a compartment of sheet material defining an inner volume configured for housing a product, the compartment extending between a first and second longitudinal end portions along a longitudinal development direction of the compartment. The compartment having a predetermined number of lateral walls defining: at least one first passage opening arranged at the first longitudinal end portion of the compartment, one second passage opening arranged at the second longitudinal end portion of the compartment. The container includes at least one occluding system engaged at the second passage opening and configured for irreversibly closing the second passage opening. The disclosure also relates a process of making the container.

8 Claims, 35 Drawing Sheets

(51) Int. Cl.
*B65D 77/04* (2006.01)
*B65D 5/42* (2006.01)
*B65D 65/46* (2006.01)

(52) U.S. Cl.
CPC ..... *B65D 65/466* (2013.01); *B65D 75/367* (2013.01); *B65D 77/0413* (2013.01)

(58) Field of Classification Search
CPC ..... B65D 75/367; B65D 77/0413; B65D 83/0463; B65D 5/0254; B65D 2101/00; B65D 5/10
USPC ..... 229/121, 102, 153, 223, 126, 152; 206/807
See application file for complete search history.

(56) References Cited

U.S. PATENT DOCUMENTS 5,060,853 A * 10/1991 Gulliver ..... B65D 5/302 156/108
5,265,794 A * 11/1993 Johnston ..... B65D 5/0227 206/459.5
5,350,108 A * 9/1994 Friar ..... B65D 5/6608 229/102
5,507,428 A * 4/1996 Robinson, Jr. ..... B65D 5/0254 229/102
5,803,345 A * 9/1998 Jones ..... B65D 5/6608 206/807
5,971,261 A * 10/1999 Grunfeld ..... B65D 5/5405 206/459.5
7,717,319 B2 * 5/2010 Adam ..... B65D 5/0254 229/102
8,408,451 B2 * 4/2013 Adam ..... B65D 5/6608 229/102
8,701,974 B2 * 4/2014 Davies ..... B65D 5/0254 229/102
8,800,855 B2 * 8/2014 Fitzwater ..... B65D 5/0227 229/129.1
8,967,455 B2 * 3/2015 Zhou ..... B65D 5/0254 229/147
9,004,344 B2 * 4/2015 Smith ..... B65D 5/0227 229/126
9,085,386 B2 * 7/2015 Hengami ..... B65D 5/723
9,878,818 B2 * 1/2018 Grajales ..... B65D 5/6608

* cited by examiner

FIG.1
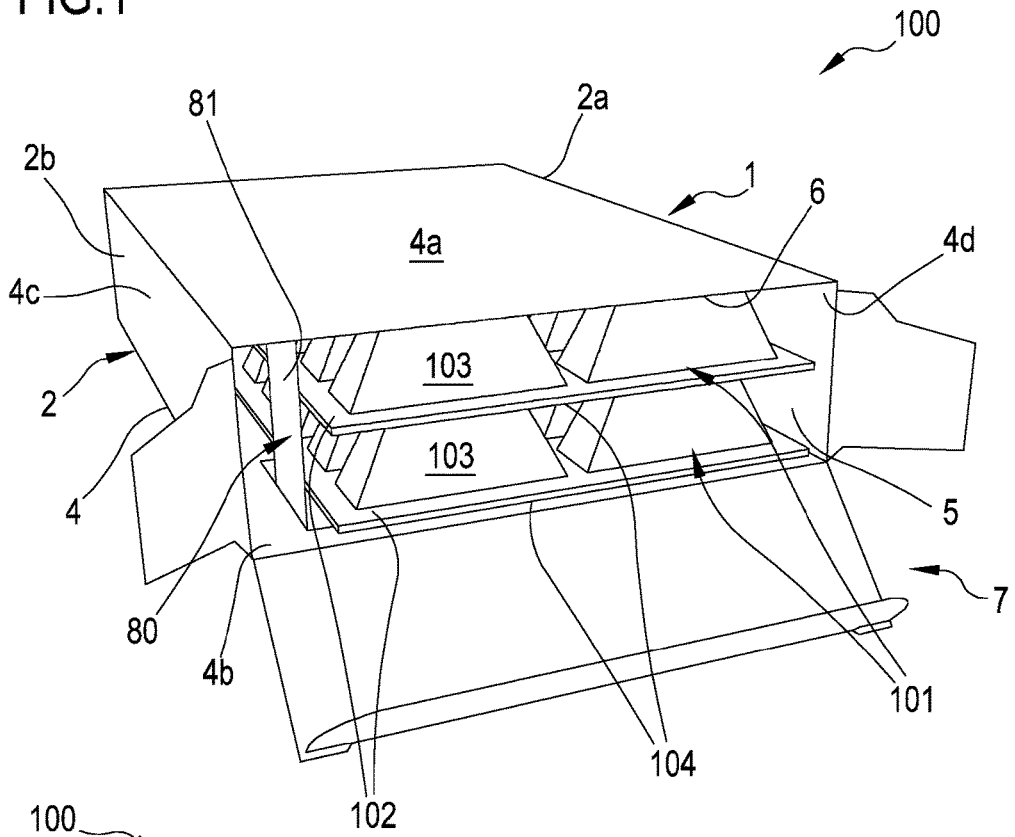
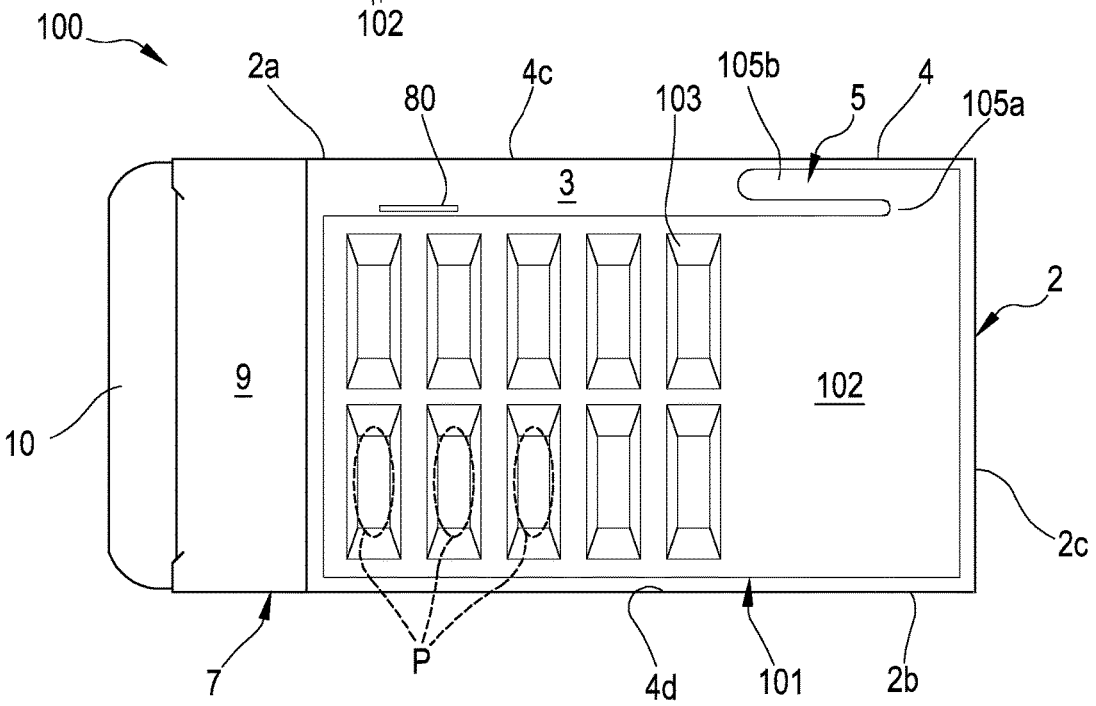
FIG.2

FIG.3
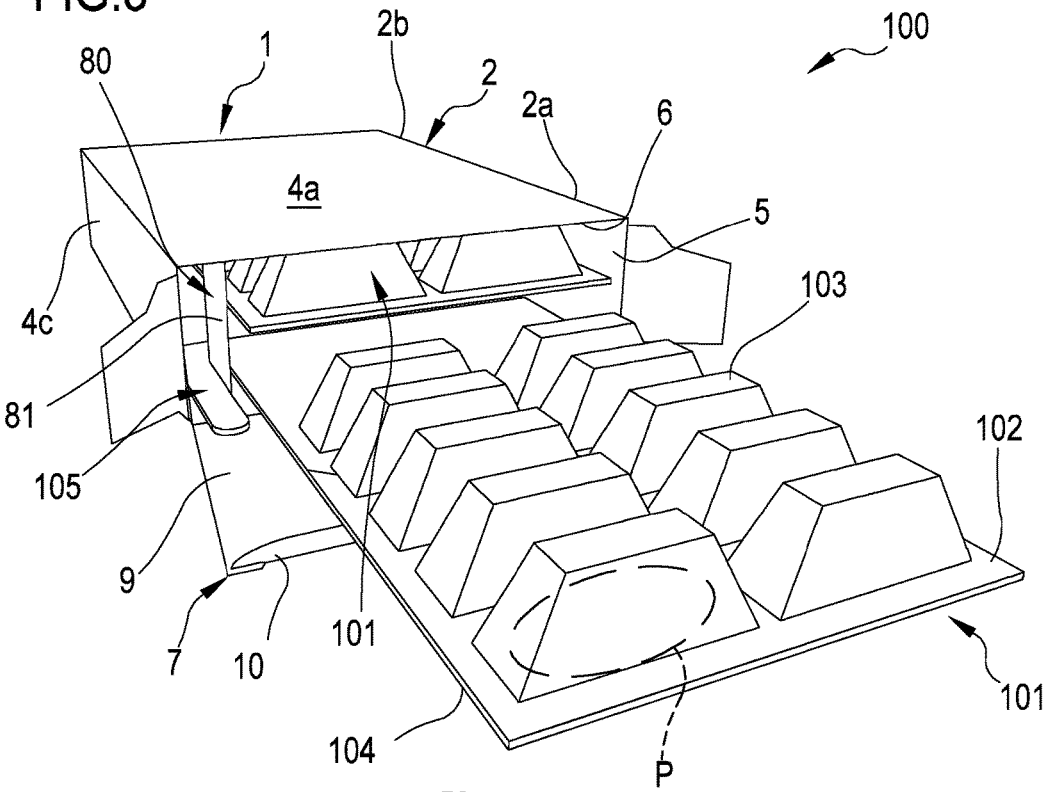
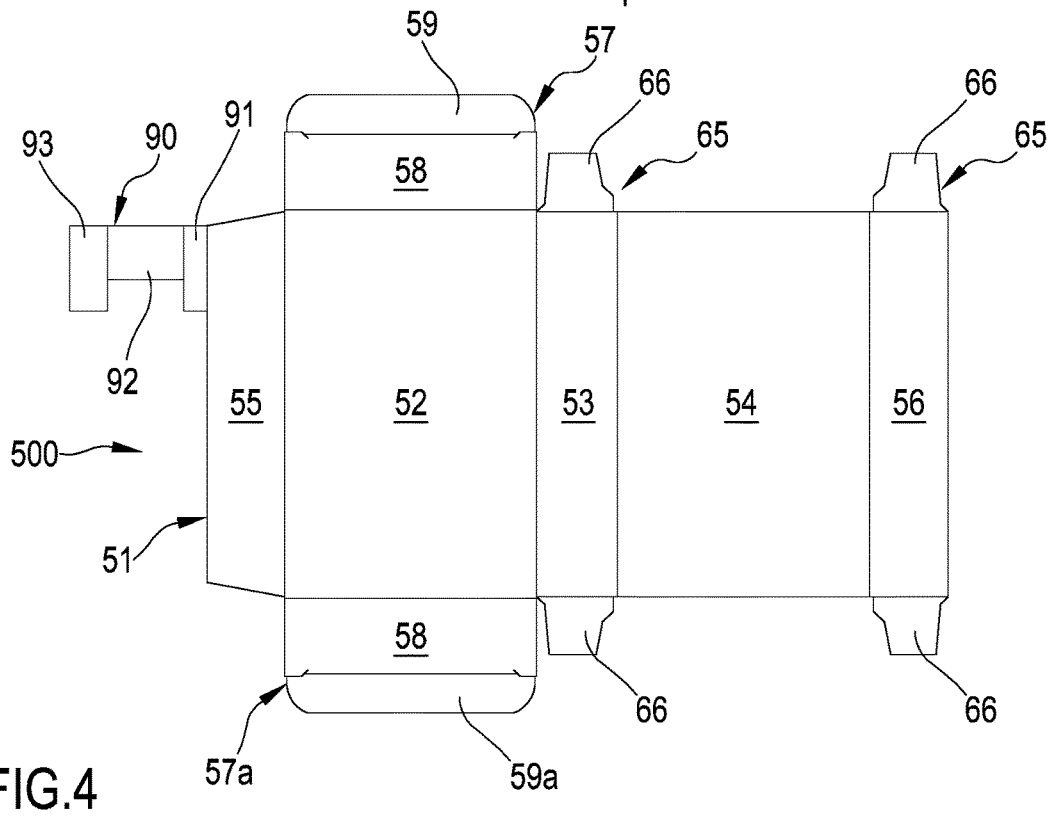
FIG.4

FIG.5
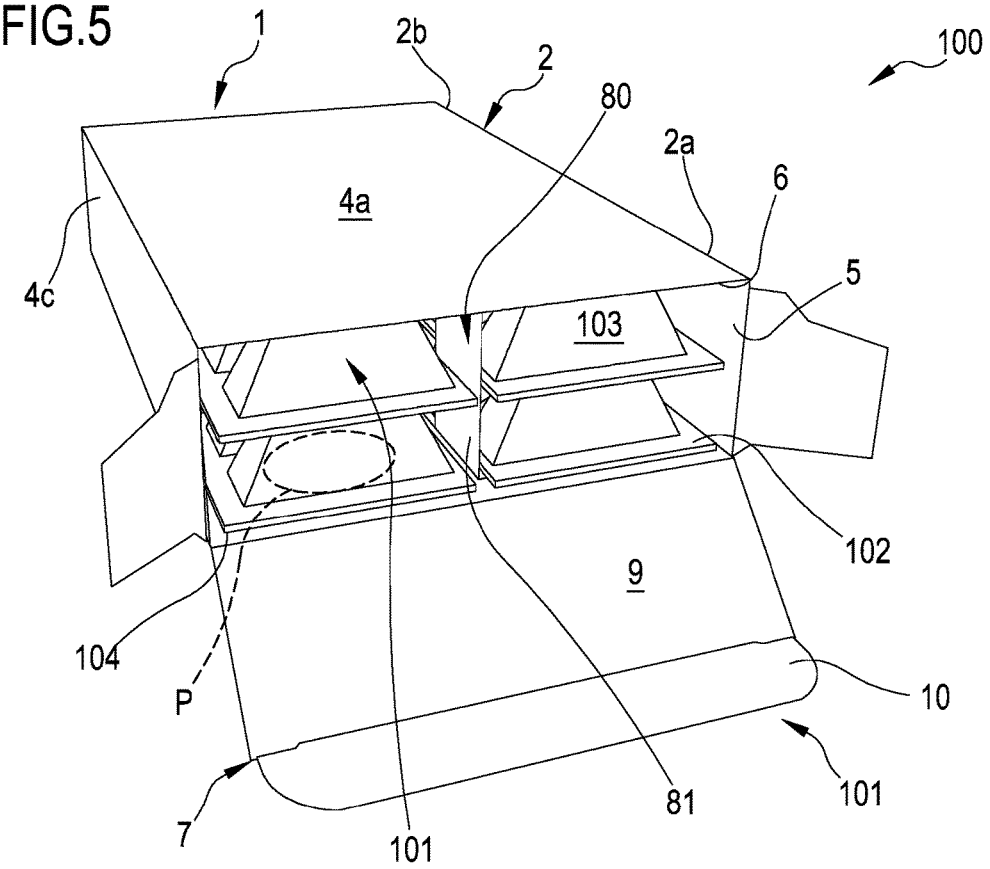
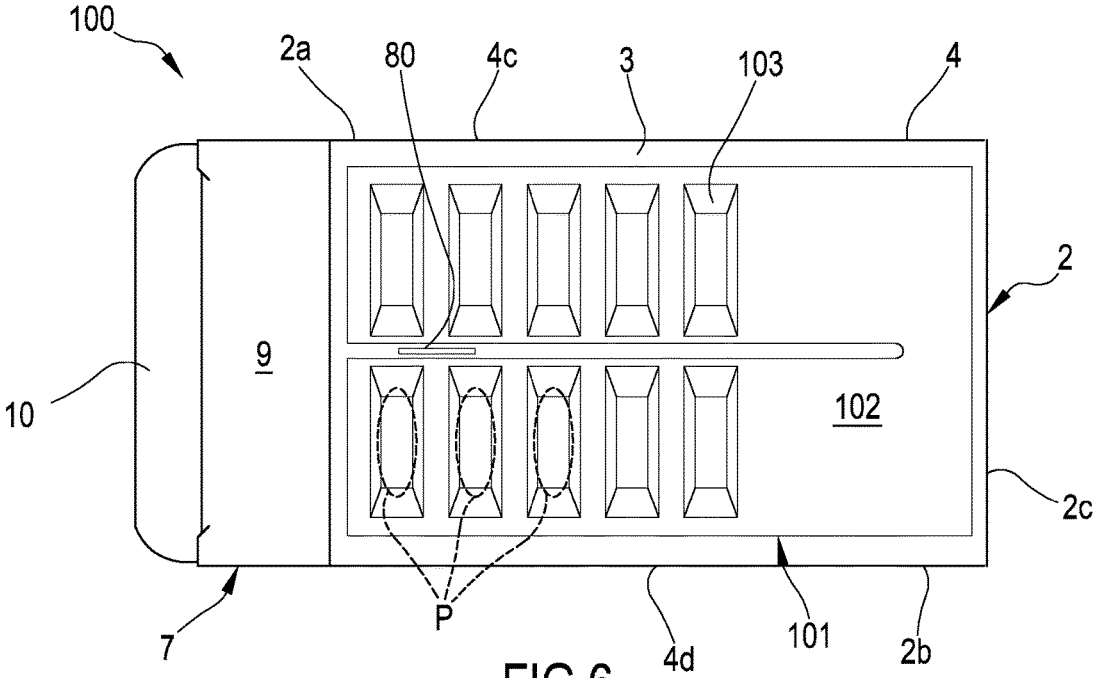
FIG.6

FIG.7
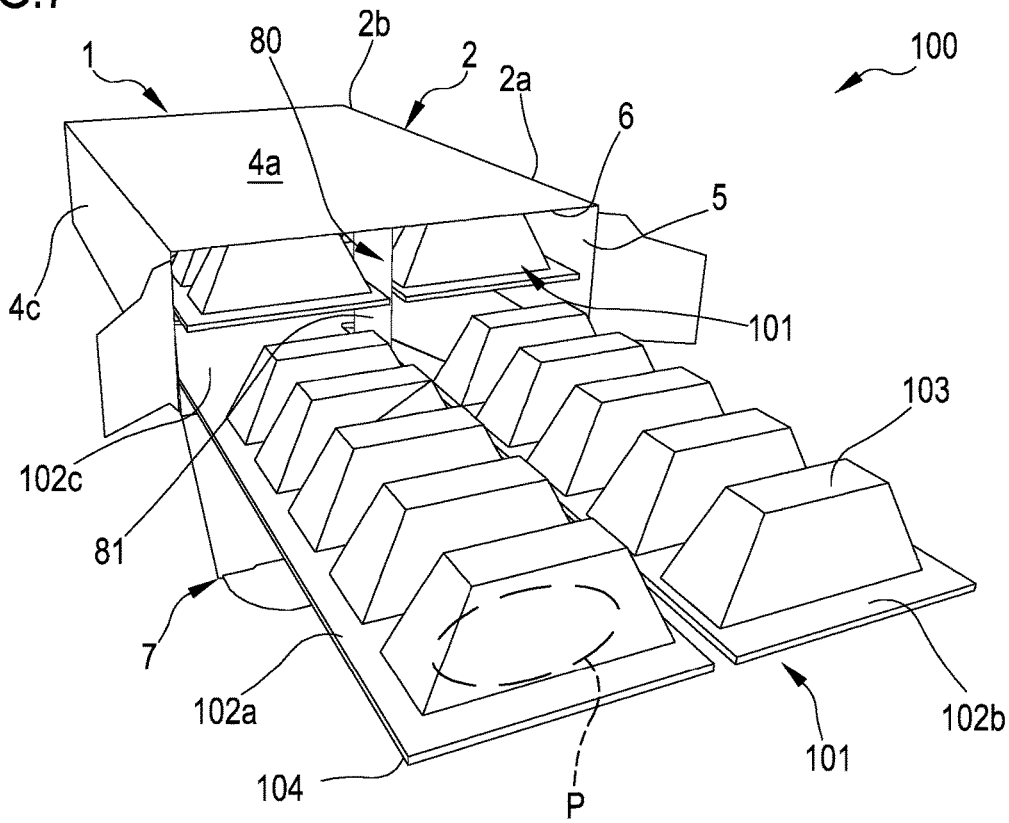
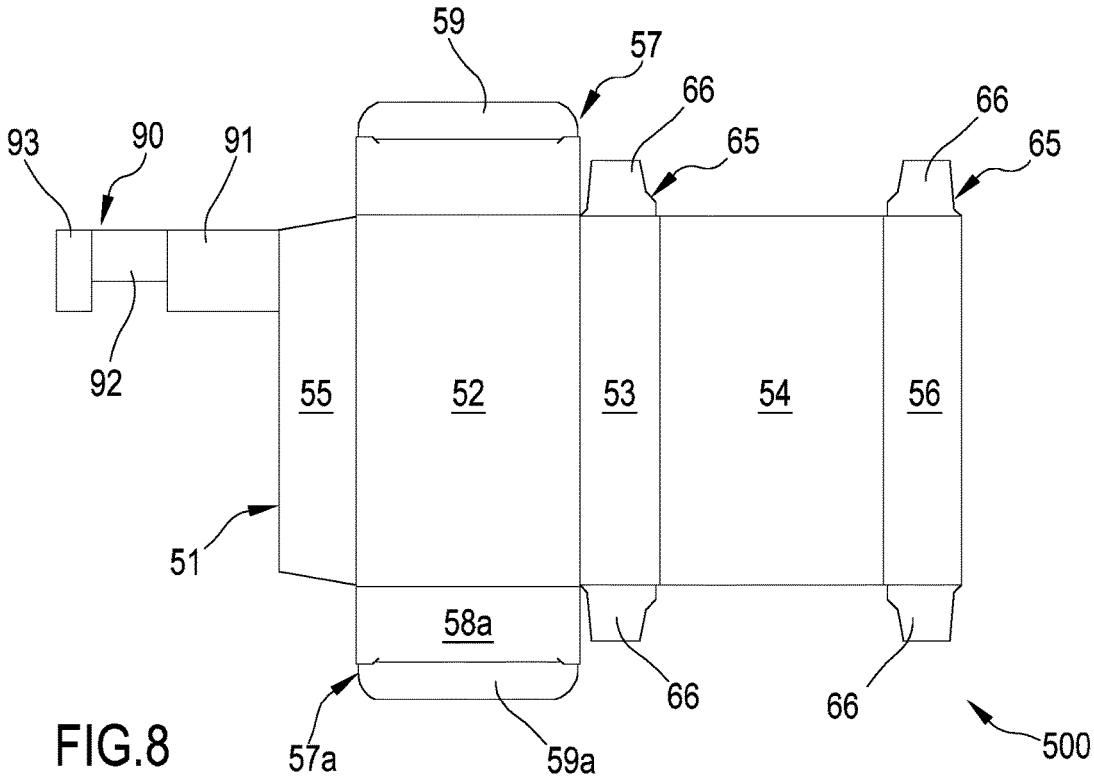
FIG.8

FIG.9
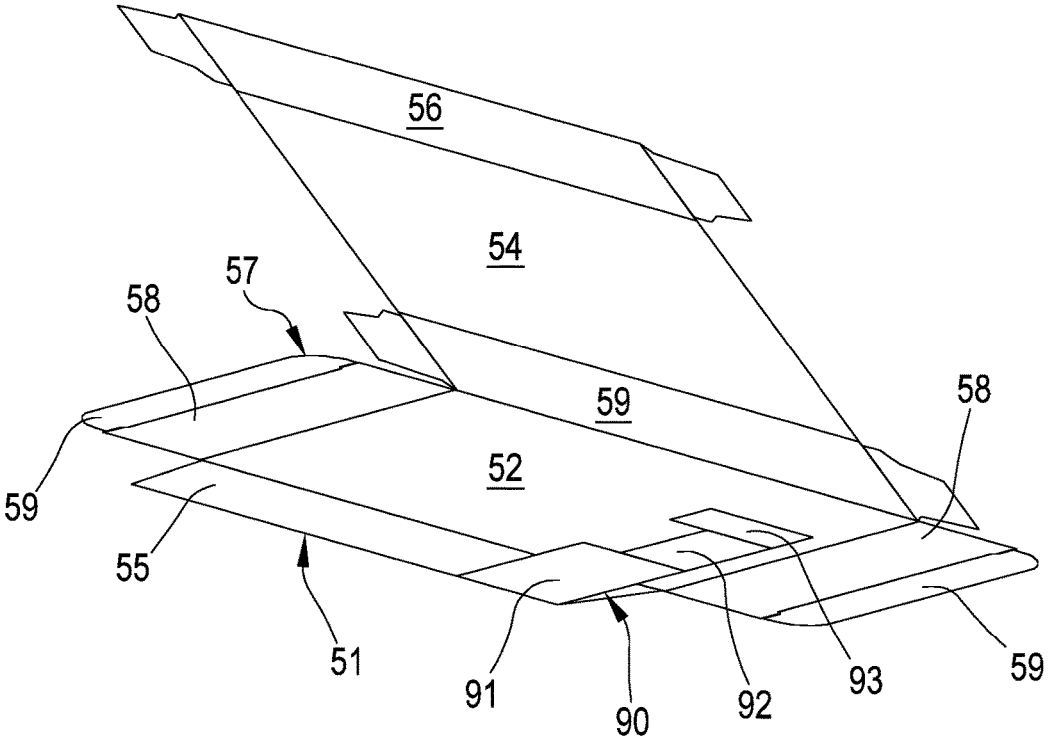
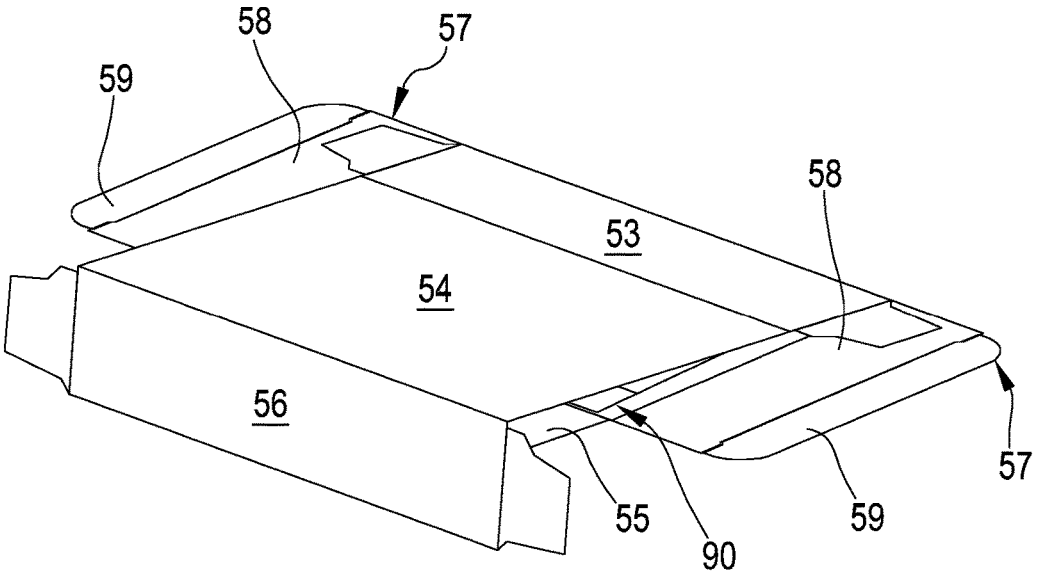
FIG.10

FIG.11
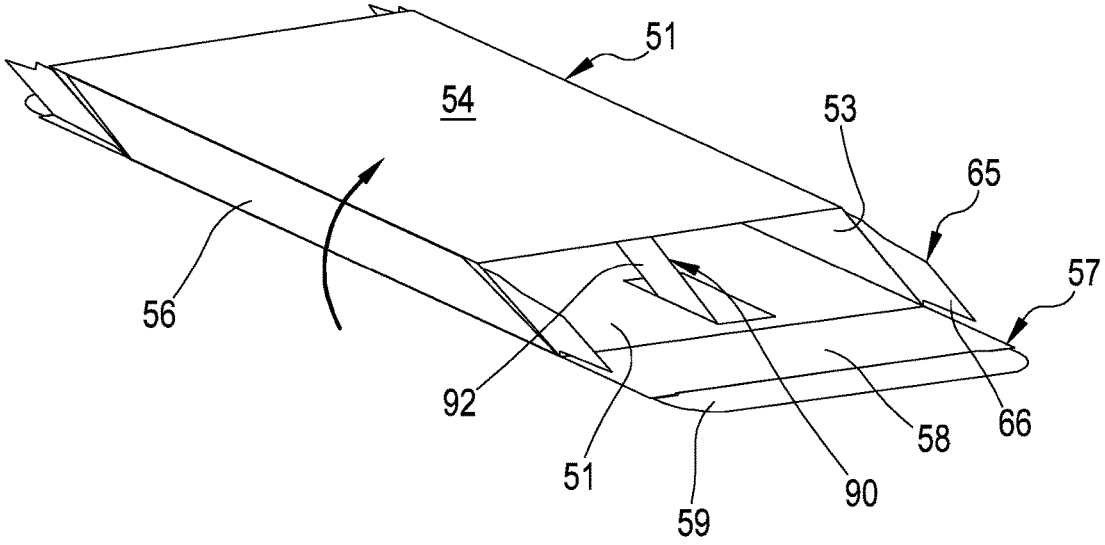
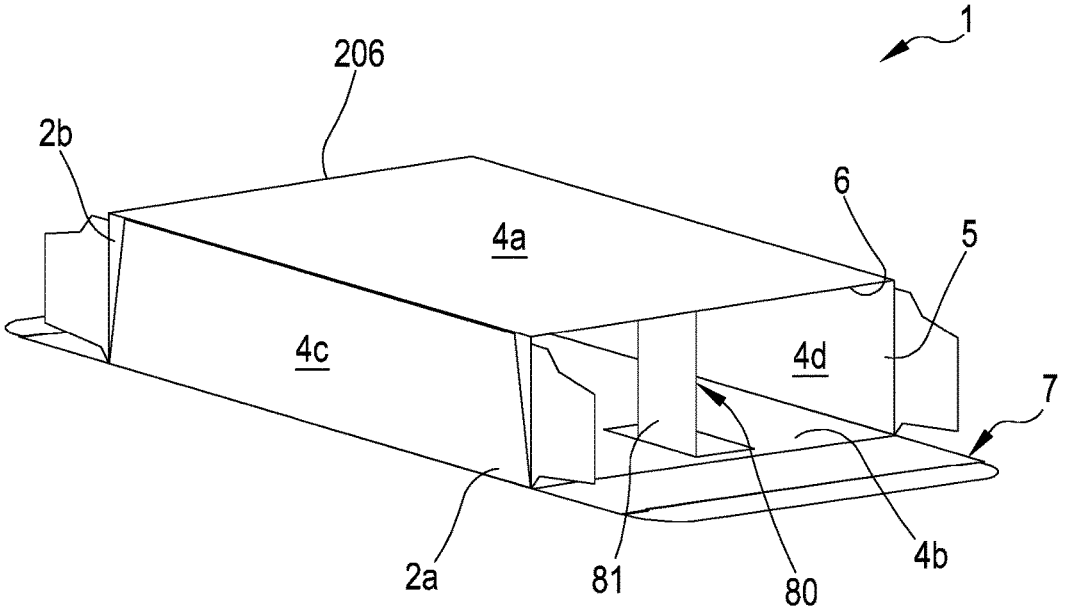
FIG.12

FIG.32
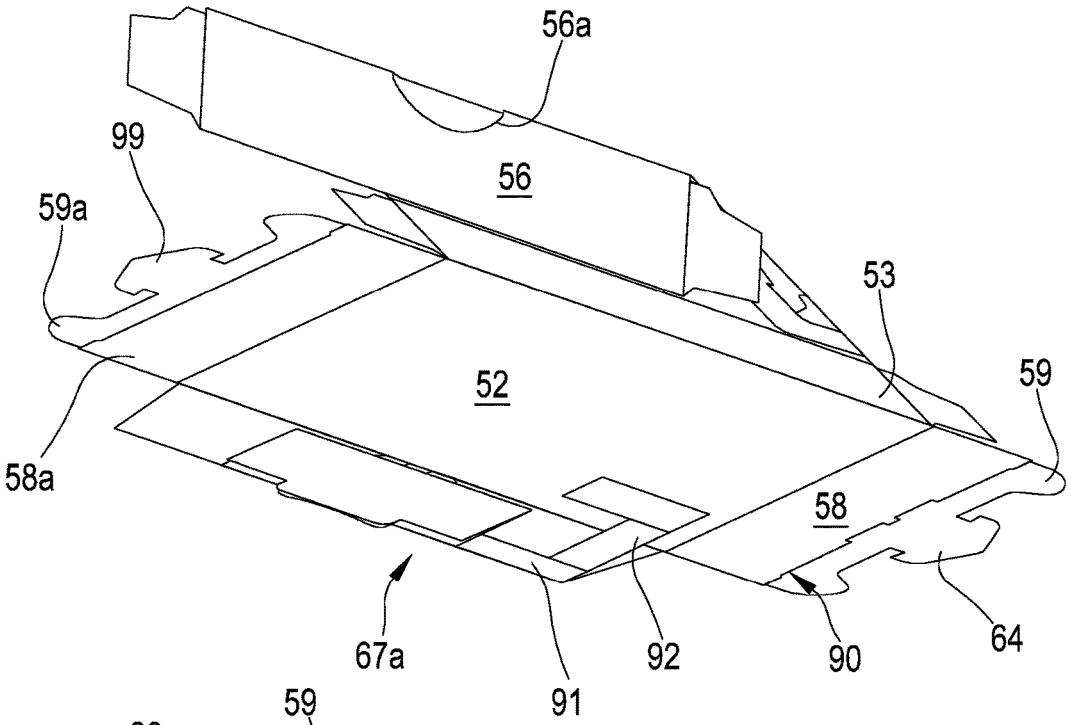
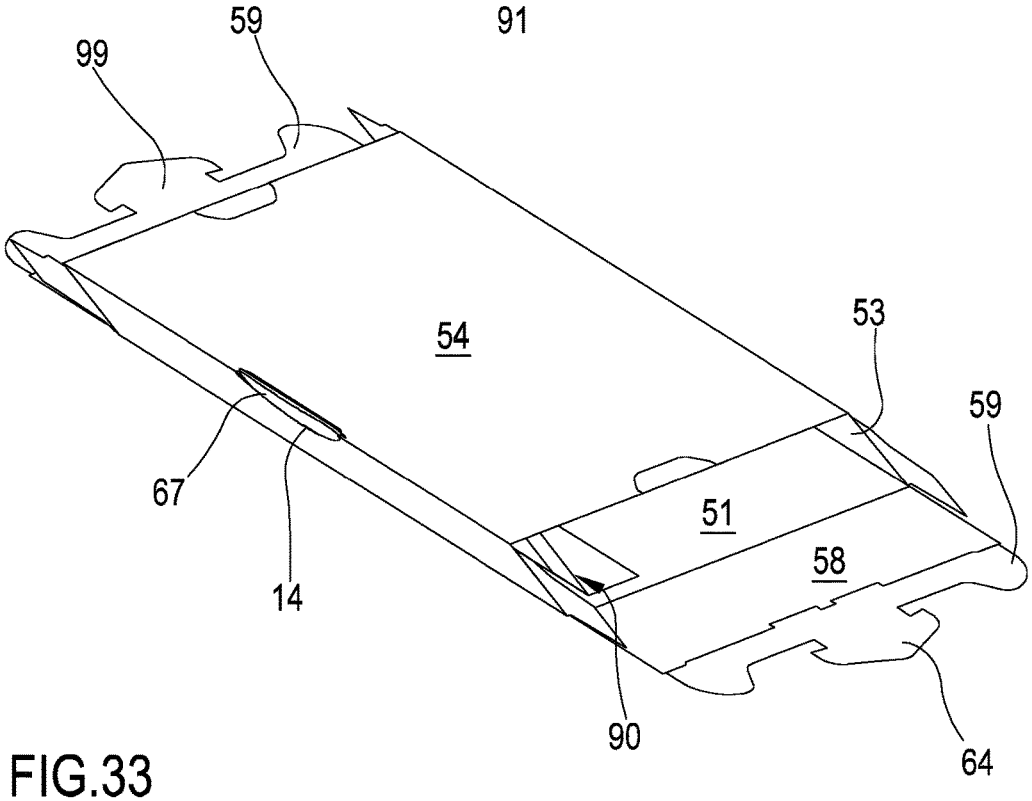
FIG.33

FIG.34
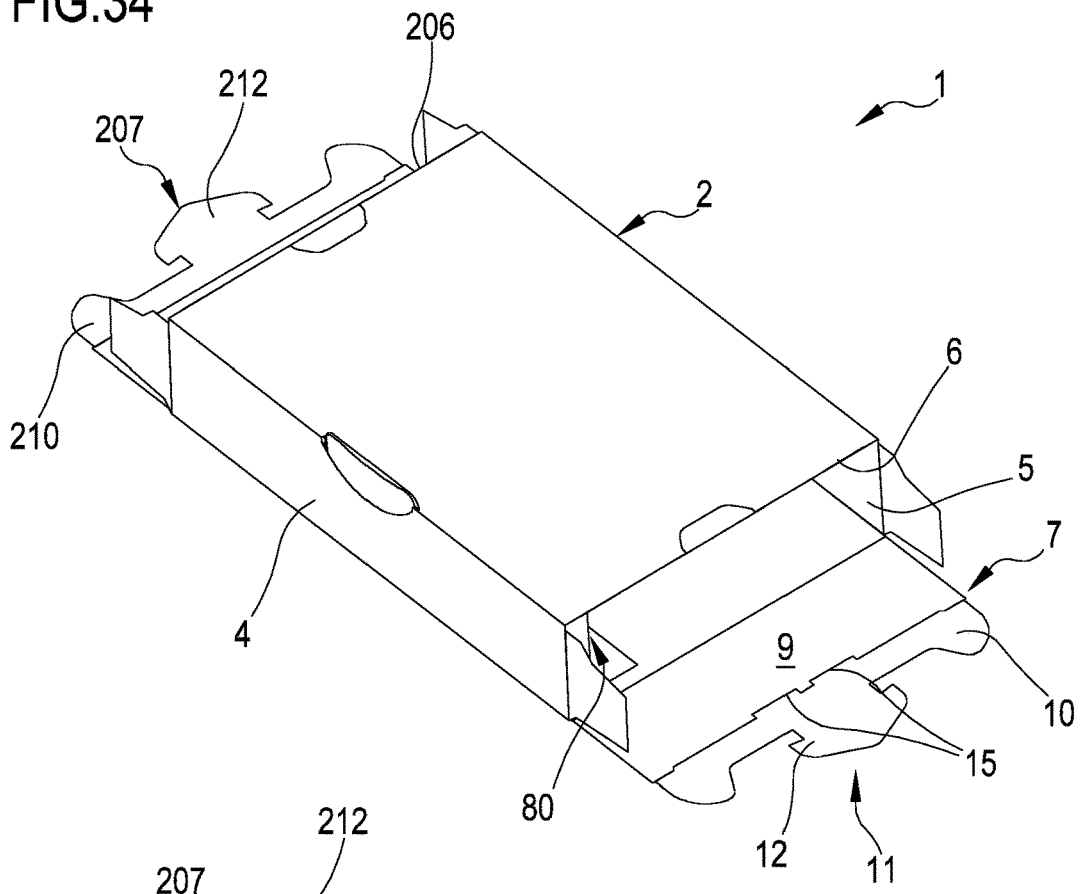
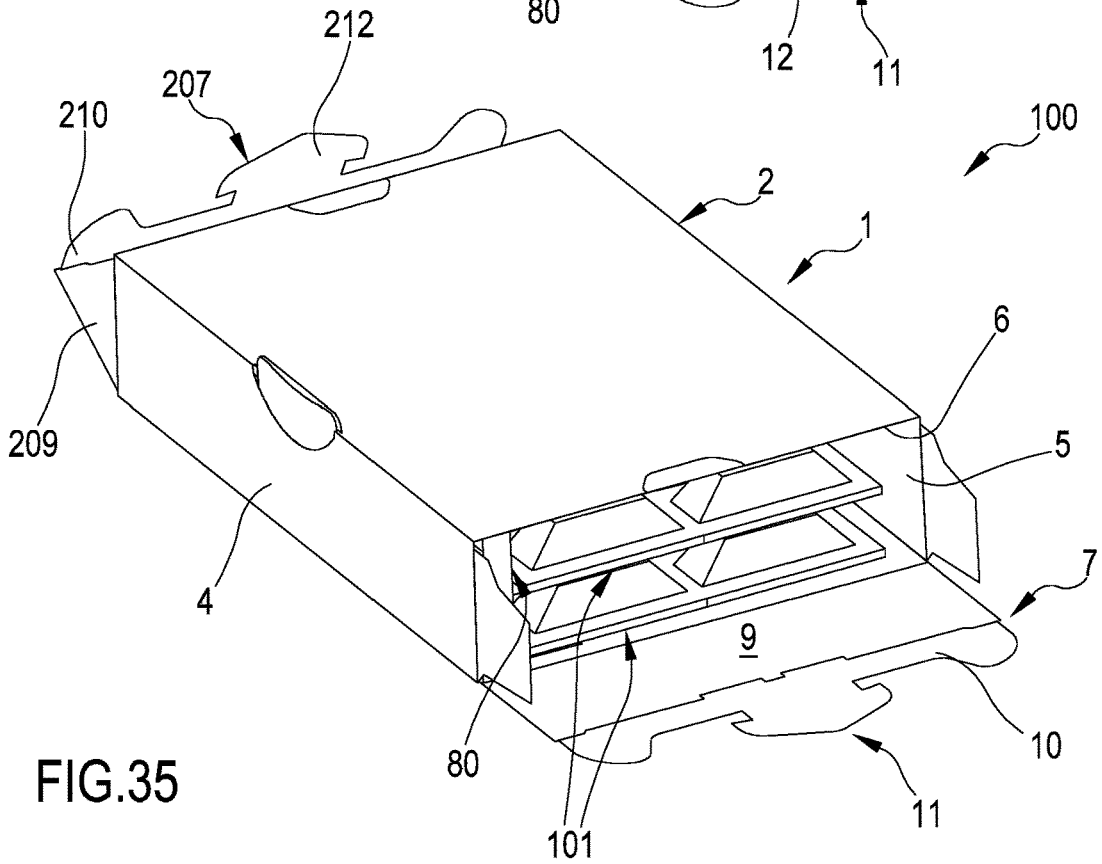
FIG.35

FIG.48
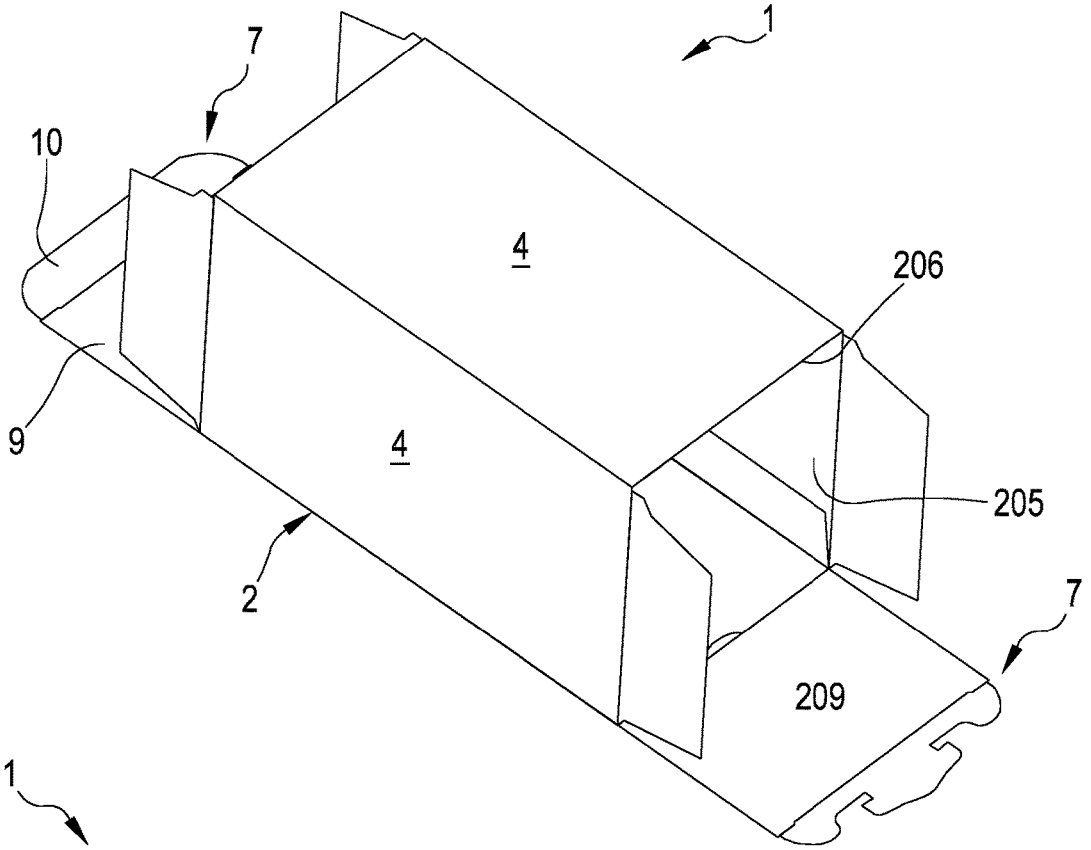
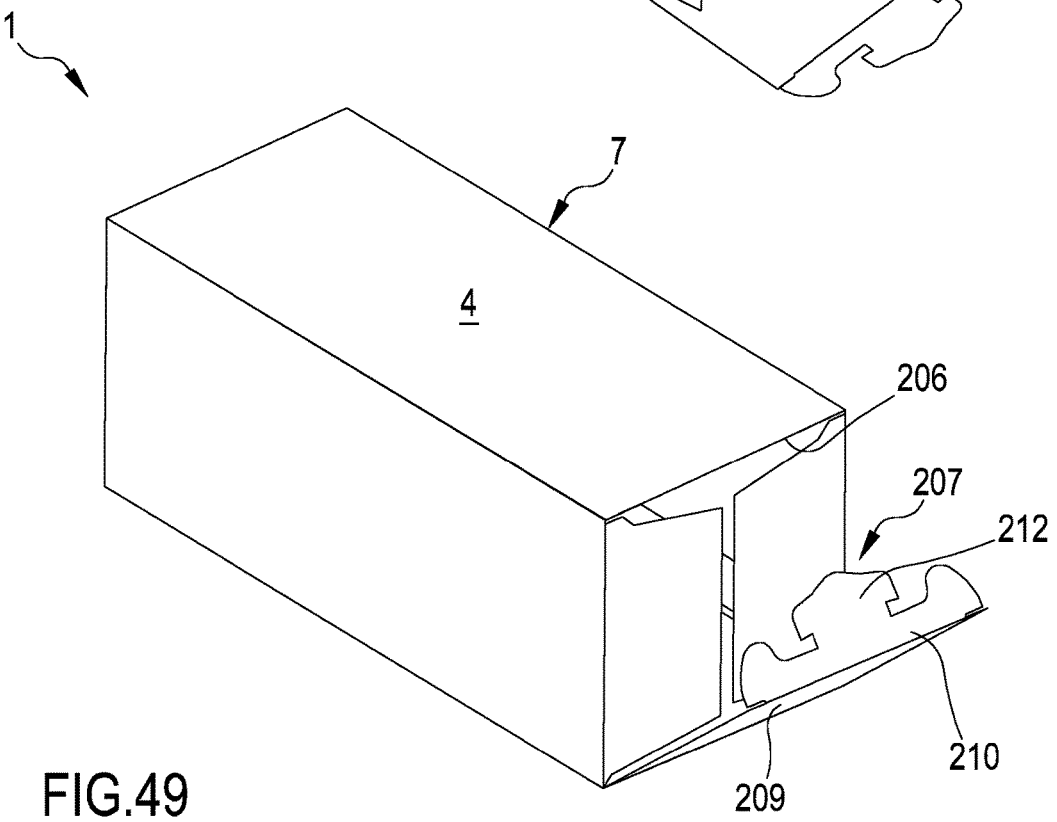
FIG.49

CONTAINER AND PROCESS OF MAKING THE SAME

CROSS-REFERENCE TO RELATED APPLICATION

This application claims priority under 35 U.S.C. § 119 to Italian Patent Application No. 102016000026083 filed on Mar. 11, 2016. The contents of this application is hereby incorporated by reference in its entirety.

TECHNICAL FIELD

The present invention relates to a container and a process of making the same.

BACKGROUND

As it is known, packages for containing drugs are commercially available. Generally, these packages comprise a box-shaped container of paper material having two accesses longitudinally opposed to each other. Generally, at each access, the container comprises a movable tab rotatable with respect to the container itself between an open configuration wherein the tab is distanced from the access and a closed condition wherein the tab is inserted into the container and occludes the access. The tab, in the closed condition of the container, has a "L" shape wherein an engagement portion of the tab itself inside the container faces and contacts a front wall of this latter. The presence of a closure system at the opposite longitudinal accesses of the container makes the container itself openable at two sides.

Generally, the interior of the container receives one or more blisters, each of them is configured for bearing a plurality of products, such as for example drugs as tablets or capsules. The blisters are configured for containing small-sized and lightweight products.

When the container is used for packaging blisters, the longitudinal closure systems are suitable to ensure a correct closure of the container and to prevent an accidental opening which will enable a blister to escape from the container itself.

These containers of paper material are often used for receiving products having size and weight greater than the ones of one or more blisters; for example, the paper material containers are actually used for receiving cosmetics flacons—for example perfumes or creams—and bottles of drugs. In such instances, the usual system for closing the container is not capable of ensuring to keep the closed condition: the flacon weight abutting on the closure system can open it and therefore can enable the product to accidentally escape from the container.

At the present it is known a solution enabling to solve such disadvantage, which comprises a box-shaped container of paper material having an upper opening and a lower opening. At the upper opening, the container comprises a closure system, as hereinbefore described, while at the lower portion, the container comprises two or more overlapped paper material tabs firmly constrained by glue. The container, described in this latter solution, comprises a locked bottom adapted to prevent the container bottom from accidentally opening.

However, the above described container is not devoid of limitations and disadvantages. De facto, it is noted that, for ensuring to stably close the bottom portion (lower portion) of the container, the same requires to apply glue between two or more overlapped tabs; the addition of the material for obtaining the container negatively impacts the costs of the same. Further, it is observed that applying the glue on one or more container tabs is an additional step of the process of making the same; such additional step negatively impacts the overall time for making the container and therefore, again, on the costs of the finished product.

SUMMARY

A first object of the present invention consists of providing a container having a simple and compact structure and which at the same can ensure to efficiently close the container itself. It is a further object of the present invention to provide a container having a highly flexible structure when used.

Then, it is an object of the present invention to provide a container which can be readily made with manufacturing low costs. Particularly, it is an object of the invention to make a container which does not require to modify existent plants used for making standard containers, in order to adapt them for making the container object of the present invention. Then, it is an object of the invention to provide a container which does not require to use different materials for making it; for example, the container can be made of paper material, optionally a biodegradable one.

Particularly, it is an object of the invention to provide a container enabling to insert one or more products through all the passage openings before finally closing it.

A further object of the present invention consists of providing a process of making a container which is fast and highly flexible, enabling therefore to minimize the manufacturing costs.

These and other objects, which will better appear in the following description, are substantially met by a container and associated process of making the same according to one or more of the attached claims and/or of the following aspects, considered alone or in any combination with each other or in combination with anyone of the attached claims and/or in combination with anyone of the further aspects or characteristics described in the following.

The aspects of the invention are described in the following.

In a 1st aspect, it is provided a container including a compartment of sheet material defining an inner volume configured for housing at least one product (P), the compartment having a predetermined number of lateral walls defining a passage opening delimited by a free edge, the compartment extending, along a longitudinal development direction, between a first and second longitudinal end portions, said passage opening being defined at said first longitudinal end portion.

In a 2nd aspect according to the preceding aspect, wherein the passage opening of the compartment defines a first passage opening, the lateral walls of the compartment further defining at least one second passage opening delimited by a respective free edge and placed at the second longitudinal end portion of the compartment.

In a 3rd aspect according to anyone of the preceding aspects, the container includes at least one occluding system of sheet material engaged at the free edge of at least one passage opening of the compartment, said occluding system being configured for irreversibly closing said opening, said occluding system being configured for preventing to gain access from the outside to the inner volume of the compartment through said second opening.

In a 4th aspect according to the preceding aspect, the container includes at least one occluding system of sheet material engaged at the free edge of the second passage opening of the compartment, said occluding system being configured for irreversibly closing the second passage opening, said occluding system being configured for preventing to gain access from the outside to the inner volume of the compartment through said passage opening.

In a 5th aspect according to anyone of the preceding aspects, the container is openable at the first passage opening of the compartment.

In a 6th aspect according to the aspect 4 or 5, the occluding system is configured for:

defining a starting initial condition, wherein the system enables a communication between the inner volume of the compartment and the outer environment through the second passage opening, defining a first closure condition wherein the occluding system irreversibly closes the second passage opening, the occluding system being configured for preventing to define an open configuration of the same following the first closure condition.

In a 7th aspect according to anyone of the aspects from 4 to 6, the occluding system includes at least one tab having a closing portion engaged to the free edge of the compartment and at least one inserting portion inserted inside the volume of the compartment, the occluding system further including:

at least one first hooking portion carried by the tab and placed inside the compartment, at least one second hooking portion engaged to the compartment and placed inside the inner volume, said second hooking portion being firmly engaged with said first hooking portion, the first and second hooking portions of the occluding system being firmly engaged to each other inside the compartment and being configured for irreversibly occluding the second passage opening of the compartment.

In an 8th aspect according to the preceding aspect, the first and second hooking portions are configured for firmly engaging with each other during a first closure condition of the occluding system, the first and second hooking portions of the occluding system, following the first closure condition, being irreversibly coupled to each other.

In a 9th aspect according to the aspect 7 or 8, the closing portion of the tab of the occluding system exhibits a shape delimited by a closed outer perimeter counter shaped and substantially identical to the second passage opening of the compartment, the closing portion of the occluding system completely covering the second passage opening of the compartment.

In a 10th aspect according to anyone of the aspects from 7 to 9, the closing portion of the occluding system is devoid of through openings.

In an 11th aspect according to anyone of the aspects from 7 to 10, the closing portion is joined in one piece to the inserting portion, the closing portion and inserting portion defining a body of sheet material exhibiting a substantially "L" shape, said closing portion and said inserting portion defining a single continuous body delimited by a closed outer single perimeter devoid of through openings defined inside said closed outer perimeter.

In a 12th aspect according to anyone of the aspects from 7 to 11, the first hooking portion of the occluding system extends in continuity with the inserting portion of the occluding system itself oppositely to the closing portion, the second hooking portion of the occluding system—in particular following the first closure condition of the occluding system—being interposed between the closing portion and first hooking portion of the occluding system itself.

In a 13th aspect according to anyone of the aspects from 7 to 12, the second hooking portion of the occluding system—in particular following the first closure condition of the occluding system—faces and is at least partially in contact with the inserting portion of the occluding system.

In a 14th aspect according to anyone of the aspects from 7 to 13, the first hooking portion of the occluding system exhibits at least one undercut firmly engaged, particularly irreversibly, with at least one respective undercut of the second hooking portion of the occluding system.

In a 15th aspect according to the preceding aspect, the undercut of the second hooking portion of the occluding system includes at least one hook defining a seat the concavity thereof faces the lateral wall of the compartment, particularly the front wall of the compartment.

In a 16th aspect according to the preceding aspect, the first hooking portion of the occluding system is firmly, particularly irreversibly, engaged inside the seat of the hook of the second hooking portion of the occluding system.

In a 17th aspect according to the aspect 15 or 16, the undercut of the first hooking portion of the occluding system includes at least one respective hook defining a seat the concavity thereof faces a concavity of the seat of the hook of the second hooking portion of the occluding system itself.

In an 18th aspect according to anyone of the aspects from 7 to 17, the second hooking portion of the occluding system substantially develops parallel to a lateral wall (4) of the container (1), particularly develops parallel to the lateral wall of the compartment and—optionally following the first closure condition of the occluding system—is directly facing the inserting portion of the occluding system.

In a 19th aspect according to anyone of the aspects from 7 to 20, the first hooking portion of the occluding system is directly carried and joined in one piece to the inserting portion of the occluding system itself, in particular the first hooking portion of the occluding system 6 joined in a one piece to the inserting portion without the presence of weakening portions.

In a 20th aspect according to anyone of the aspects from 7 to 19, the first hooking portion is placed oppositely to the closing portion of the tab with respect to said inserting portion.

In a 21st aspect according to anyone of the aspects from 7 to 20, the second hooking portion of the occluding system is directly engaged to a lateral wall of the compartment, particularly is directly engaged to the lateral wall of the compartment which—optionally following the first closure condition of the occluding system—is directly facing the inserting portion of the occluding system.

In a 22nd aspect according to anyone of the aspects from 7 to 21, the second hooking portion of the occluding system completely develops inside the inner volume of the compartment, particularly the second hooking portion of the occluding system is completely contained inside the volume of the compartment.

In a 23rd aspect according to anyone of the aspects from 7 to 22, the inserting portion of the occluding system—optionally following the first closure condition of the occluding system—is completely positioned inside the inner volume of the compartment.

In a 24th aspect according to anyone of the aspects from 7 to 23, the first hooking portion is completely contained inside the inner volume of the compartment, optionally said first hooking portion—optionally following the first closure condition of the occluding system—is placed completely inside the inner volume of the compartment and is spaced from the free edge of the second passage opening of the compartment.

In a 25th aspect according to anyone of the aspects from 7 to 24, the first and second hooking portions—optionally following the first closure condition of the occluding system—are spaced from the free edge of the second passage opening, particularly the first and second hooking portions are interposed between the free edge of the first opening and the freed edge of the second passage opening, optionally the first and second hooking portion are distinct from the free edge of the second passage opening.

In a 26th aspect according to anyone of the aspects from 7 to 25, the engagement between the second hooking portion and the first hooking portion of the same occluding system is completely defined inside the inner volume of the compartment.

In a 27th aspect according to anyone of the aspects from 7 to 26, the inserting portion of the occluding system—optionally following the first closure condition of the occluding system—is interposed between a lateral wall of the compartment directly facing said inserting portion and the second hooking portion of the occluding system itself.

In a 28th aspect according to anyone of the aspects from 7 to 27, the second hooking portion includes a tab of sheet material extending along a development plane, the tab of said hooking portion includes a body exhibiting a substantially "C" shape the concavity thereof faces away from the closing portion of the occluding system.

In a 29th aspect according to the preceding aspect, the tab of the second hooking portion of the occluding system is sloped with respect to the inserting portion facing said second hooking portion.

In a 30th aspect according to the aspect 28 or 29, the tab of the second hooking portion of the occluding system has an angle of inclination with respect to the inserting portion facing said second hooking portion less than 20°, optionally less than 10°.

In a 31st aspect according to anyone of the aspects from 28 to 30, the tab of the second hooking portion exhibits a substantially "C" shape, the concavity thereof defines the seat of the undercut of the second hooking portion itself.

In a 32nd aspect according to anyone of the aspects from 2 to 31, the container includes at least one closure system also made of sheet material, engaged at the free edge of the first passage opening, said closure system being movable, particularly by rotation, with respect to the compartment, the closure system being configured for defining at least one closure condition in which the closure system itself substantially occludes the first passage opening of the compartment and prevents the communication between the inner volume of the compartment and the outer environment, the closure system being further configured for defining an open configuration, in which the system itself enables the communication between the inner volume and outer environment.

In a 33rd aspect according to the preceding aspect, the closure system is opposite to the occluding system with respect to the compartment.

In a 34th aspect according to anyone of the preceding aspects, the container further includes an occluding system substantially identical to the occluding system engaged at the second opening of the compartment, said further occluding system being engaged at the free edge of the first passage opening and being configured for irreversibly closing the first passage opening, said further occluding system being configured for preventing the access from the outside to the inner volume of the compartment through said passage opening.

In a 35th aspect according to anyone of the aspects from 1 to 33, the container includes:

at least a closure system also made of sheet material, engaged at the free edge and movable, particularly by rotation, with respect to the compartment, the closure system being configured for defining at least one closure condition in which the closure system itself substantially occludes the passage opening of the compartment and prevents the communication between the inner volume of the compartment and the outer environment, the closure system being further configured for defining an open configuration in which the system enables the communication between the inner volume and the outer environment, at least one stop element placed inside the compartment between the passage opening and a longitudinal mid portion of the compartment defined between the first and second end portions of the compartment, said stop element emerging, from at least one lateral wall of the compartment, inside this latter for defining a projection.

In a 36th aspect according to the preceding aspect, the stop element is arranged at the first longitudinal end portion of the compartment, particularly at the passage opening of the compartment.

In a 37th aspect according to the aspect 35 or 36, the stop element exhibits a predetermined extension along the longitudinal development direction of the compartment the compartment exhibiting a predetermined longitudinal extension defined by a maximum distance between the first and second end portions and wherein the ratio of the predetermined longitudinal extension of the compartment to the predetermined longitudinal extension of the stop element is greater than 2, particularly greater than 3, still more particularly included between 3 and 10.

In a 38th aspect according to anyone of the aspects from 35 to 37, the stop element of the container includes a tab of sheet material extending along a plane parallel to the longitudinal development direction of the compartment In a 39th aspect according to anyone of the aspects from 35 to 38, the stop element extends from a lateral wall of the compartment to an opposite lateral wall, the stop element being connected, particularly directly connected and optionally joined in one piece, to two lateral walls of the compartment opposite to and facing each other.

In a 40th aspect according to anyone of the aspects from 35 to 39, the compartment along a section perpendicular to the longitudinal development direction of the compartment itself, exhibits a parallelogram shape, particularly a rectangular or square shape.

In a 41st aspect according to anyone of the aspects from 35 to 40, the compartment includes a front wall and a rear wall opposite and parallel to each other, the front wall and rear wall are connected to each other by means of a first and second lateral walls also opposite and parallel to each other.

In a 42nd aspect according to anyone of the aspects from 35 to 41, the stop element is interposed between the first and second lateral walls of the compartment In a 43rd aspect according to anyone of the aspects from 35 to 42, the stop element is spaced from the first and second lateral walls of the compartment In a 44th aspect according to anyone of the aspects from 38 to 42, the tab of the stop element extends along a plane substantially parallel to the first and second lateral walls of the compartment In a 45th aspect according to the aspect 42 or 43 or 44, the stop element is directly connected, at a side, to the front wall and, at an opposite side, to the rear wall of the compartment.

In a 46th aspect according to anyone of the aspects from 42 to 45, the container includes:

at least one stop element defined in correspondence of at least one of the first and second lateral walls of the compartment and/or at least one stop element placed at a transversal mid portion of the compartment defined between the first and second lateral walls of the compartment In a 47th aspect according to anyone of the aspects from 35 to 46, the stop element arranged at the first end portion of the compartment defines a first stop element, and wherein the container further includes at least one second stop element arranged at the second end portion of the compartment the first stop element being spaced and arranged in proximity of the first lateral wall, while the second stop element being spaced and arranged in proximity of the second lateral part of the compartment In a 48th aspect according to the preceding aspect, the second stop element is arranged at the second passage opening of the compartment In a 49th aspect according to the aspect 47 or 48, the second stop element exhibits a predetermined extension along the longitudinal development direction defined by a maximum distance between the first and second end portions, and wherein the ratio of the predetermined longitudinal extension of the compartment to the predetermined longitudinal extension of the second stop element is greater than 2, particularly greater than 3, still more particularly included between 3 and 10.

In a 50th aspect according to anyone of the aspects from 47 to 49, the second stop element of the container includes a tab of sheet material extending along a plane parallel to the longitudinal development direction of the compartment In a 51st aspect according to anyone of the aspects from 47 to 50, the second stop element extends from a lateral wall of the compartment to an opposite lateral wall, the second stop element being connected, particularly directly connected and joined in one piece to two lateral walls of the compartment opposite to and facing each other.

In a 52nd aspect according to anyone of the aspects from 47 to 51, the second stop element is interposed between the first and second lateral walls of the compartment In a 53rd aspect according to anyone of the aspects from 47 to 52, the second stop element is spaced from the first and second lateral walls of the compartment.

In a 54th aspect according to anyone of the aspects from 50 to 53, the tab of the stop element extends along a plane substantially parallel to the first and second lateral walls of the compartment.

In a 55th aspect according to the aspect 52 or 53 or 54, the second stop element is directly connected, at one side, to the front wall and, at an opposite side, to the rear wall of the compartment.

In a 56th aspect according to the aspect 32 or 33 or to anyone of the aspects from 34 to 55, the closure system includes at least one tab having a closing portion engaged to the free edge of the opening of the compartment, and movable, particularly by rotation, with respect to this latter, the tab further exhibiting at least one inserting portion configured for being inserted, in the closed configuration of the closure system, inside the volume of the compartment, and wherein the container includes at least one safety device of sheet material exhibiting:

at least one first hooking portion carried by the tab of the closure system, at least one second hooking portion engaged to the compartment and configured for cooperating with said first hooking portion, the first and second hooking portions being configured for firmly engaging with each other in the closed configuration of the closure system in order to define a safety condition, said first and second hooking portions, under the safety condition, are configured for preventing the closure system from switching from the closed configuration to the open configuration, wherein the container includes at least one slot configured for enabling, at least under the safety condition (e.g., closed configuration), to insert at least one opening device adapted to enable to disengage from each other the first and second hooking portions, and for therefore enabling the closure system to switch from the closed configuration to the open one, the safety device being further configured for enabling the first and second hooking portions to reversibly switch, following the open configuration of the closure system, to the safety condition.

In a 57th aspect according to the preceding aspect, the container includes at least one opening device configured for being inserted, at least under the safety condition, at least partially through the slot of the container for enabling to disengage from each other the first and second hooking portions and for enabling the closure system to switch from the closed configuration to the open one, particularly wherein the opening device being configured for being inserted, at least under the safety condition, inside the compartment between the first and second hooking portions in order to enable the disengagement.

In a 58th aspect according to the aspect 56 or 57, the closure system is configured for switching from the closed configuration to the open configuration when the opening device is interposed between said first and second hooking portions.

In a 59th aspect according to anyone of the aspects from 56 to 58, the first hooking portion exhibits at least one undercut configured for abutting, under the safety condition, against at least one respective undercut of the second hooking portion.

In a 60th aspect according to the preceding aspect, the undercut of the second hooking portion includes at least one hook defining a seat the concavity thereof faces a lateral wall of the compartment, particularly faces the front wall of the compartment, and wherein the first hooking portion of the safety device is configured for firmly engaging inside the seat of the hook of the second hooking portion in the closed configuration of the system.

In a 61st aspect according to the aspect 59 or 60, the undercut of the first hooking portion includes at least one respective hook defining a seat, the concavity thereof, under the safety condition, faces the concavity of the seat of the hook of the second hooking portion.

In a 62nd aspect according to anyone of the aspects from 56 to 61, the slot of the container is defined by:

at least one cutout carried by the closure system, particularly placed at the free edge and inserting portion of the closure system itself; and/or an aperture present between the inserting portion of the closure system and a lateral wall of the compartment carrying said second hooking portion.

In a 63rd aspect according to anyone of the aspects from 56 to 62, the second hooking portion develops substantially parallel to a lateral wall of the container, particularly develops parallel to the lateral wall of the compartment directly facing, in the closed configuration of the closure system, the inserting portion.

In a 64th aspect according to anyone of the aspects from 56 to 63, the first hooking portion is directly carried by and joined in one piece to the inserting portion, particularly the first hooking portion is arranged oppositely to the closing portion of the tab with respect to the inserting portion.

In a 65th aspect according to anyone of the aspects from 56 to 64, the second hooking portion is directly engaged to a lateral wall of the compartment, particularly is directly engaged to the lateral wall of the compartment directly facing, in the closed configuration of the closure system, the inserting portion.

In a 66th aspect according to anyone of the aspects from 56 to 65, the opening device includes a sheet element exhibiting a gripping portion from which at least one appendage emerges, configured for being inserted at least partially inside the slot said appendage being configured for being interposed, at least under the safety condition, between the first and second hooking portions of the safety device.

In a 67th aspect according to anyone of the aspects from 56 to 66, the second hooking portion develops completely inside the volume of the compartment, particularly the second hooking portion is completely received inside the volume of the compartment.

In a 68th aspect according to anyone of the aspects from 56 to 67, the inserting portion, in the closed configuration of the closure system, is completely placed inside the volume of the compartment, particularly the first hooking portion, in the closed configuration of the closure system, is completely received inside the volume of the compartment.

In a 69th aspect according to anyone of the aspects from 56 to 68, the first hooking portion, in the closed configuration of the closure system, being arranged completely inside the inner volume of the compartment and spaced from the free edge of the compartment.

In a 70th aspect according to anyone of the aspects from 56 to 69, the engagement of the second hooking portion with the first hooking portion is completely defined inside the volume of the compartment.

In a 71st aspect according to anyone of the aspects from 35 to 70, the container includes:

a second closure system engaged at the free edge of the second passage opening of the compartment, said second closure system being also made of sheet material and being engaged at the free edge of the second passage opening, said second closure system being movable, particularly by rotation, with respect to the compartment, the second closure system being configured for defining at least one closure condition in which the second closure system itself substantially occludes the second passage opening of the compartment and prevents the communication between the inner volume of the compartment and the outer environment, the second closure system being further configured for defining an open configuration in which the system itself enables the communication between the inner volume and the outer environment, the second closure system including at least one tab having a closing portion engaged to the free edge of the second passage opening of the compartment and movable, particularly by rotation, with respect to this latter, said tab further exhibiting at least one inserting portion configured for being inserted, in the closed configuration of the second closure system, inside the volume of the compartment, at least a further safety device of sheet material exhibiting:

at least one first hooking portion carried by the tab of the second closure system, at least one second hooking portion engaged to the compartment and configured for cooperating with said first hooking portion of the second closure system, the first and second hooking portions of the further safety device being configured for firmly engaging with each other in the closed configuration of the second closure system in order to define a safety condition, said first and second hooking portions of the further safety device, under the safety condition, are configured for preventing the second closure system from switching from the closed configuration to the open one, and wherein the second closure system includes at least one slot configured for enabling, at least under the safety condition, to insert at least one opening device adapted to enable the disengagement from each other of the first and second hooking portions of the further safety device, and for enabling therefore the second closure system to switch from the closed configuration to the open one, the further safety device being further configured for enabling the respective first and second hooking portions to reversibly switch, following the open configuration of the second closure system, to the safety condition.

In a 72nd aspect according to anyone of the preceding aspects, the opening device is configured for being inserted, at least under the safety condition, at least partially through the slot of the second closure system of the container for enabling to disengage from each other the first and second hooking portions of the further safety device, and for enabling the second closure system to switch from the closed configuration to the open one, particularly wherein the opening device being configured for being inserted, at least under the safety condition, inside the compartment between the first and second hooking portions of the further safety device in order to enable the disengagement.

In a 73rd aspect according to the aspect 71 or 72, the second closure system is configured for switching from the closed configuration to the open one only when the opening device is interposed between said first and second hooking portions of the further safety device.

In a 74th aspect according to anyone of the aspects from 71 to 73, the first hooking portion of the further safety device exhibits at least one undercut configured for abutting, under the safety condition, against at least one respective undercut of the second hooking portion of the further safety device.

In a 75th aspect according to the preceding aspect, the undercut of the second hooking portion of the further safety device includes at least one hook defining a seat the concavity thereof faces a directly connected lateral wall of the compartment, and said second hooking portion of the further safety device.

In a 76th aspect according to the preceding aspect, the first hooking portion of the further safety device is configured for firmly engaging inside the seat of the hook of the second hooking portion of the further safety device under the closing condition of the second closure system.

In a 77th aspect according to the aspect 75 or 76, the undercut of the first hooking portion of the further safety device includes at least one respective hook defining a seat the concavity thereof, under the safety condition, faces the concavity of the seat of the hook of the second hooking portion of the further safety device.

In a 78th aspect according to anyone of the aspects from 71 to 77, the slot of the second closure system is defined by:

at least one cutout carried by the second closure system, particularly arranged at the free edge of the second passage opening, and the inserting portion of the second closure system itself; and/or an aperture present between the inserting portion of the second closure system and a lateral wall of the compartment carrying said second hooking portion of the further safety device.

In a 79th aspect according to anyone of the aspects from 71 to 78, the second hooking portion substantially develops parallel to a lateral wall of the container.

In an 80th aspect according to anyone of the aspects from 71 to 79, the second hooking portion develops parallel to the lateral wall of the compartment, directly facing, under the safety condition of the second closure system, the inserting portion of this latter.

In an 81st aspect according to anyone of the aspects from 71 to 80, the first hooking portion of the further safety device is directly carried by and joined in one piece to the inserting portion of the second closure system, particularly the first hooking portion is arranged oppositely to the closing portion of the tab with respect to the inserting portion of the second closure system.

In an 82nd aspect according to anyone of the aspects from 71 to 81, the second hooking portion of the further safety device is directly engaged to a lateral wall of the compartment, particularly is directly engaged to the lateral wall of the compartment directly facing, in the closed configuration of the second closure system, the inserting portion of this latter.

In an 83rd aspect according to anyone of the aspects from 71 to 82, the opening device includes a sheet element exhibiting a gripping portion from which emerges at least one appendage configured for being inserted at least partially inside the slot of the second closure system, said appendage being configured for being interposed, at least under the safety condition, between the first and second hooking portions of the further safety device.

In an 84th aspect according to anyone of the aspects from 71 to 83, the second hooking portion of the further safety device develops completely inside the volume of the compartment, particularly said second hooking portion is completely received inside the volume of the compartment, and wherein the inserting portion of the closure system, in the closed configuration of this latter, is placed completely inside the volume of the compartment, particularly the first hooking portion of the further safety device, in the closed configuration of the second closure system, is completely received inside the volume of the compartment.

In an 85th aspect according to anyone of the aspects from 71 to 84, the first hooking portion, in the closed configuration of the second closure system, is completely arranged inside the inner volume of the compartment, and spaced from the free edge of the second passage opening of the compartment, particularly wherein the engagement between the second hooking portion with the first hooking portion of the further safety device is completely defined inside the volume of the compartment.

In an 86th aspect according to anyone of the aspects from 71 to 85, the second hooking portion of the further safety device develops substantially parallel to the extension plane of the base portion of the package.

In an 87th aspect according to anyone of the preceding aspects, the compartment is made of paper material, particularly is completely made of paper material.

In an 88th aspect according to anyone of the preceding aspects, the occluding system is made of paper material, particularly is completely made of paper material.

In an 89th aspect according to anyone of the preceding aspects, the occluding system is joined in one piece to the compartment, particularly the compartment and occluding system are made in one piece.

In a 90th aspect according to anyone of the aspects from 32 to 89, the closure system is made of paper material, particularly completely made of paper material.

In a 91st aspect according to anyone of the aspects from 32 to 90, the closure system is joined in one piece to the compartment, particularly the compartment and closure system are made in one piece.

In a 92nd aspect according to anyone of the aspects from 35 to 91, the stop element is made of paper material, particularly completely made of paper material.

In a 93rd aspect according to anyone of the aspects from 35 to 92, the stop element is joined in one piece to the compartment, particularly the compartment and stop element are made in one piece.

In a 94th aspect according to anyone of the aspects from 47 to 93, the second stop element is made of paper material, particularly completely made of paper material.

In a 95th aspect according to anyone of the aspects from 47 to 94, the second stop element is joined in one piece to the compartment, particularly the compartment and second stop element are made in one piece.

In a 96th aspect according to anyone of the aspects from 56 to 95, the safety device is made of paper material, particularly completely made of paper material.

In a 97th aspect according to anyone of the aspects from 47 to 96, the safety device is joined in one piece to the compartment, particularly the compartment and safety device are made in one piece.

In a 98th aspect according to anyone of the aspects from 71 to 97, the further safety device is made of paper material, particularly completely made of paper material.

In a 99th aspect according to anyone of the aspects from 71 to 98, the further safety device is joined in one piece to the compartment, particularly the compartment and further safety device are made in one piece.

In a 100th aspect, a package including a container according to anyone of the preceding aspects, is provided.

In a 101st aspect according to the preceding aspect, the package includes at least one wrapping housed at least partially inside the compartment containing at least one product, the wrapping being configurable between a first operative position wherein the wrapping itself is completely housed in the compartment of the container, and a second operative position wherein part of the wrapping is arranged outside the inner volume of the compartment, the wrapping, in the second operative position, exhibiting at least one portion housed in the inner volume of the compartment, the wrapping including at least one abutment element directly connected to a portion of the wrapping directly carrying the product, said abutment element, in the second operative position of the wrapping, being configured for abutting against the stop element of the container for preventing the wrapping from being completely extracted from the container.

In a 102nd aspect according to the preceding aspect, the wrapping includes a base portion of sheet material extending substantially along a plane and exhibiting a plurality of relieves, each relief defining a seat adapted to contain at least one product, said wrapping including at least one covering portion of sheet material arranged for closing the seat containing said products, the abutment element being directly carried by the base portion and/or the covering portion.

In a 103rd aspect according to the preceding aspect, the abutment element includes at least one projection directly connected to and emerging laterally from the base portion and/or from the covering portion of the wrapping, particularly the projection being made in one piece with the base portion and/or the covering portion of the wrapping.

In a 104th aspect according to the aspect 102 or 103, the extension plane of the tab of the stop element is transversal, particularly perpendicular, to the extension plane of the base portion of the wrapping.

In a 105th aspect according to the aspect 102 or 103 or 104, the extension plane of the tab of the second stop is transversal, particularly perpendicular, to the extension plane of this portion of the wrapping.

In a 106th aspect according to anyone of the aspects from 102 to 105, the wrapping includes a blister pack, the abutment element being directly defined on the blister pack directly carrying one or more products.

In a 107th aspect according to anyone of the aspects from 103 to 106, the container includes at least one stop element defined at and spaced from the first lateral wall of the compartment, the base portion of the compartment being interposed between said stop element and second lateral wall of the compartment, the projection emerges laterally from the base portion towards the first lateral wall, said projection of the abutment element, in the second operative position of the wrapping, being configured for abutting against said stop element defined at and spaced from the first lateral wall of the compartment for preventing the wrapping from being completely extracted from the container.

In a 108th aspect according to anyone of the aspects from 102 to 107, the container includes a first stop element defined at and spaced from the first lateral wall of the compartment and a second stop element defined at and spaced from the second lateral wall of the compartment, the base portion of the wrapping being interposed between said first and second stop elements, and wherein the abutment element of the wrapping includes a first and second projections emerging laterally from the base portion respectively towards the first and second lateral walls, said first and second projections of the abutment element, being opposite to each other with respect to the base portion of the wrapping, said first and second projections of the abutment element, in the second operative position of the wrapping, being configured for abutting respectively against said first and second stop elements for preventing the wrapping from being completely extracted from the container.

In a 109th aspect according to anyone of the aspects from 103 to 108, the projection of the abutment element includes a tab joined in one piece to the base portion and/or to the closing portion of the wrapping, particularly the projection is joined in one piece to the base portion directly carrying said products.

In a 110th aspect according to anyone of the aspects from 103 to 109, the projection of the abutment element includes a first portion emerging from an outer perimeter of the base portion and a second portion joined in one piece to the first portion of said abutment element, the second portion of the projection of the abutment element emerging from said first portion in order to define a body having a substantially "L" shape, the stop element of the container, in the second operative position of the wrapping, being:

in abutment against the first portion of said abutment element, and interposed between the base portion and second portion of said abutment element.

In a 111th aspect according to anyone of the aspects from 102 to 110, the base portion of the wrapping includes a first and second longitudinal bodies spaced from and parallel to each other, said first and second longitudinal bodies being placed parallel to the longitudinal development direction of the compartment, said first and second longitudinal bodies being engaged with each other, at one longitudinal end portion, by means of a connecting body facing the second end portion of the compartment, the first longitudinal body, the second longitudinal body and the connecting body integrally defining a base portion in one piece exhibiting a substantially "C" shape, the container including a stop element arranged at a transversal mid portion of the compartment arranged between the first and second lateral walls of the compartment, said stop element being interposed between the first and second longitudinal bodies, the connecting body defining said abutment element, configured for abutting, in the second operative position of the wrapping, against said stop element interposed between the first and second longitudinal bodies for preventing the wrapping from being completely extracted from the container.

In a 112th aspect, the process for making a container according to anyone of the aspects from 1 to 111, is provided.

In a 113th aspect according to the preceding aspect, the process includes the following steps:

providing at least one first sheet, particularly of paper material, with a flat configuration, said first sheet including at least one first and one second portions interconnected by a central connecting portion, the first sheet further including at least one first and one second lateral connecting portions, the first portion being interposed between the first lateral connecting portion and the central connecting portion, the second portion being interposed between the central connecting portion and second lateral connecting portion, each of said portions including at least one first and one second longitudinal edges opposite to each other and a first and second end edges opposite to each other, the first end edges of the portions of the first sheet defining a first end edge of said first sheet, the second end edges of the portions of the first sheet defining a second end edge of said first sheet, said portions, central connecting portion and said lateral connecting portions being joined along the longitudinal edges and aligned along a single connecting direction, folding the first sheet along the longitudinal edges of the portions of the same first sheet in order to define the compartment exhibiting at least one opening at the first end portion of the compartment.

In a 114th aspect according to the preceding aspect, wherein the step of folding the first sheet defines, by means of the opposite end edges of the first sheet itself the first and second passage openings of the compartment.

In a 115th aspect according to the aspect 113 or 114, the process includes the following steps:

providing a second sheet, particularly of paper material, with a flat configuration, said second sheet being connected to the first end edge of the first portion of the first sheet, the second sheet including a first and second portions joined in one piece to each other, the first portion of the second sheet being interposed between the first portion of the first sheet and the second portion of the second sheet, folding the second sheet in order to define the closure system at the first opening of the compartment, particularly the folding step being performed following the step of folding the first sheet and in order to define said compartment.

In a 116th aspect according to anyone of the aspects from 113 to 115, the process includes the following steps:

providing a third sheet, particularly of paper material, having a flat configuration, said third sheet being connected to the second end edge of the first portion of the first sheet, the third sheet including a first and second portions joined in one piece to each other, the first portion of the third sheet being interposed between the first portion of the first sheet, and the second portion of the third sheet, providing a first lower sheet, particularly of paper material, having a flat configuration, said first lower sheet being connected to the second end edge of the second portion of the first sheet, the first lower sheet including a first portion and a second portion, the third sheet and first lower sheet being arranged on the same end edge of the first sheet opposite to the second sheet, providing a second lower sheet, particularly of paper material, having a flat configuration, said second lower sheet including at least one portion joined in one piece to the second portion of the third sheet, the second portion of the third sheet being interposed between the first portion of the same third sheet, and the portion of the second lower sheet, folding the first sheet along the longitudinal edges of the portions of the same first sheet in order to define said compartment, folding the first and second lower sheets with respect to the first sheet in order to define said occluding system.

In a 117th aspect according to the preceding aspect, the portion of the second lower sheet defines the first hooking portion of the occluding system.

In a 118th aspect according to the aspect 116 or 117, the third sheet and second lower sheet are integrally joined in order to define a single body, the third sheet and/or second lower sheet being devoid of openings crossing the sheet itself.

In a 119th aspect according to anyone of the aspects from 116 to 118, the step of folding the first lower sheet with respect to the first sheet includes at least the following sub-steps:

folding the first lower sheet above the second portion of the first sheet, constraining, optionally by pasting, the second portion of the first lower sheet to the second portion of the first sheet, folding the first portion of the first lower sheet, with respect to the second portion of the first lower sheet itself away from the second portion of the first sheet, in order to define the second hooking portion of the occluding system.

In a 120th aspect according to anyone of the aspects from 116 to 119, following the step of folding the first lower sheet, the process includes the following steps:

folding the first sheet along the longitudinal edges of the portions of the same first sheet for defining said compartment, following the step of folding the first sheet, folding the second portion of the third sheet with respect to the first portion of the same third sheet, folding the third sheet with respect to the first sheet, inserting the second portion of the third sheet and the portion of the second lower sheet inside the compartment defined by the first sheet, the portion of the second lower sheet defining the first hooking portion of the occluding system, coupling the first and second hooking portions, defined respectively by the first portion of the first lower sheet and by the portion of the second lower sheet, inside the compartment for defining said occluding system.

In a 121st aspect according to anyone of the aspects from 112 to 120, the process further includes a step of:

providing the compartment of sheet material, particularly of paper sheet material, providing the closure system of sheet material, particularly of paper sheet material, engaged at the free edge of the compartment, making at least inside the compartment, at least one stop element according to anyone of the aspects from 35 to 55, particularly a stop element arranged between the passage opening and a longitudinal mid portion of the compartment defined between the first and second defined end portions of the compartment, said stop element emerging, from at least one lateral wall of the compartment, inside this latter for defining a projection.

In a 122nd aspect according to the preceding aspect, the step of making the stop element includes at least the following sub-steps:

providing at least one first lateral sheet connected to a longitudinal edge of the first lateral connecting portion of the first sheet, the first lateral sheet being joined in one piece to the first sheet and being opposite to the first portion of the first sheet with respect to the first lateral connecting portion, said first lateral sheet including at least one first, one second and one third portions joined in one piece to each other, the first portion of the first lateral sheet being joined in one piece to the first lateral connecting portion of the first sheet, the second portion of the first lateral sheet being interposed between the first and third portions of the first lateral sheet itself, folding the first lateral sheet on the first sheet so that at least the second and third portions of the first lateral sheet are overlapped on and in contact with the first portion of the first sheet, constraining, for example by pasting, the third portion of the first lateral sheet to the first portion of the first sheet, folding the central connecting portion and second portion of the first sheet above the first portion of the first sheet and above the first lateral sheet, constraining, for example by pasting, the first portion of the first lateral sheet to the second portion of the first sheet, constraining, for example by pasting, the second lateral connecting portion to the first lateral connecting portion of the first sheet, folding the first sheet along the longitudinal edges of the portions of the same first sheet, during the step of folding the first sheet the same enables to fold the portions of the first lateral sheet with respect to each other, following the step of folding the first sheet, this latter defines the compartment while the first lateral sheet defines the stop element inside the compartment.

In a 123rd aspect according to the aspect 121 or 122, the step of making the stop element further includes at least the following sub-steps:

providing at least one second lateral sheet connected to a longitudinal edge of the first lateral connecting portion of the first sheet, the second lateral sheet being joined in one piece to the first sheet and being opposite to the first portion of the first sheet itself with respect to the first lateral connecting portion, said second lateral sheet including at least one first, one second and one third portions joined in one piece to each other, the first portion of the second lateral sheet being joined in one piece to the first lateral connecting portion of the first sheet, the second portion of the second lateral sheet being interposed between the first and third portions of the second lateral sheet itself, the first portion of the second lateral sheet being arranged at least partially around an outer perimeter of the first lateral sheet, folding the fourth sheet on the first sheet so that at least the second and third portions of the second lateral sheet are overlapped on and in contact with the first portion of the first sheet, constraining, for example by pasting, the third portion of the second lateral sheet to the first portion of the first sheet, folding the central connecting portion and second portion of the first sheet above the first portion of the first sheet and above the second lateral sheet, constraining, for example by pasting, the first portion of the second lateral sheet to the second portion of the first sheet, constraining, for example by pasting, the second lateral connecting portion to the first lateral connecting portion, folding the first sheet along the longitudinal edges of the portions of the same first sheet, when folding the first sheet, the same enables to fold the portions of the second lateral sheet with respect to each other, following the step of folding the first sheet, this latter defines the compartment while the second lateral sheet defines the stop element or the second stop element inside the compartment.

In a 124th aspect according to anyone of the aspects from 112 to 123, including a step of providing the safety device, which provides at least the following sub-steps:

providing a first upper sheet connected to the first end edge of the second portion of the first sheet, the first upper sheet including a first portion and second portion, folding said first upper sheet, constraining, for example by pasting, the first upper sheet to said second portion of the first sheet, folding said first portion of the first upper sheet with respect to said second portion of the same end sheet for defining the second hooking portion of the safety device.

In a 125th aspect according to the preceding aspect, the step of providing the safety device further includes a step of providing a second upper sheet having a flat configuration, which includes at least one portion joined in one piece to the second portion of the second sheet, the second portion of the second upper sheet being configured for defining the first hooking portion of the safety device.

In a 126th aspect according to the aspect 124 or 125 including a step of providing the open device, which provides at least the following sub-steps:

defining on the first lateral connecting portion of the first sheet a cutout or a weakening line defining a third lateral sheet, said third lateral sheet being shaped in order to define a single portion defining the gripping portion from which the appendage of the opening device emerges, defining a through opening at the longitudinal edge of the second lateral portion of the first sheet in contact with the second portion of the first sheet, such through opening defining a pocket on the lateral wall of the compartment adapted to enable to extract the opening device.

In a 127th aspect according to the preceding aspect, the inner sheet is joined in one piece to the first lateral connecting portion of the first sheet.

In a 128th aspect according to the aspect 126 or 127, the step of providing the opening device provides a step of separating the inner sheet from the first sheet in order to define said opening device distinct and separable from the compartment.

In a 129th aspect according to anyone of the aspects from 112 to 128, the process includes at least the following steps:

providing a fourth lateral sheet having a flat configuration and joined in one piece to the first lateral connecting portion of the first sheet, the fourth lateral sheet including a first and second portions joined in one piece to each other, the first portion of the fourth sheet being joined in one piece to the first connecting portion of the first sheet and being interposed between the second portion of the fourth lateral sheet and the first connecting portion of the first sheet, folding said fourth lateral sheet, before the step of folding the first sheet, in order to overlap the first portion of the first lateral sheet of the fourth lateral sheet on the first lateral portion of the first sheet, providing the second portion of the fourth lateral sheet above and in contact with the first portion of the fourth lateral sheet itself, constraining, particularly by pasting, the second lateral connecting portion of the first sheet to the first lateral connecting portion of the first sheet.

In a 130th aspect according to anyone of the aspects from 115 to 129, the step of providing the second sheet provides making at least one cutout on the same sheet in order to define the slot of the container.

In a 131st aspect according to the preceding aspect, the cutout is made on the first and/or second portions of the first end sheet.

In a 132nd aspect according to the aspect 130 or 131, the cutout is made at a delimiting transversal edge between the first and second portions of the second sheet, the slot being configured for being crossed at least partially by said opening device.

In a 133rd aspect, a process for making a package according to anyone of the aspects from 100 to 111 is provided, said process including at least the following sub-steps:

providing a container, particularly according to anyone of the aspects from 1 to 99 and according to the making process according to anyone of the aspects from 112 to 132, providing at least one wrapping, inserting completely the wrapping in the inner volume of the compartment, arranging the closure system in the closed configuration.

In a 134th aspect according to the preceding aspect, the compartment includes the first and second passage openings, the container exhibiting, at the first passage opening, the closure system and, at the second passage opening, the occluding system, said process including the following steps:

defining the compartment wherein the first and second passage openings enable the communication between the inner volume of the compartment and the outer environment, completely inserting the wrapping in the inner volume of the compartment through the second passage opening, arranging the closure system in the closed configuration, defining the occluding system adapted to irreversibly close the second passage opening.

DESCRIPTION OF DRAWINGS

Some embodiments and some aspects of the invention will be described in the following with reference to the attached drawings, given only in an indicative and therefore non limiting way, wherein:

FIG. 1 is a perspective view of a first embodiment of a package;

FIG. 2 is a schematic cross-section view of the package in FIG. 1;

FIG. 3 is a further perspective view of the package according to FIGS. 1 and 2;

FIG. 4 is a top view of a blank for obtaining a container;

FIG. 5 is a perspective view of a second embodiment of the package;

FIG. 6 is a cross-section schematic view of the package in FIG. 5;

FIG. 7 is a further perspective view of the package according to FIGS. 5 and 6;

FIG. 8 is a top view of a blank for making a container;

Figure 13:
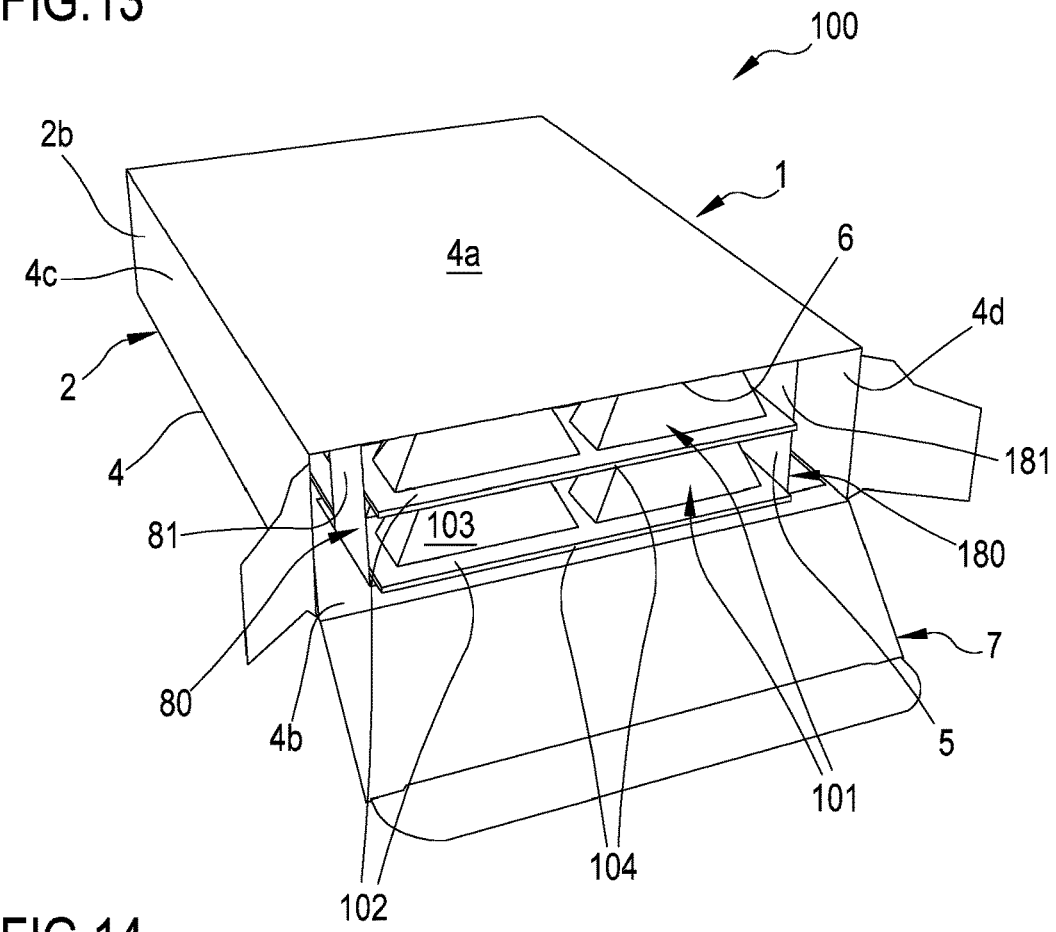
Figure 14:
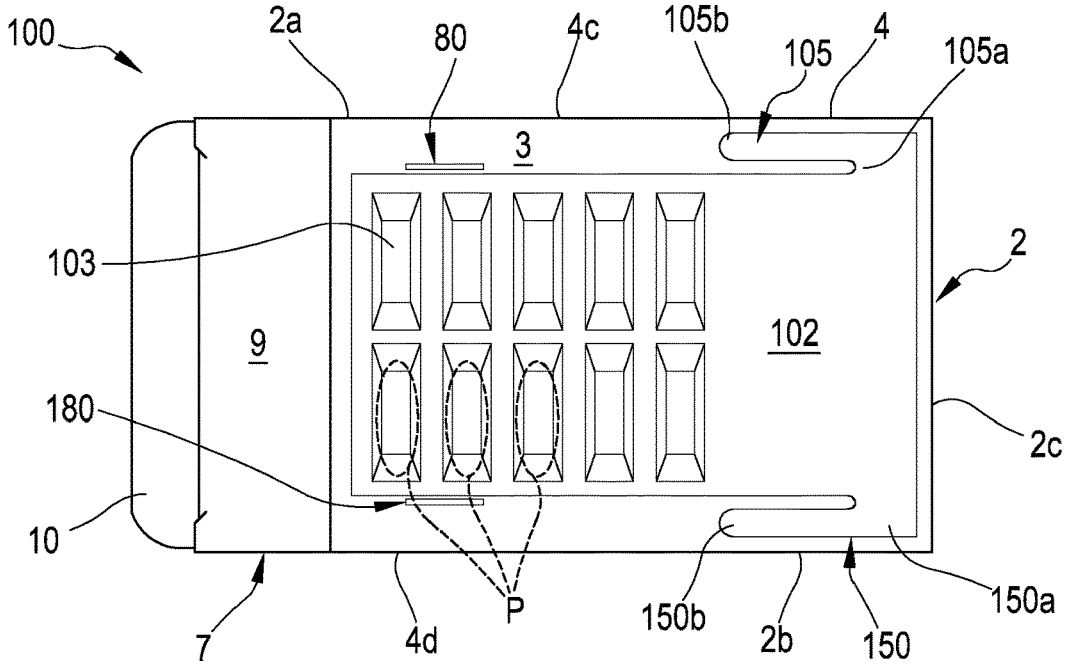
Figure 15:
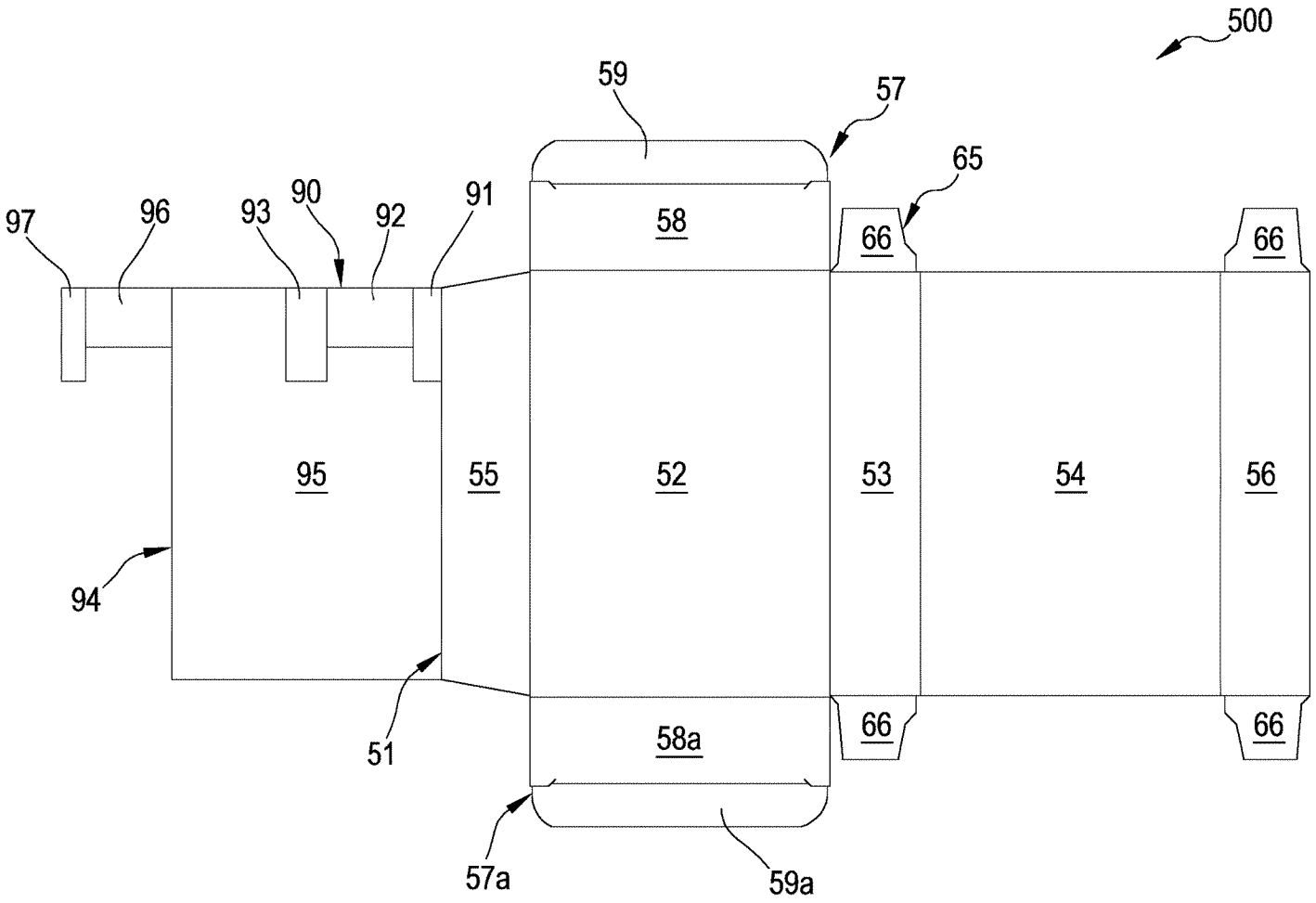
Figure 16:
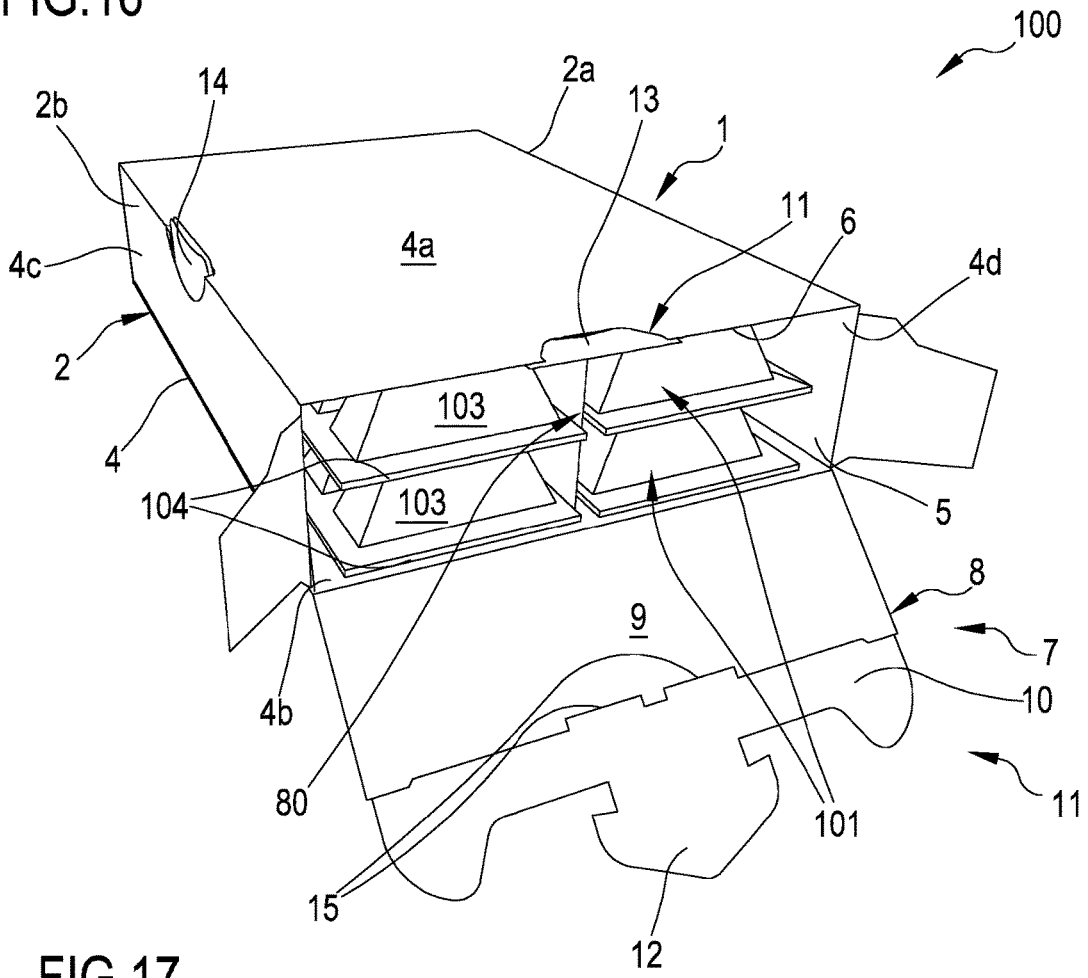
Figure 17:
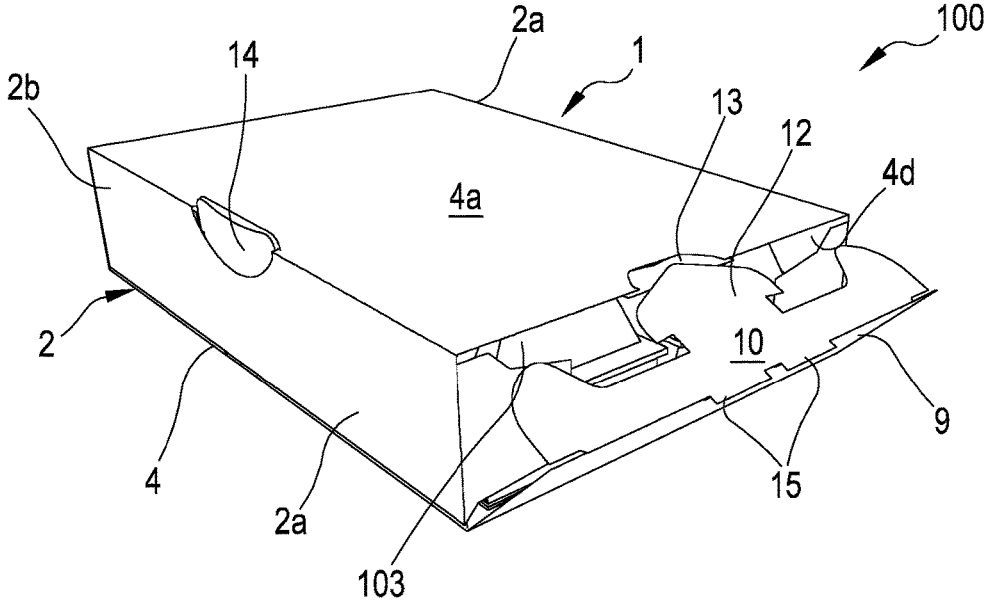
Figure 18:
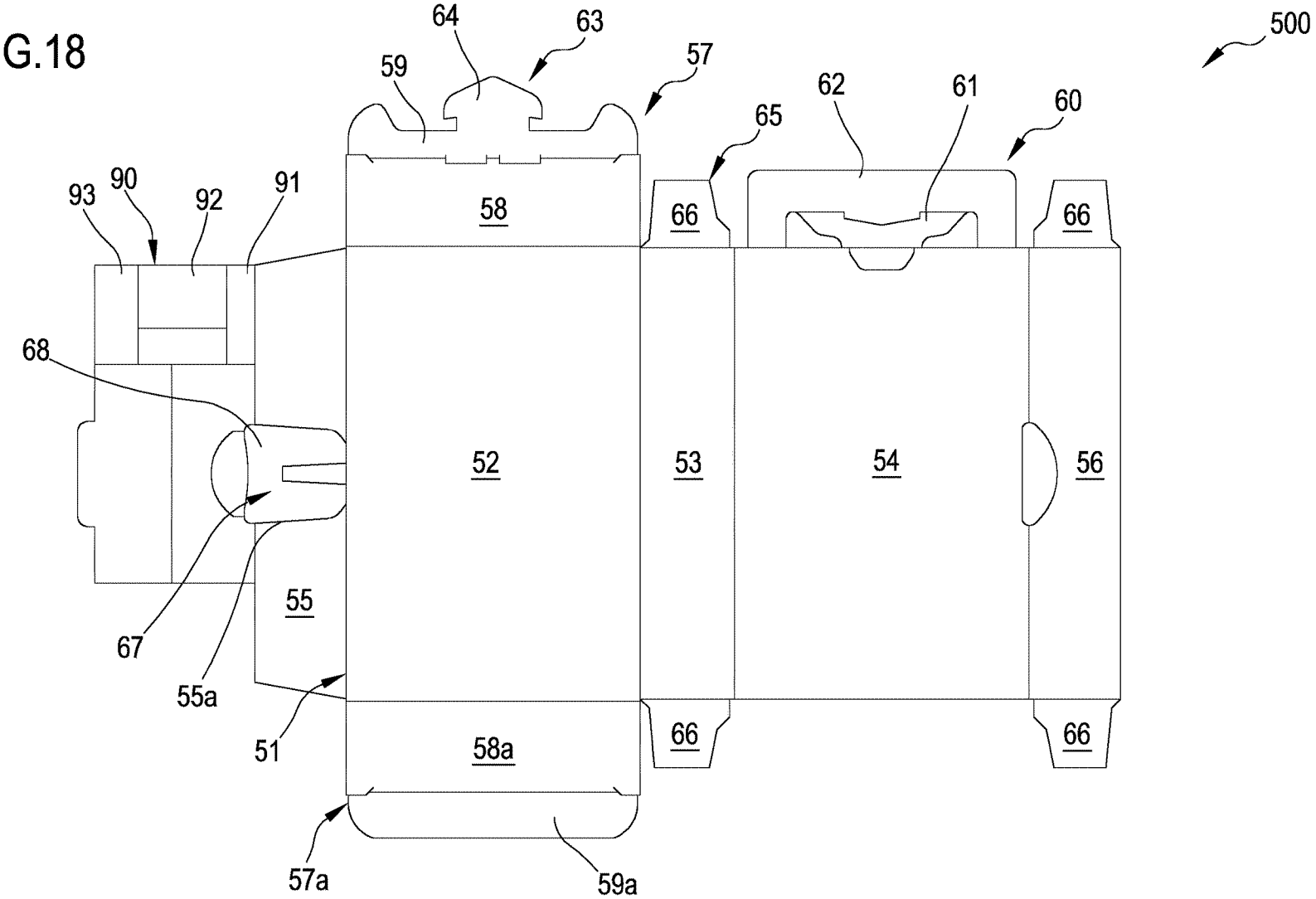
Figure 19:
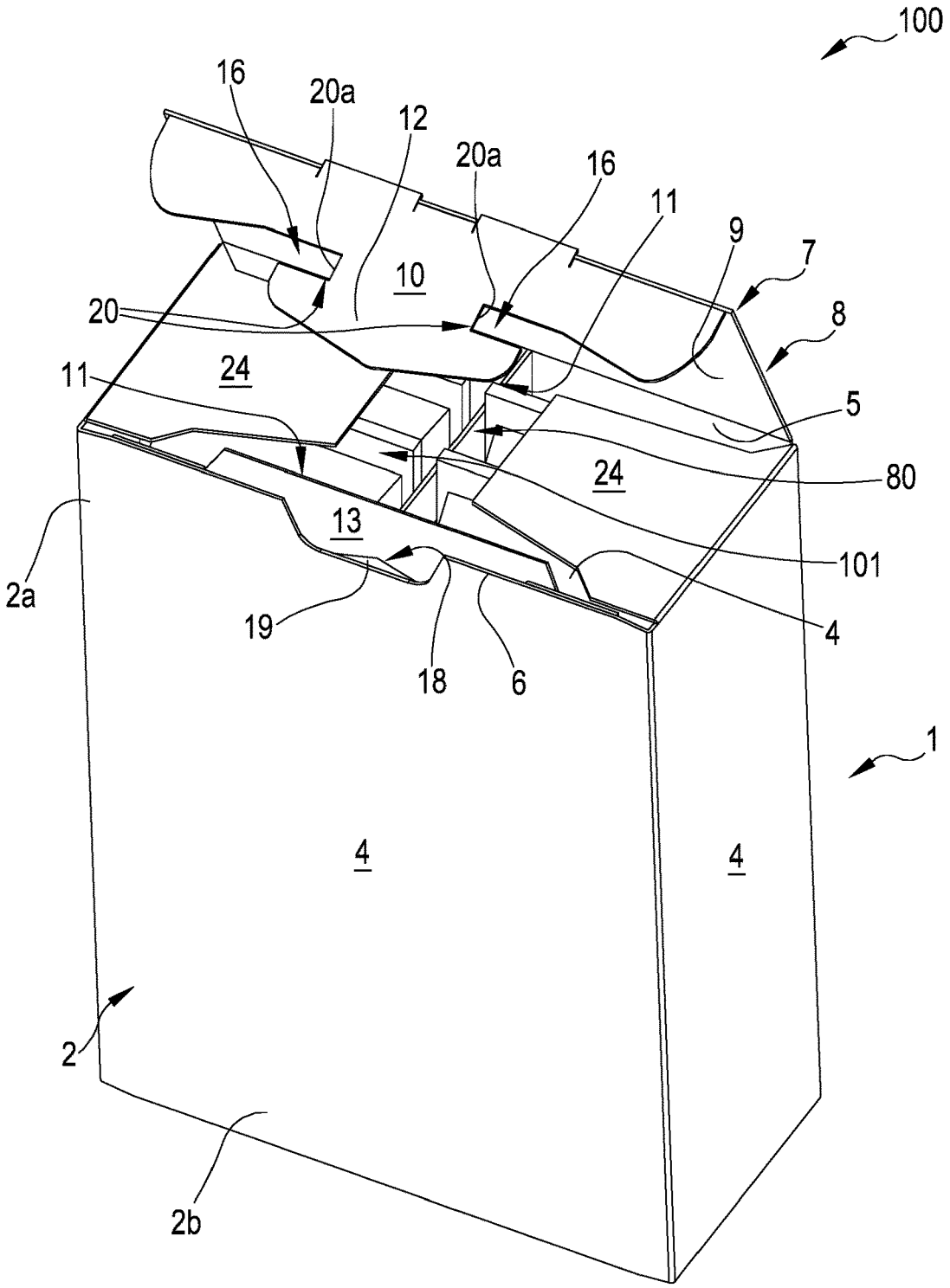
Figure 21:
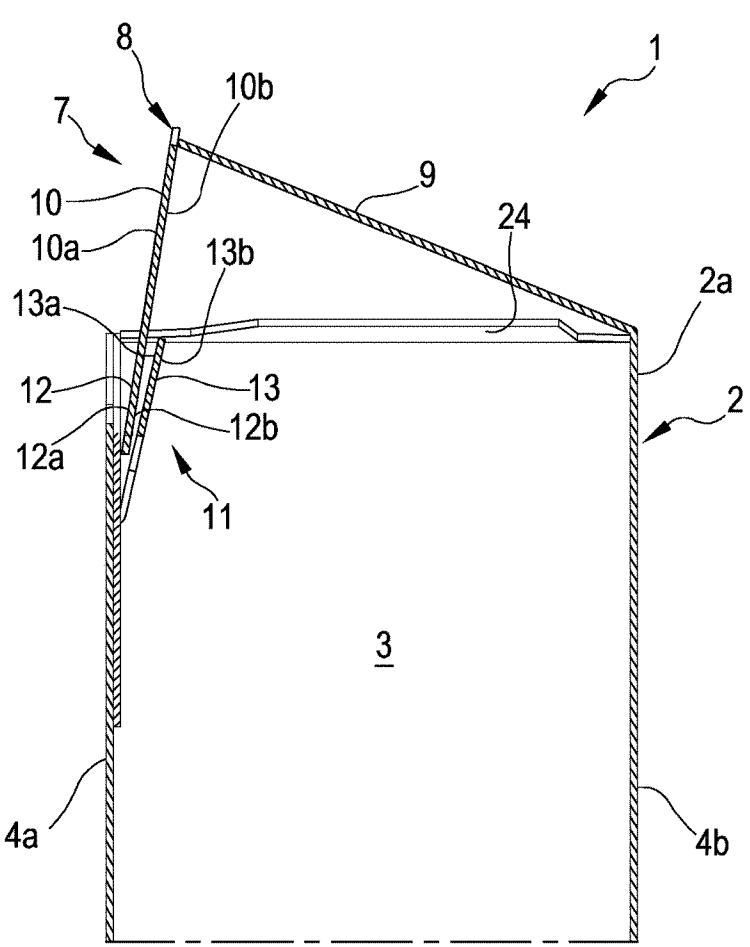
Figure 20:
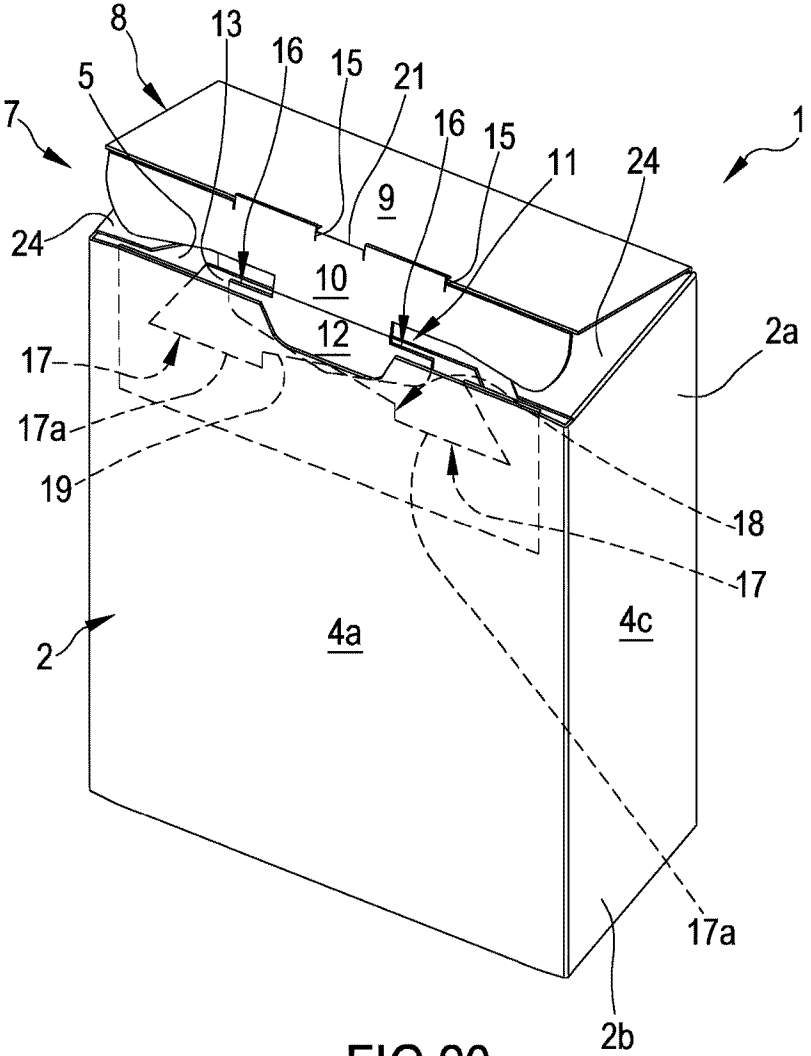
Figure 29:
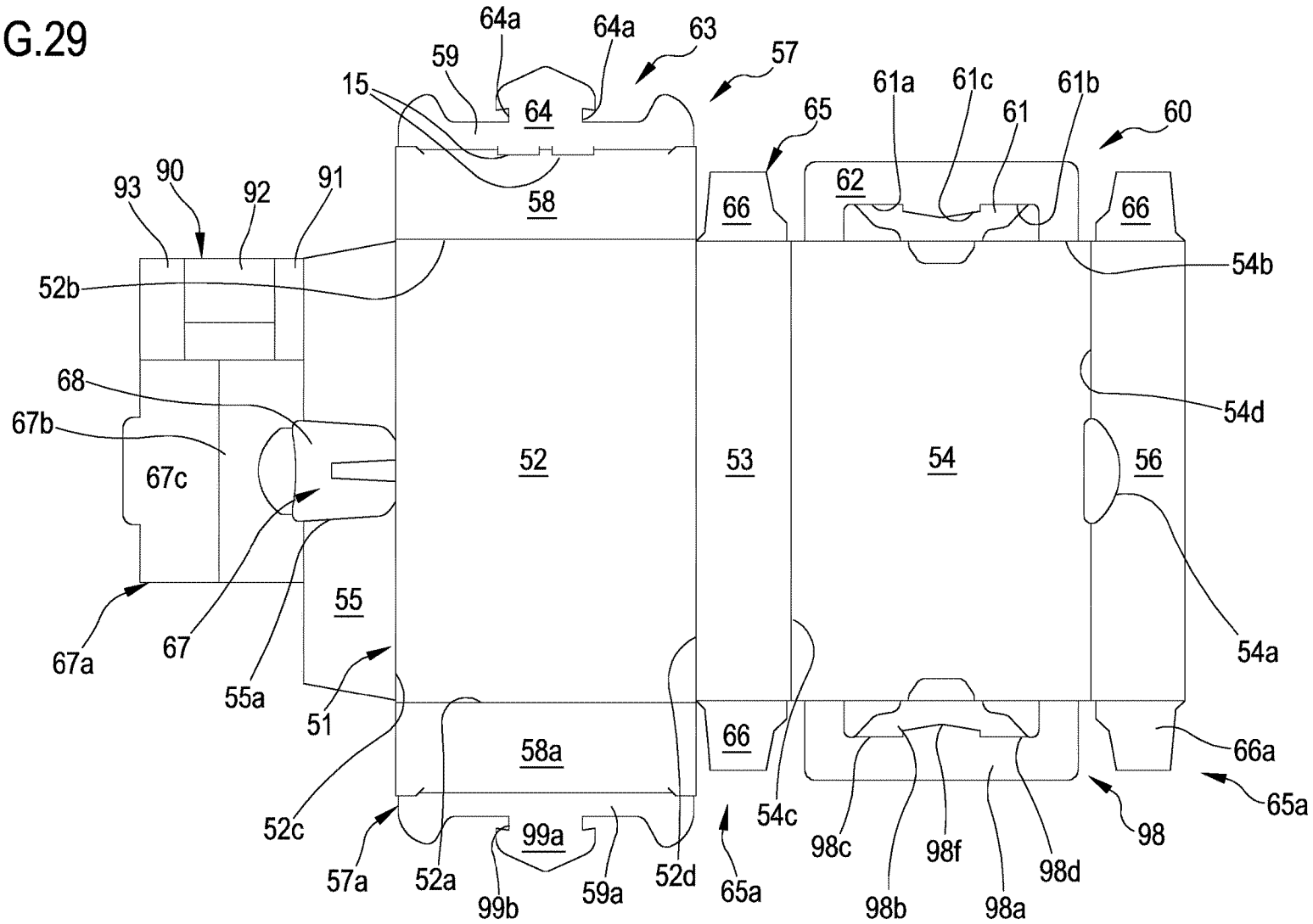
Figure 36:
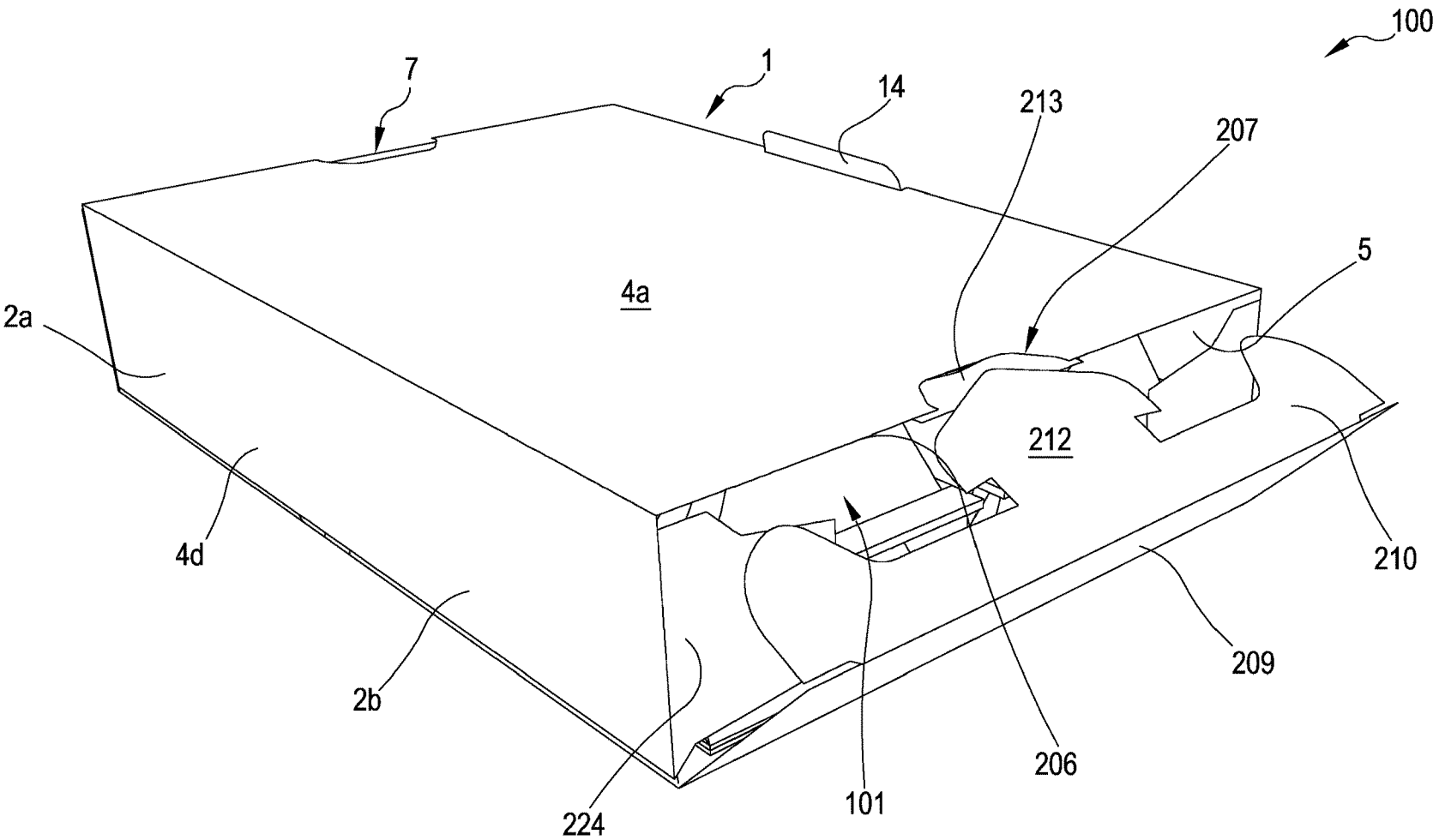
Figure 38:
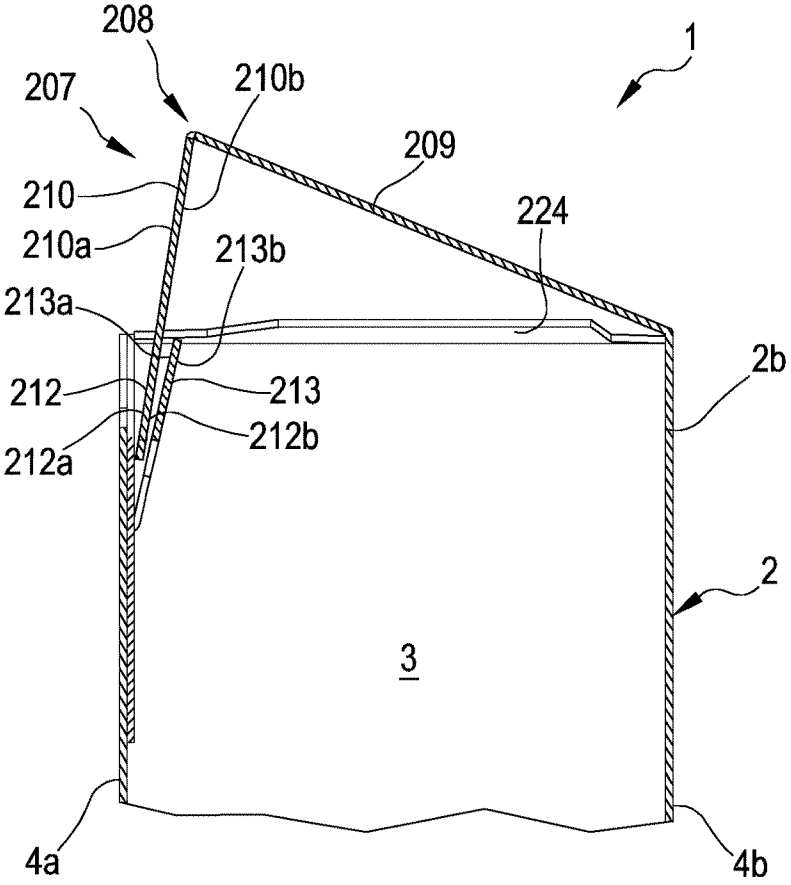
Figure 37:
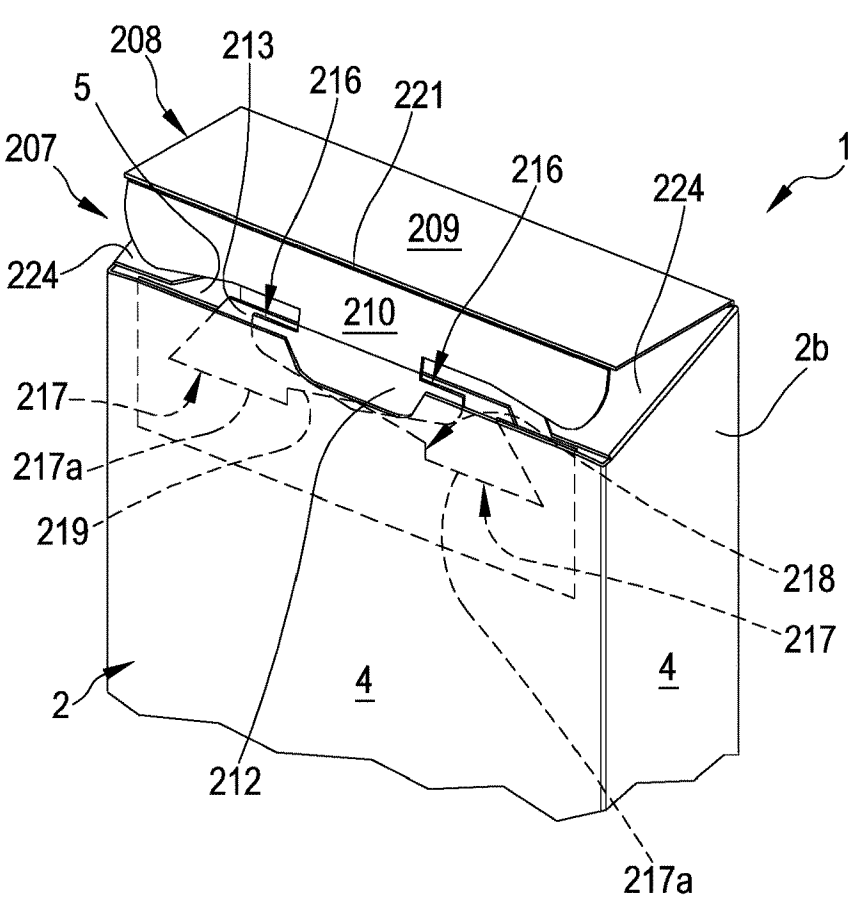
Figure 38A:
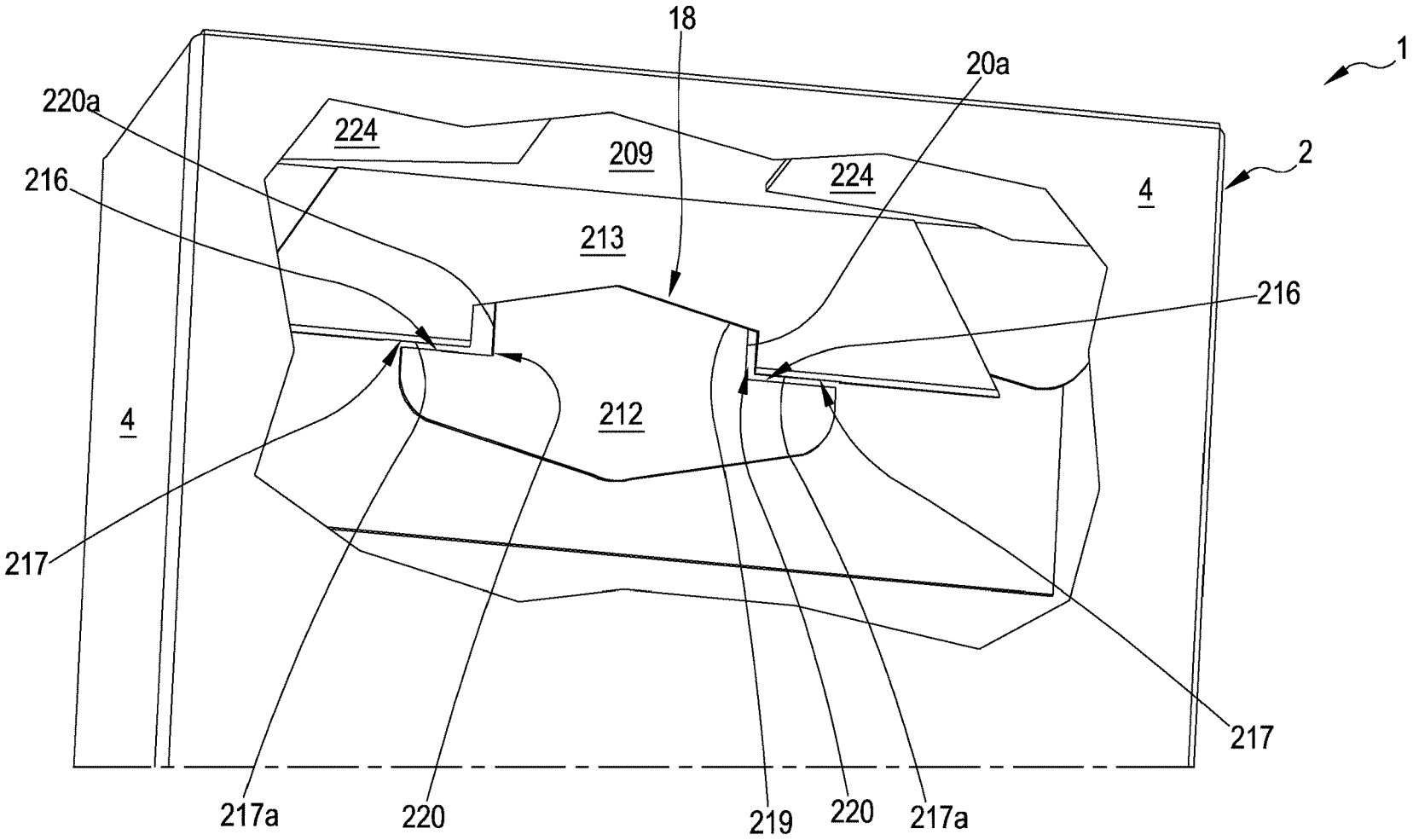
Figure 38B:
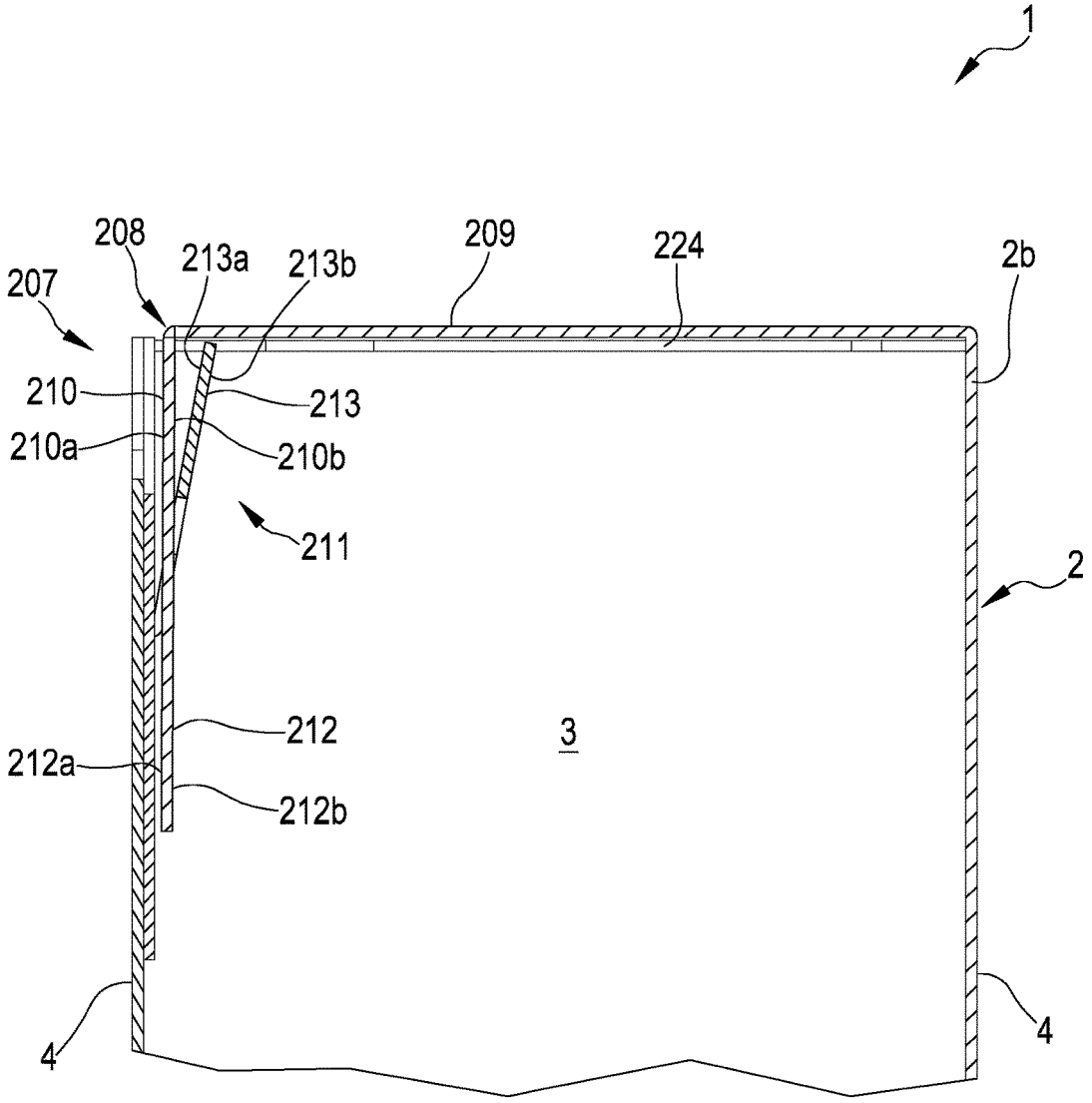
Figure 39:
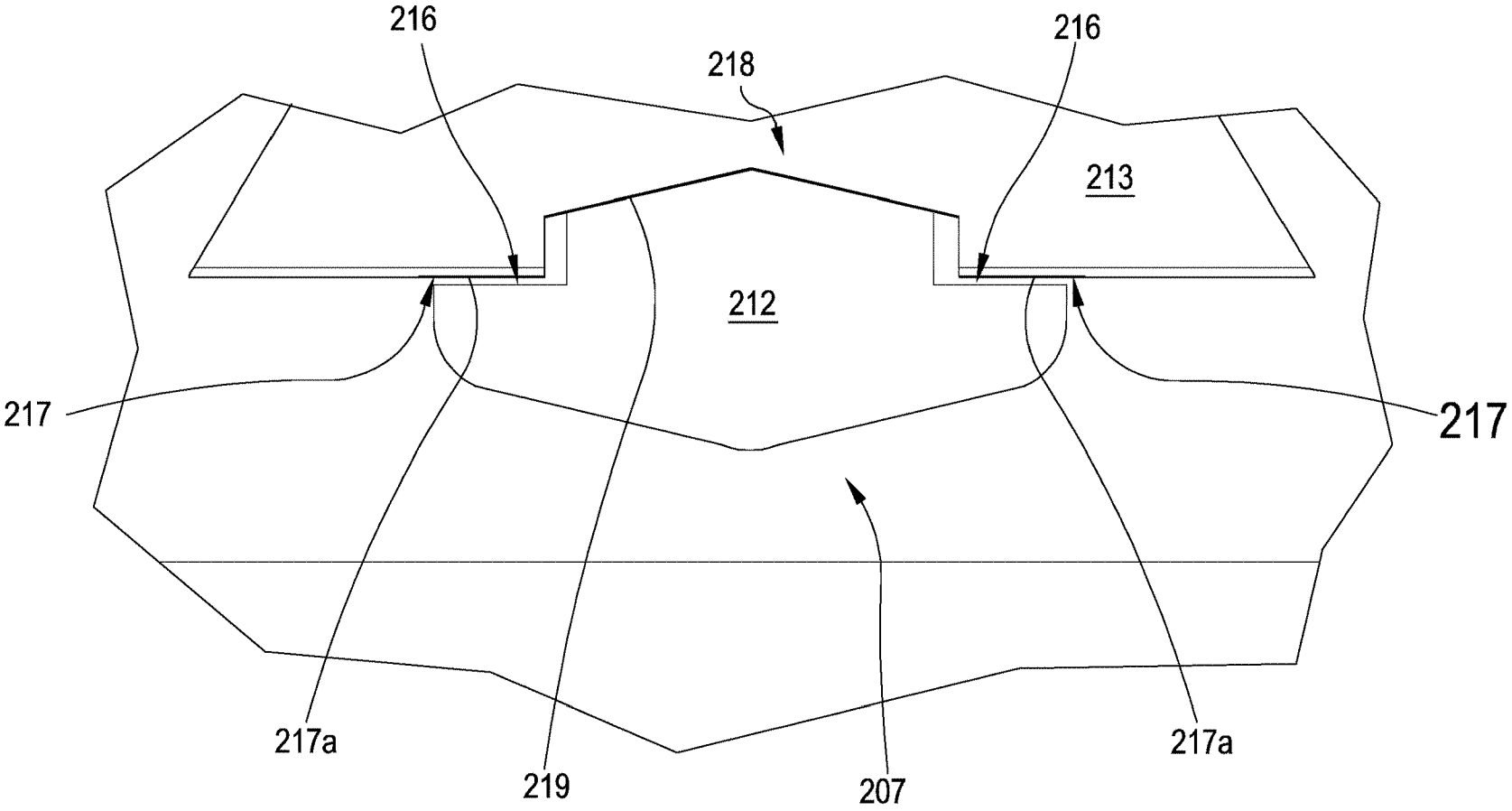
Figure 41:
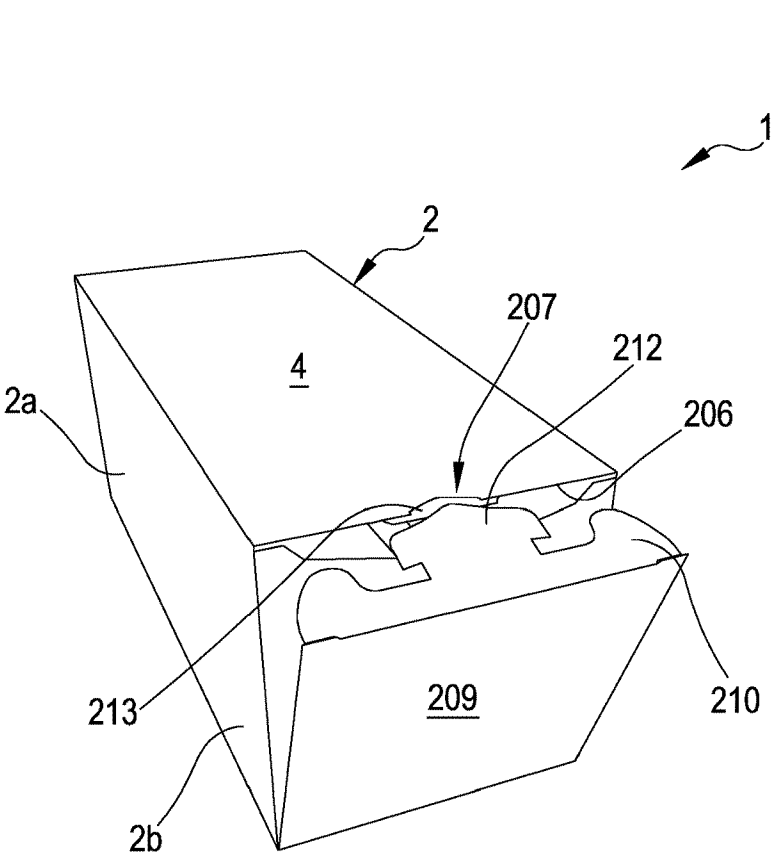
Figure 40:
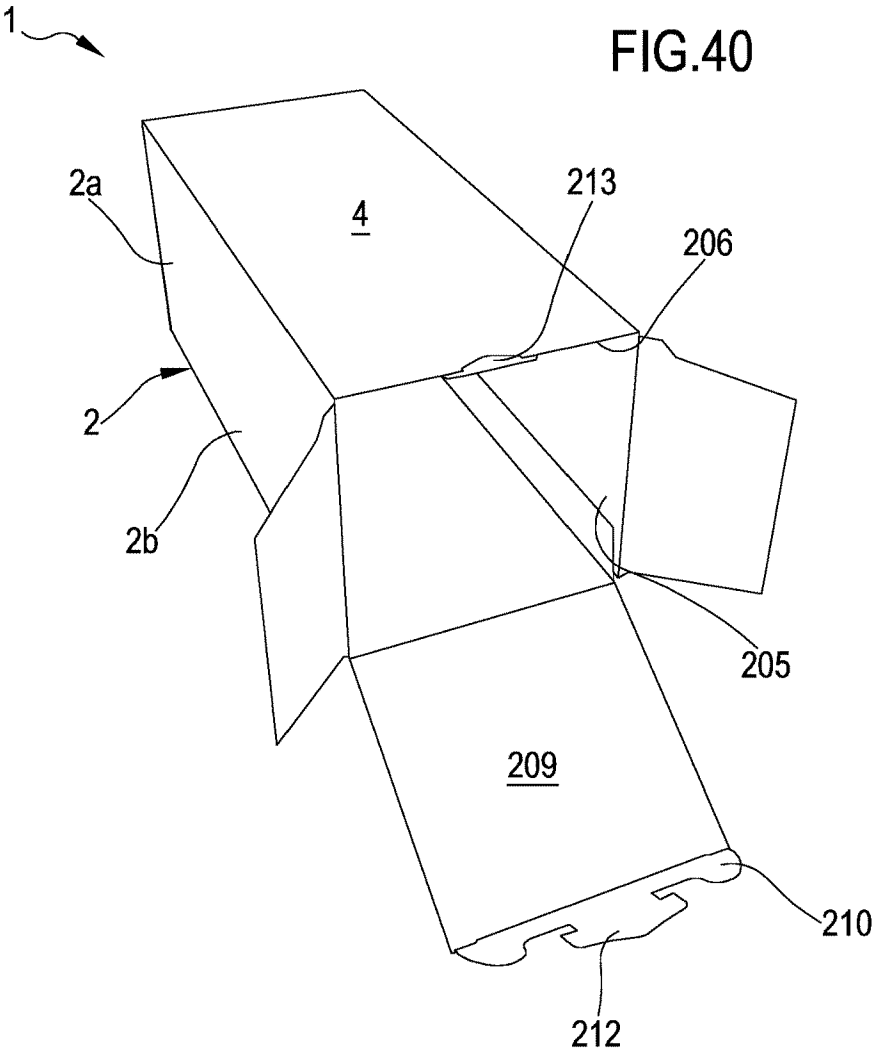
Figure 42:
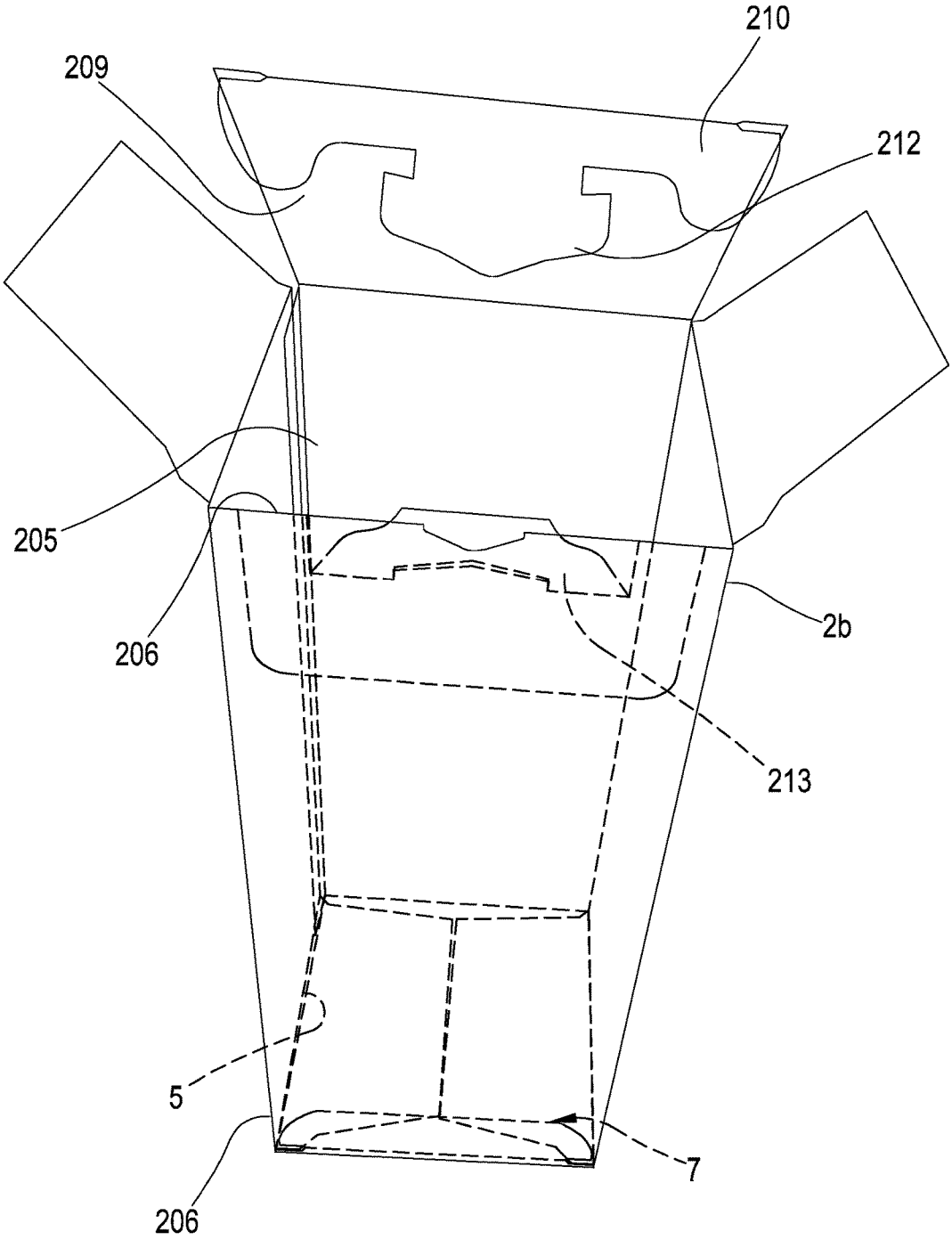
Figure 43:
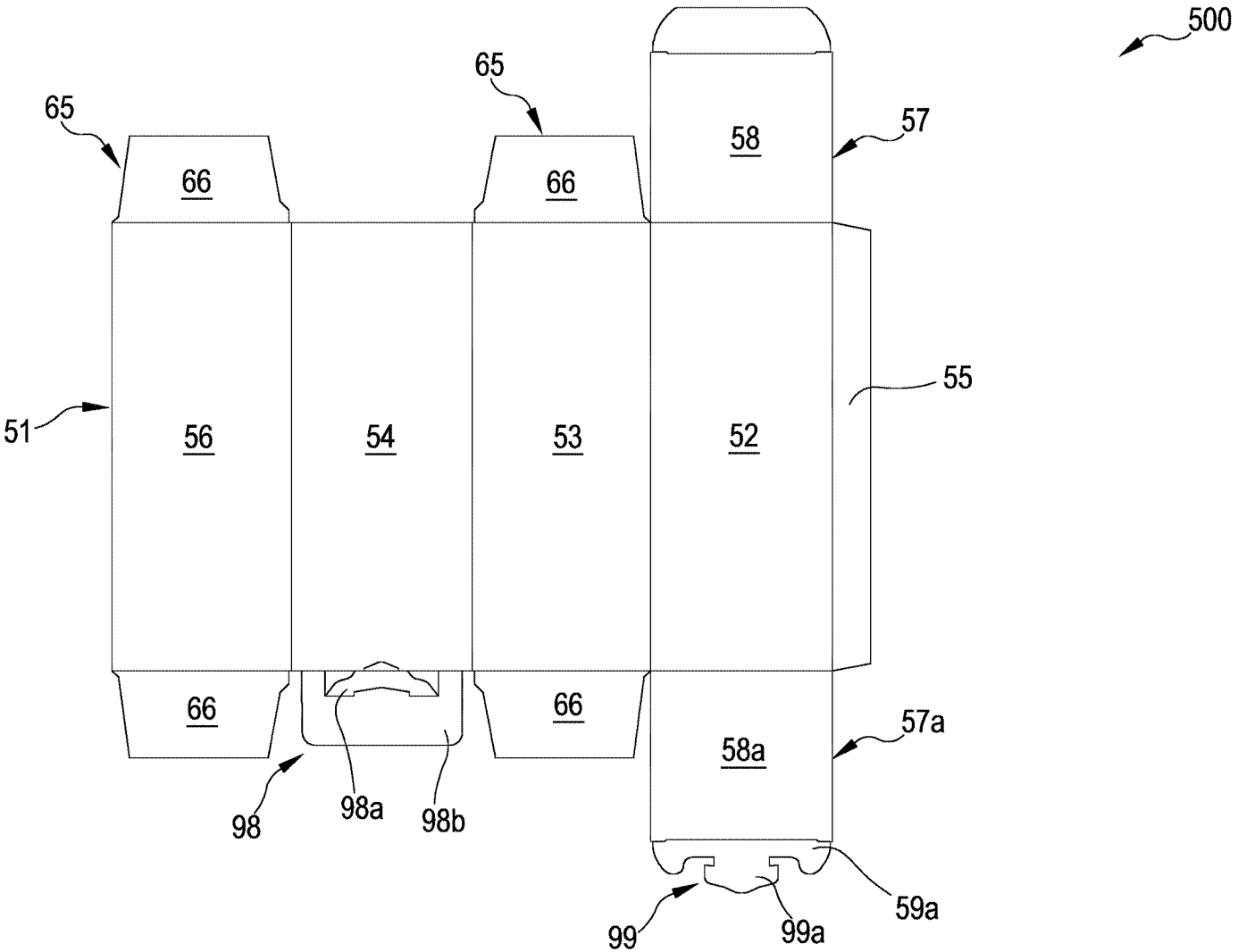
Figure 44:
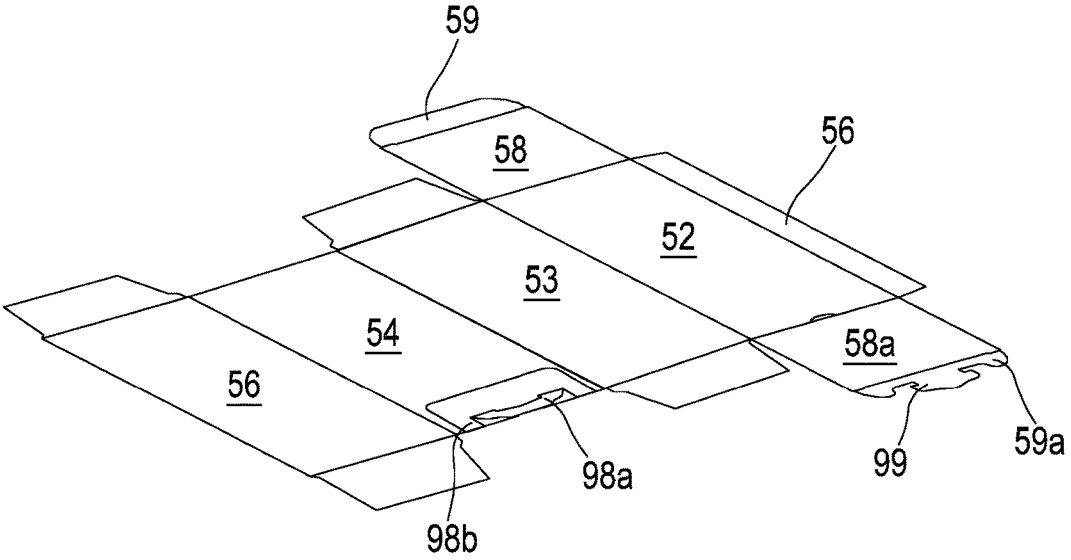
Figure 45:
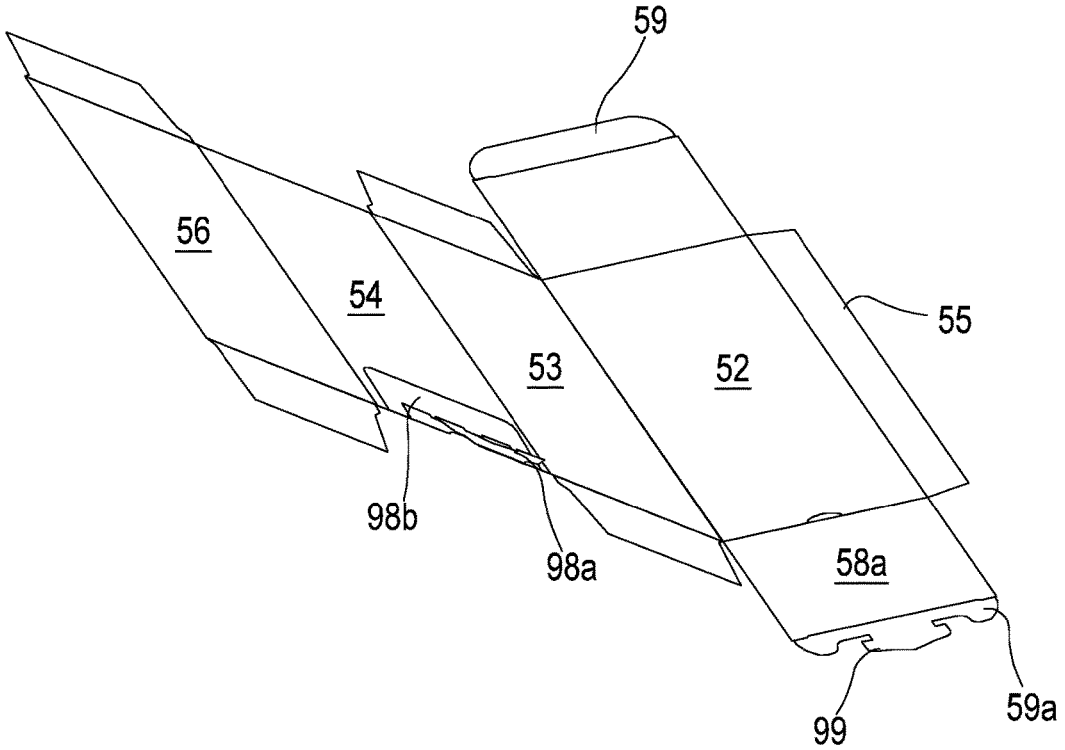
Figure 46:
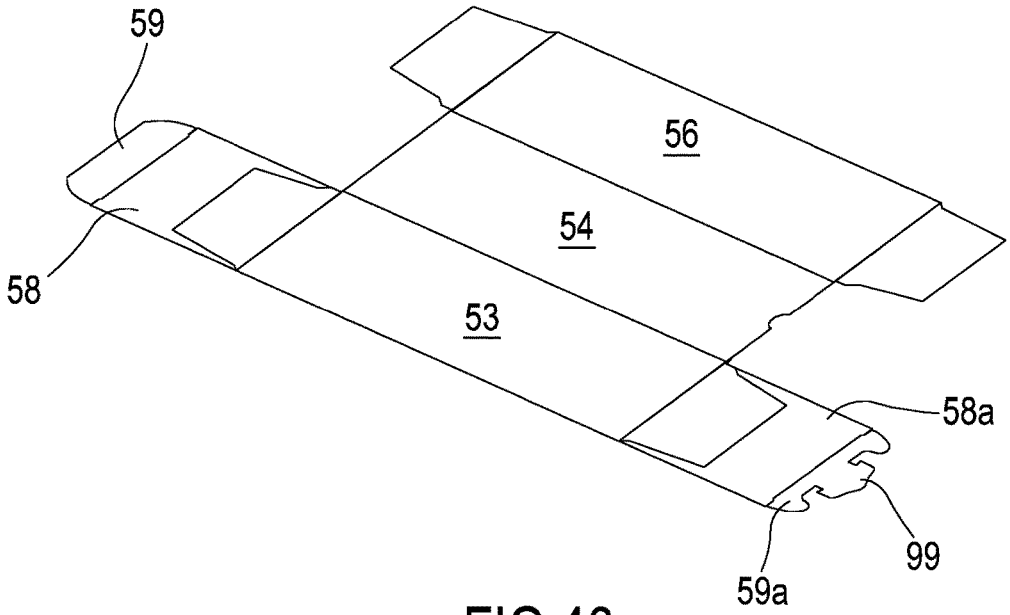
Figure 47:
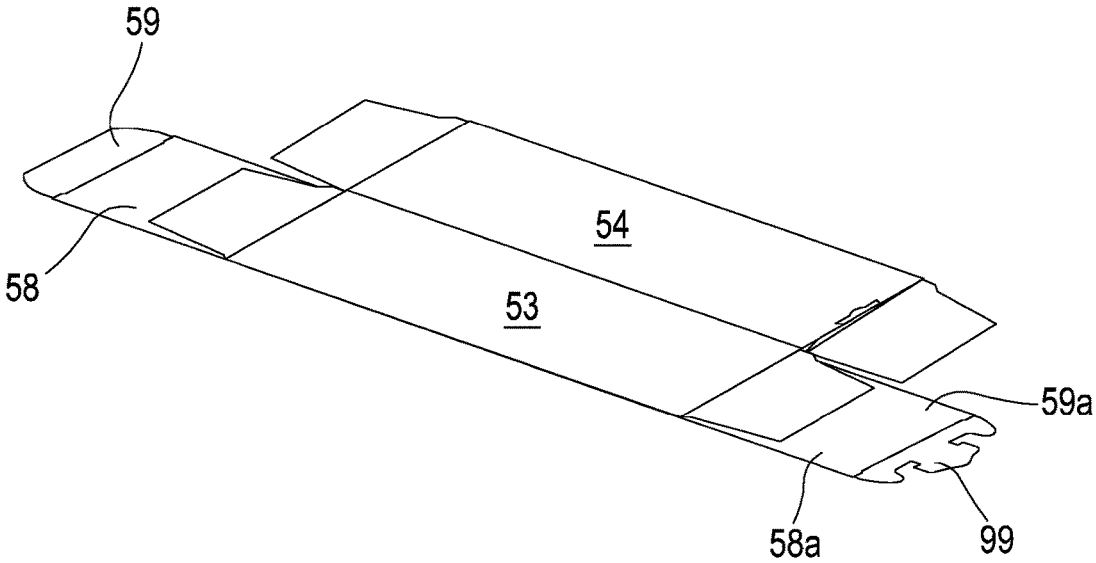
Figure 50:
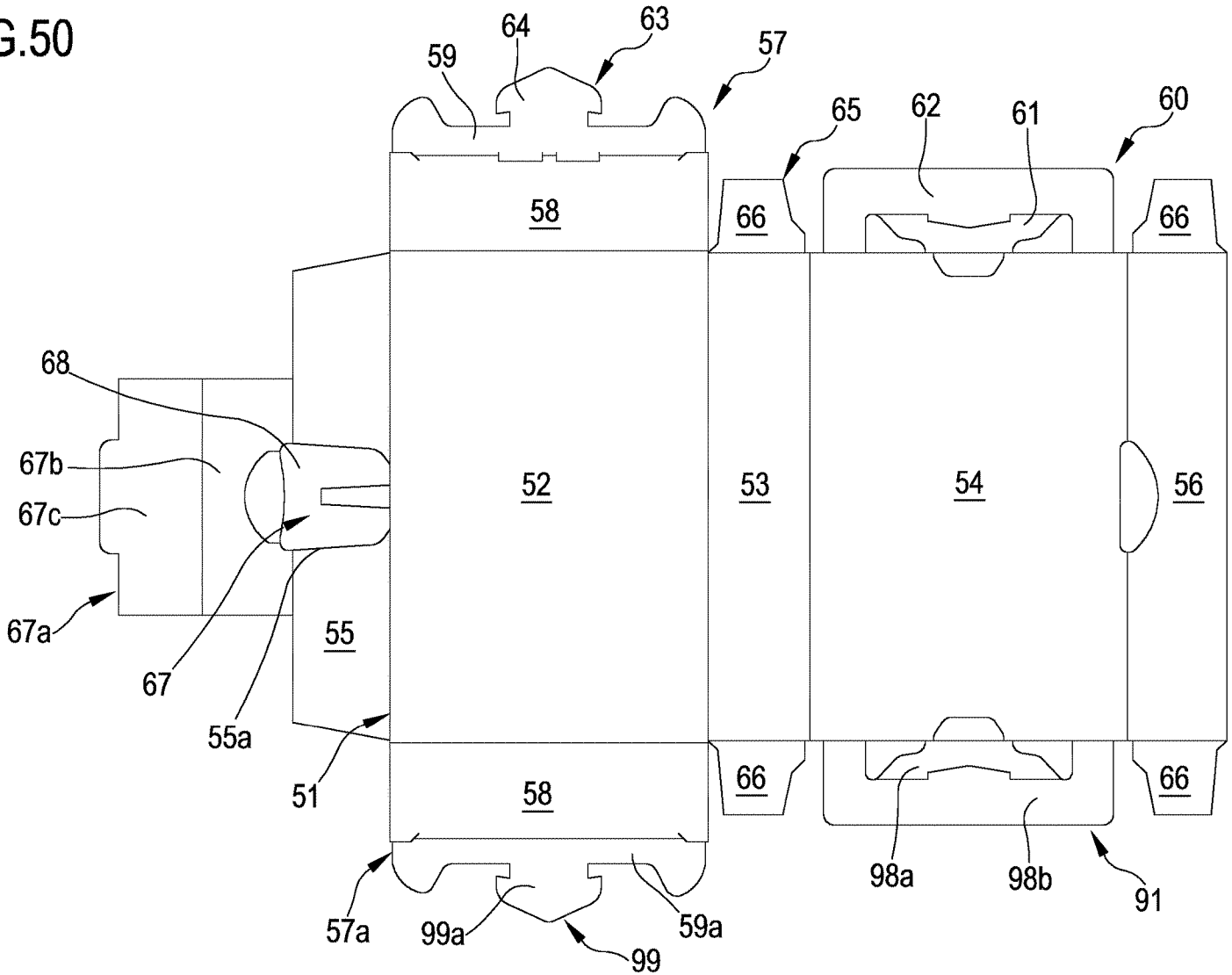
Figure 51:
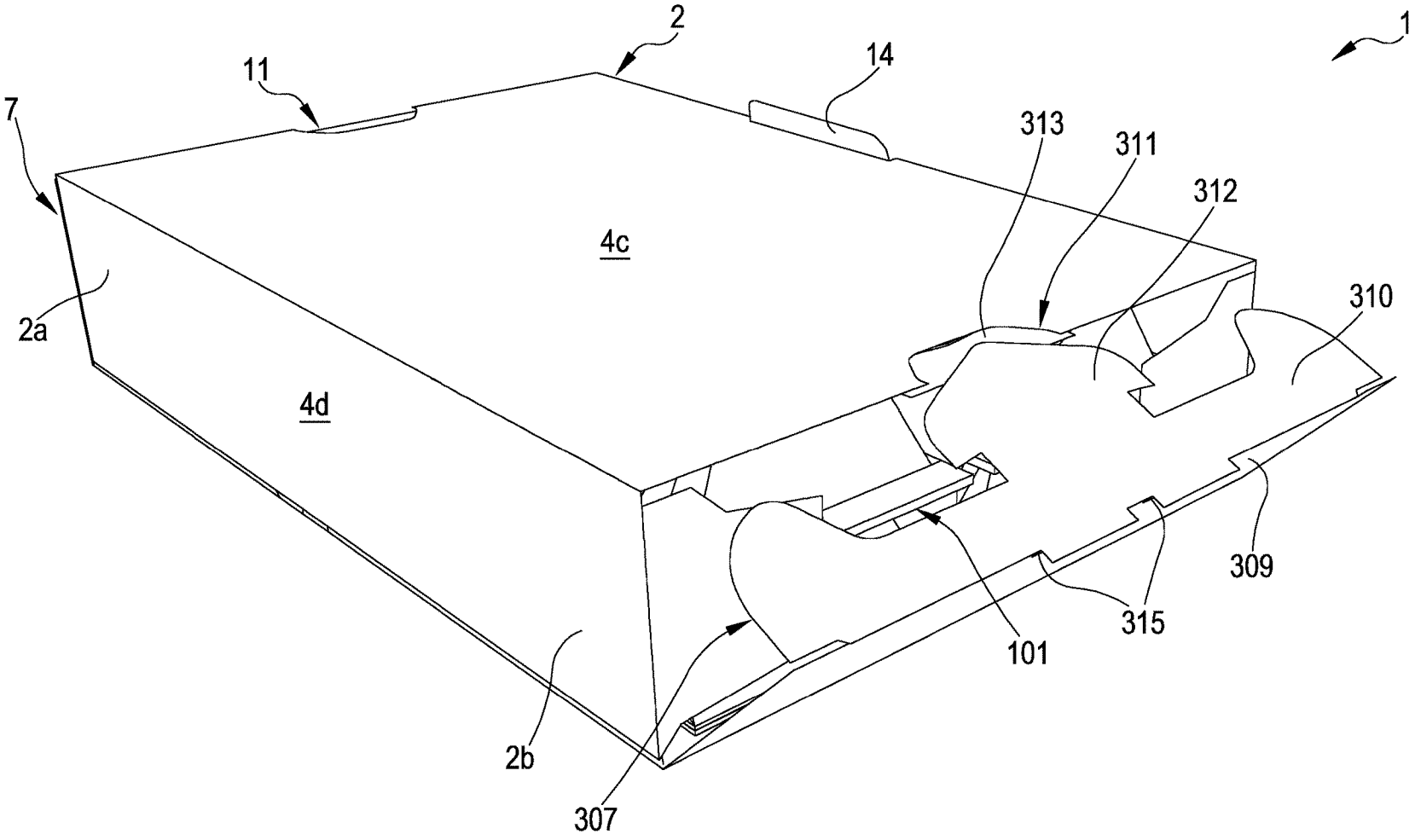
Figure 52:
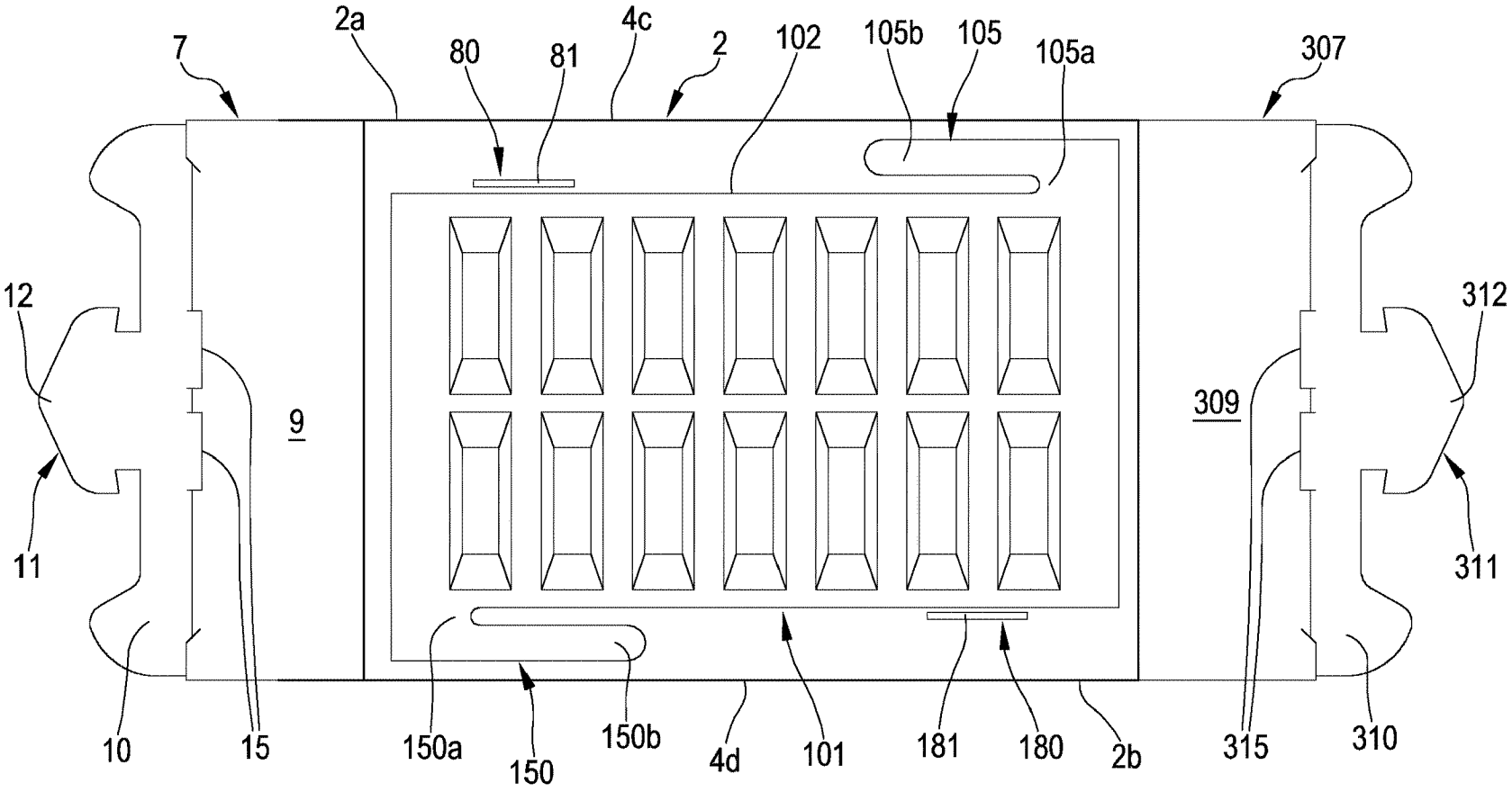
Figure 52B:
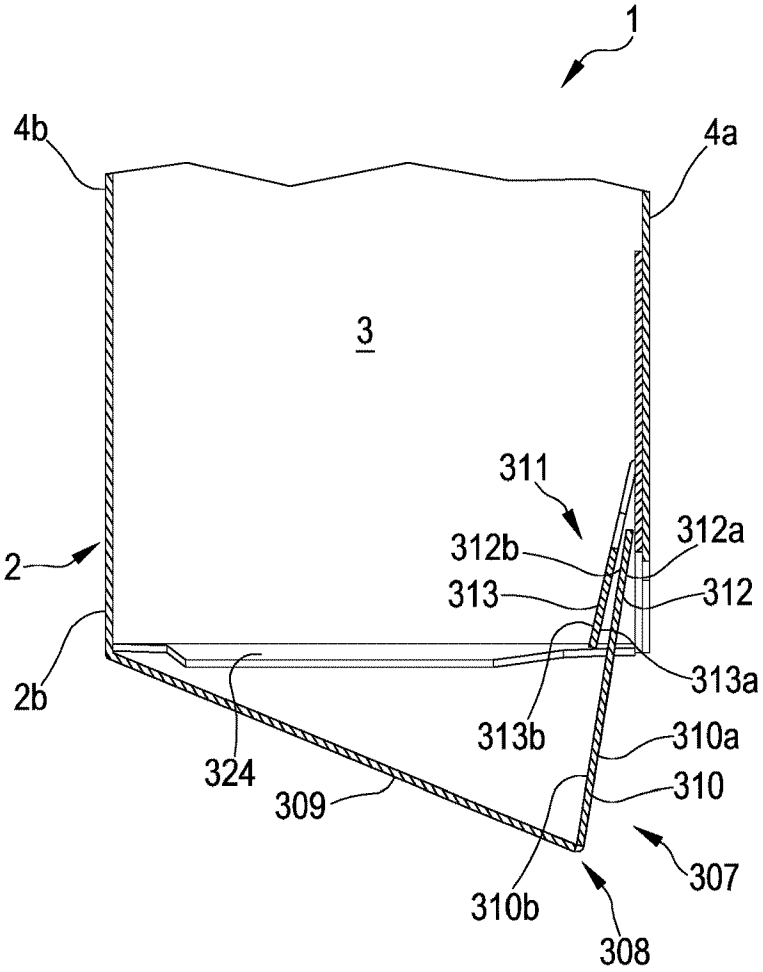
Figure 52A:
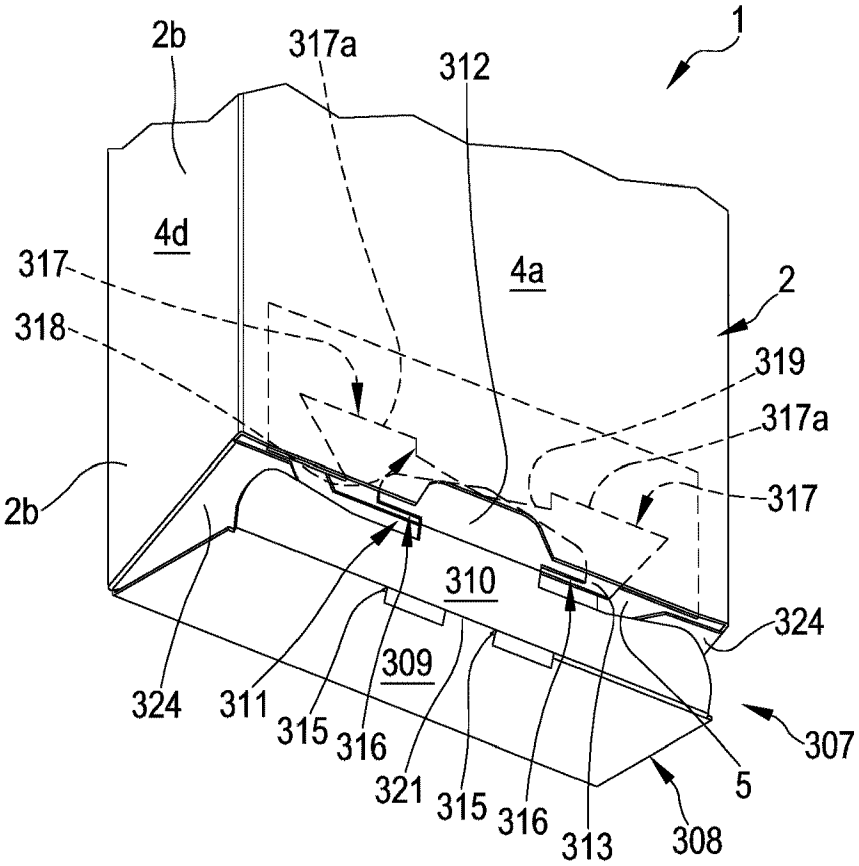

Figures from 9 to 12 are schematic views of blank folding steps of making a container;

FIG. 13 is a perspective view of a third embodiment of a package;

FIG. 14 is a cross-section schematic view of the package in FIG. 13;

FIG. 15 is a top view of a blank for making a container;

FIGS. 16 and 17 are perspective views of a fourth embodiment of a package;

FIG. 18 is a top view of a blank for making a container;

FIG. 19 is a further perspective view of the package, according to the fourth embodiment;

FIG. 20 is a perspective view of a container;

FIG. 21 is a cross-section schematic view of the container in FIG. 20;

Figures from 22 to 28 are further views of the container in FIG. 20;

FIG. 29 is a top view of a blank for making a container;

Figures from 30 to 35 are schematic views of steps of making a fifth embodiment of a package;

FIG. 36 is a perspective view of a fifth embodiment of a package;

FIGS. 37 and 38 are detailed view of a container of the package in FIG. 36;

FIGS. 38A and 38B are further detailed views of the package in FIG. 36;

FIG. 39 is a detailed view of the package in FIG. 36;

Figures from 40 to 42 are associated perspective views of a container;

FIG. 43 is a top view of a blank for obtaining a container according to Figures from 40 to 42;

Figures from 44 to 49 are schematic views of a process for making a container according to Figures from 40 to 43;

FIG. 50 is a top view of a blank for obtaining a container and an associated package;

FIG. 51 is a perspective view of a sixth embodiment of a package;

FIG. 52 is a cross-section schematic view of the package in FIG. 51;

FIGS. 52A and 52B are detailed views of a container of the package in FIG. 51.

The figures can illustrate implementations of the object of the invention by not in scale views; therefore, parts and components illustrated in the figures in relation to the object of the invention, could only indicate schematic views.

DETAILED DESCRIPTION

The term product means an article or a compound of articles of any type. For example, the product can be a drug or medicament at the solid, liquid or gel state, in other words in a state of two or more of the cited aggregation states. Further, the product can mean a package, for example a blister pack, receiving a plurality of articles. The term product can further mean at least one selected in the group of: one or more bottles of cosmetics articles, one or more bottles of drugs.

The container 1 can be at least partially made of a paper sheet material. The term paper material means paper or paperboard: in particular, the sheet material useable for making the container can have a basis weight between 100 and 500 g/m$^2$ and particularly between approximately 200 and approximately 400 g/m$^2$. The relevant paper material extends between a first and second prevalent development surfaces. The sheet paper material used for making the container can, in an embodiment variant thereof, be covered, for at least part of the first and/or second prevalent development surfaces, by a coating of plastic material, for example a film, whose aim consists of reinforcing the container. When the coating is placed in order to cover an outer surface of the container, this can be further used for defining a water and/or moisture barrier useful for avoiding the weakening and the structure loss of the container with the consequent deformation of the paper material making this latter component. Advantageously but in a non-limiting way, the coating could comprise a plastic film adapted to completely cover both the sides (first and second prevalent development surfaces) of the paper material defining the container; the thickness of coating film can have values varying between 5 and 300 μm, particularly between 10 and 200 μm, still more particularly between 10 and 100 μm. The plastic material of the coating can be for example selected among the following materials: low density polyethylene (LDPE), high density polyethylene (HDPE), polypropylene (PP), and/or polyethylene (PE).

1. Package

FIGS. 1-52 illustrate multiple examples of a package 100. For example, package 100 can be used for containing pharmaceutical and/or cosmetic products. In a preferred but non limiting embodiment of the invention, the package 100 can find application in all the fields requiring, for safety reasons, to prevent children from opening the package itself.

1.1 A First Example

A first example of an embodiment of the present invention provides a package 100 as illustrated in FIG. 36. Such package 100 including a container 1 exhibiting a type of closure which, as it will be better described in the following, enables to open the container 1 just on a side and only under determined conditions. Further, such package 100 includes a system which, as it will be better described in the following, prevents to completely extract the wrapping 101 containing one or more products P.

The container 1 includes a compartment 2 made of sheet material, particularly of paper sheet material, defining an inner volume 3 configured for housing at least one product P. The compartment 2 substantially is the recess adapted to house the product (particularly a plurality of products P). Particularly, the compartment 2 includes a predetermined number of lateral walls 4 defining at least one passage opening 5 delimited by a free edge 6: the passage opening 5 is configured for putting into communication the inner volume 3 of the compartment 2 with the outer environment. The attached figures illustrate, in a non-limiting way, a configuration of the compartment 2 exhibiting two passage openings opposite to each other with respect to the compartment itself so that this latter can define substantially a conduit or tube laterally delimited by said walls 4 and open at the longitudinal ends. Still more particularly, the compartment extends between a first and second longitudinal end portions 2*a*, 2*b* along a longitudinal development direction of the compartment 2 itself; the lateral walls 4 therefore define:

- a first passage opening 5 delimited by a free edge 6 and placed at the first longitudinal end portion 2*a* of the compartment 2,
- a second passage opening 205 delimited by a respective free edge 206 and placed at the second longitudinal end portion 2*b* of the compartment 2.

The attached figures illustrate a non-limiting example of a configuration of the compartment 2, which exhibits a rectangular prismatic shape (flat lateral walls 4 having a rectangular shape). De facto, the compartment exhibits a front wall 4*a* and a rear wall 4*b* facing and parallel to each other: the front wall and rear wall are connected to each other by means of a first and second lateral walls 4*c*, 4*d* also facing and parallel to each other. The front wall 4*a* is spaced from the rear wall 4*b*; the first and second lateral walls 4*c*, 4*b* of the compartment 2 are also spaced from each other.

In some implementations, it is not excluded the possibility of making a compartment 2 with a different shape, for example a square, trapezoidal shape.

The invention provides a small-sized container 1, the compartment 2 thereof defines an inner volume 3 substantially greater than 20,000 $mm^3$, particularly included between 40,000 and 200,000 $mm^3$. The container 1, object of the present invention, can be used for packaging medium-sized products; under such condition, the compartment 2 can exhibit an inner volume 3 greater than 500,000 $mm^3$, particularly included between 800,000 and 1,400,000 $mm^3$. However, it is not excluded the possibility of using the container 1 object of the present invention, for packaging large-sized products; under such condition, the compartment 2 thereof exhibits an inner volume 3 greater than the above mentioned volumes, for example greater than 10,000 $cm^3$ and anyway in a non-limiting way.

Moreover, the container 1 includes at least one closure system 7 (as illustrated in FIGS. 19 and 20, for example) of sheet material, particularly of paper sheet, engaged at the free edge 6 and movable, particularly by rotation, with respect to the compartment 2: the closure system 7 is defined at the first end portion of the compartment 2. In particular, the closure system 7 is configured for defining at least one closure condition (see FIG. 23, for example) in which the system 7 itself prevents the communication between the inner volume 3 of the compartment 2 and the outer environment; the closure system 7 is further configured for defining at least one open configuration (see FIG. 19, for example), in which the closure system 7 itself enables the communication between the inner volume 3 and the outer environment. De facto, the system 7 substantially embodies a cover adapted to cooperate with the compartment 2 in order to manage the access to the inner volume 3.

More particularly, the closure system 7 exhibits a closing portion 9 directly engaged with and joined in one piece to the free edge 6 of the compartment 2: the closing portion 9 embodies the component of the tab 8 configured for preventing the passage through the opening 5 in the closed configuration of the system 7 itself. As illustrated in the attached figures, the closing portion 9 substantially includes a flat body of sheet material counter shaped to the free edge 6 of the opening 5. The attached figures schematically show a preferred configuration of the closing portion 9 exhibiting a rectangular shape completely counter shaped to the free edge 6.

Moreover, the tab 8 exhibits at least one inserting portion 10 (FIG. 19) configured for being inserted, in the closed configuration of the system 7, into the volume 3 of the compartment 2. The inserting portion 10 is joined in one piece to the closing portion 9 and emerges from this latter: the inserting portion 10 represents substantially an extension of the closing portion 9 adapted to be inserted, in the closed configuration of the system 7, into the compartment 2. In particular, in the closed configuration of the closure system 7, the inserting portion 10 is positioned completely inside the volume 3 of the compartment 2. As illustrated in the attached figures, the inserting portion 10 includes also a substantially flat body of sheet material having, in a non-limiting, a rectangular shape. As illustrated for example in the cross-section view in FIG. 21, the inserting portion 10 extends between a first and second prevalent development surfaces 10*a*, 10*b* respectively facing the outside (directly facing the front wall 4*a* and the compartment 2) and the inner volume 3 of the compartment 2. In the closed configuration of the system 7, at least one portion of the first development surface 10*a* of the inserting portion 10 faces, particularly contacts, directly a part of a lateral wall 4 of the compartment 2 (particularly the front wall 4*a*): the surface 10*a*, in the closed configuration of the system 7, extends at least parallel to the front wall 4*a* of the compartment 2, particularly, to a wall of the compartment 2 opposite to the wall directly connected to the system 7, in other words the rear wall 4*b*.

Moreover, the inserting portion 10 includes an actuating portion 22 (FIG. 23) configured to be actuated for enabling to open the container 1, as it will be described more in particular in the following.

Figure 23:
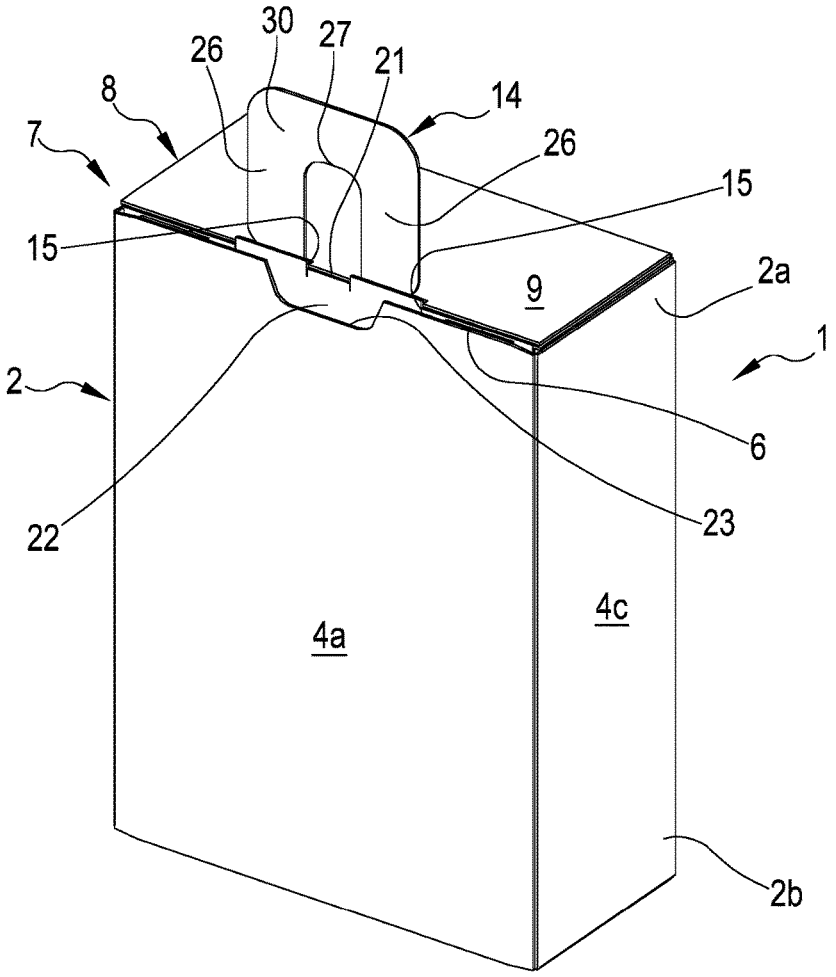
Figure 24:
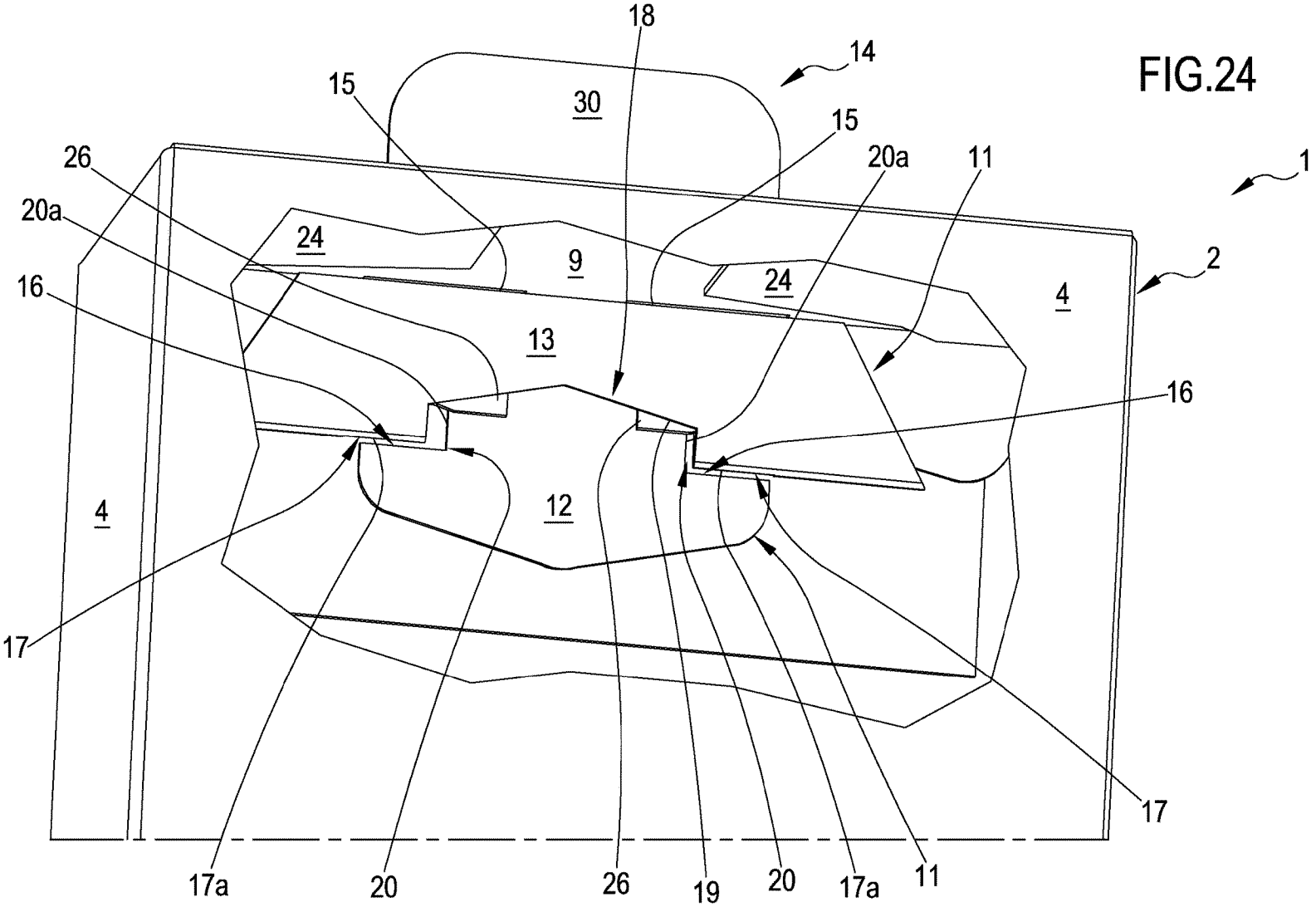
Figure 26:
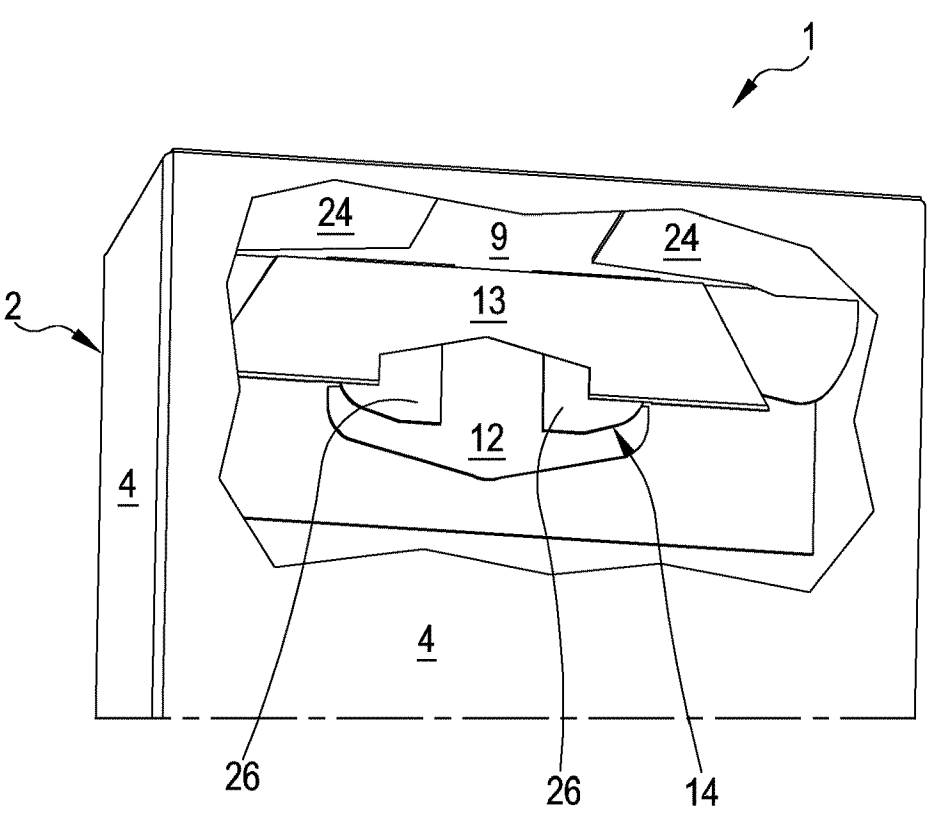
Figure 25:
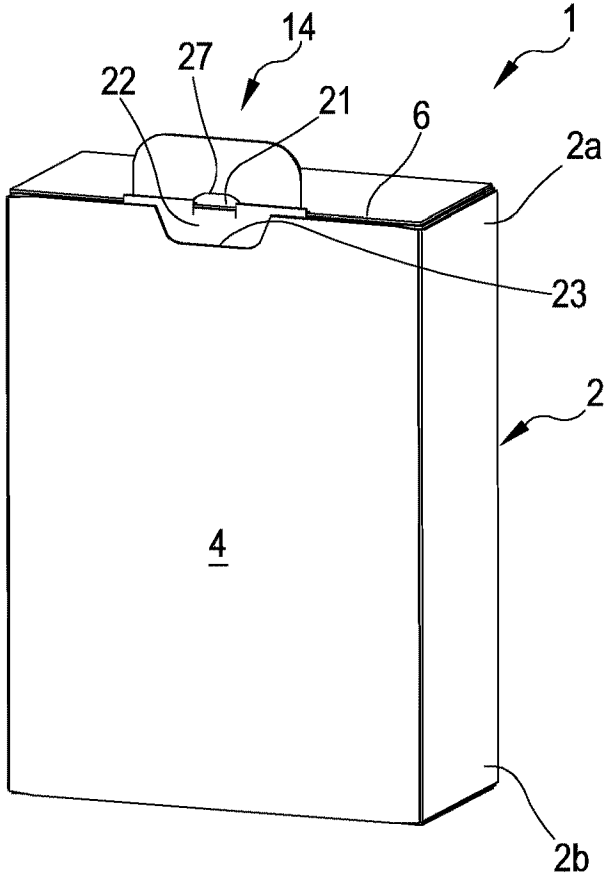
Figure 27:
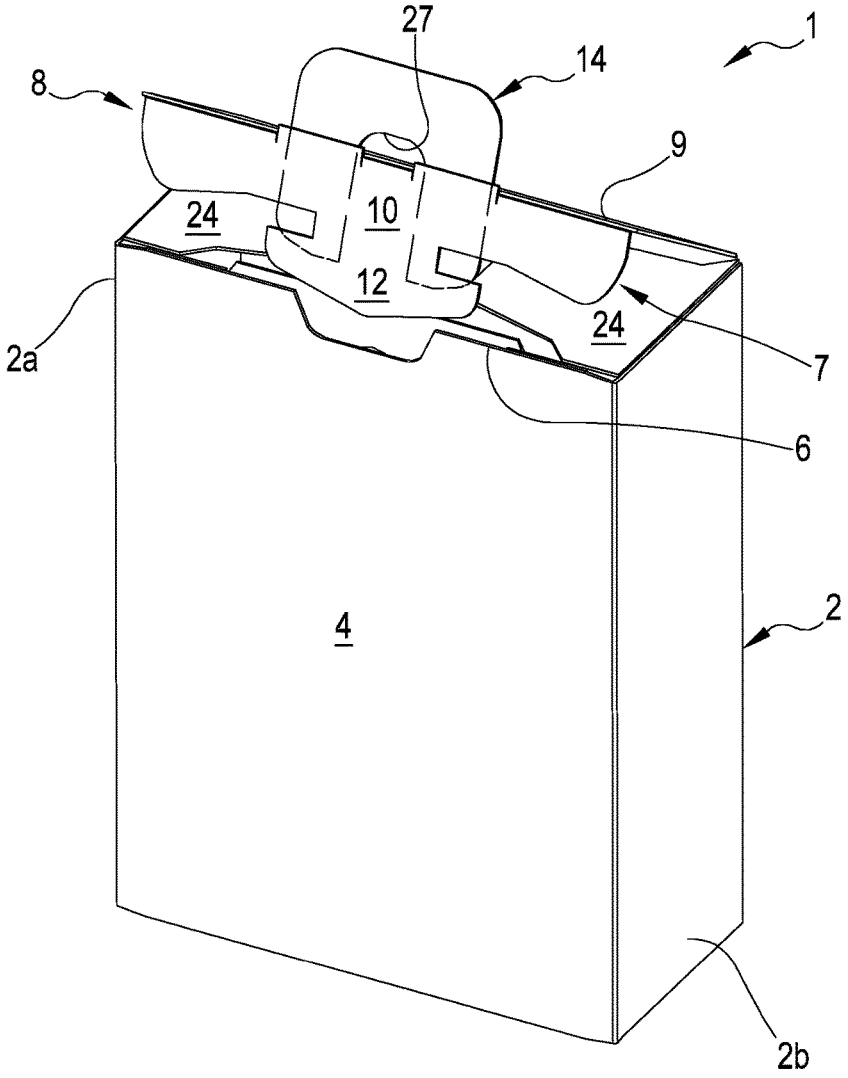

As illustrated in the attached figures, the free edge 6 exhibits a recess 23 substantially a depression of the free edge 6 itself (FIG. 23). The recess 23 exhibits an open outline exhibiting a concavity having, in a non-limiting way, a substantially "C" shape. The recess 23 is configured for enabling to see and grip at least part of the inserting portion 10 in the closed configuration of the system 7. Particularly, in the closed configuration of the closure system 7, the concavity of the recess 23 of the free edge 6 leaves exposed the actuating portion 22 of the inserting portion 10, which therefore becomes accessible from the outside of the container 1 and suitably movable.

The closing portion 9 and inserting portion 10 exhibit an interconnection edge opposite to the free edge 6 of the compartment 2 with respect to the closing portion 9 itself: the inserting portion 10 is movable through rotation with respect to the closing portion 9 around said reciprocal connection edge. The inserting portion 10, in the closed configuration of the system 7, is configured for defining, along a cross-section and in cooperation with the closing portion 9, a substantially "L" shape: under such condition, the inserting portion 10 substantially extends parallel to the wall 4*a* of the compartment 2.

As illustrated in FIG. 20 for example, the closure system 7 further includes at least one slot 15, which enables the communication between the inner volume 3 of the compartment 2 and the outer environment. The slot 15 can be defined at the inserting portion 10; alternatively, the slot 15 can be defined at the closing portion 9 or can develop at both the inserting 10 and closing portions 9. As illustrated in the attached figures, the slot 15 can be defined at a folding line substantially interposed between the inserting portion 10 and closing portion 9. In the closed configuration of the closure system 7, the slot 15 is arranged at the free edge 6 of the compartment 2.

Figure 30:
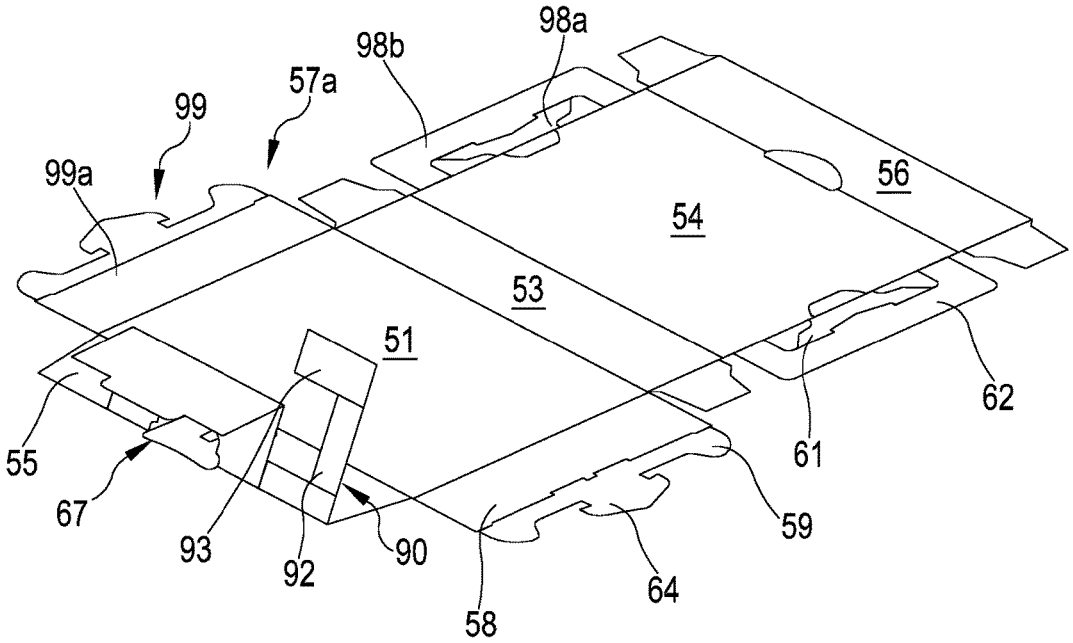

According to the embodiment shown in FIGS. 19, 30, the closure system 7 can exhibit, in a non-limiting way, two slots 15, between them an abutment edge 21 is interposed. The abutment edge 21, as it will be better described in the following, is configured to cooperate with an opening device 14.

The slots 15 can exhibit the same dimensions or, alternatively, different dimensions. From the dimensional point of view, each slot 15 can exhibit a width included between 3 and 200 mm, particularly included between 5 and 50 mm.

The slot 15 is substantially formed by a cutout 15*a* carried by the closure system 7. The cutout 15*a* is carried by the closure system 7 and, particularly, is defined at the inserting portion 10 of the closure system 7 and, in the closed configuration, is arranged at the free edge 6. By folding the inserting portion 10 with respect to the closing portion 9, the cutout 15*a* enables to rotationally move a flap of the closing portion 9 defined by the cutout 15*a* itself and open a space or aperture forming, as stated, said slot 15. The cutout 15*a* exhibits a substantially "U" shape and the slot 15, obtained by it, exhibits a substantially rectangular shape. Alternatively, the cutout 15*a* can be formed by an aperture defined between the inserting portion 10 of the closure system 7, and a lateral wall 4 of the compartment 2.

As illustrated for example in FIG. 19, the closure system 7 can further include at least one abutment portion 24 engaged to the free edge 6 of the compartment 2 adjacent the tab 8: the abutment portion 24, in the closed configuration, is configured for being interposed between the inner volume 3 and tab 8 in order to cooperate with this latter for holding it firmly in said closure condition. The abutment portion 24 substantially includes a flat tab of sheet material joined in one piece to the free edge 6 of the compartment 2 adjacent to the closing portion 9. The abutment portion 24 exhibits, in a non-limiting way, a rectangular or trapezoidal shape. The abutment portion 24 is also configured for rotating around the abutment edge 6 for facing, in at least the closed configuration of the container 1, the inside of the compartment 2. More particularly, the abutment portion 24 is constrained to the free edge 6 in order to engage, in the closed configuration of the container 1, at least part of the inserting portion 10 and/or of the closing portion 9 for firmly holding the tab 8 in the closed configuration.

Advantageously, the container 1 includes two abutment portions 24 opposite to each other with respect to the tab 8: this latter is interposed between the two abutment portions 24 (FIG. 19). In such configuration, the two abutment portions 24 work symmetrically on the tab 8 for firmly holding it in the closed configuration.

Advantageously, the closure system 7 is made of a paper material sheet and is obtained by folding it; particularly, the closure system 7 is made in one piece with the compartment 2 and is made of the same paper material sheet.

As illustrated in Figures from 19 to 23 for example, the container 1 further includes at least one safety device 11 made of a sheet material, particularly a paper sheet material. The safety device 11 includes at least one first hooking portion 12 carried by the tab 8, and at least one second hooking portion 13 engaged to the compartment 2. The first and second hooking portions 12, 13 are configured for firmly engaging with each other during a closure condition of the closure system 7. In the closed configuration of the closure system 7, the container 1 is substantially in a safety condition, in which the container 1 is prevented from opening by the engagement between the first and second hooking portions 12, 13. As illustrated in FIGS. 16, 17, from 19 to 22 for example, the second hooking portion 13 is arranged inside the compartment 2 and lies substantially in a plane parallel to one of the lateral walls 4. The second hooking portion 13 develops completely inside the volume 3 (is completely arranged inside the inner volume of the compartment 2) of the compartment 2 both in the closed configuration and the open configuration of the closure system 7. With reference to the first hooking portion 12, in the closed configuration of the system 7, it is configured for being inserted at least partially, particularly completely, into the inner volume 3 of the compartment 2 in order to firmly engage the second hooking portion 13. In the closed configuration of the system 7, the first hooking portion 12 is completely contained inside the volume 3 of the compartment 2, and is spaced from the free edge 6. Moreover, in the closed configuration of the system 7, the engagement between the second hooking portion 13 and first hooking portion 12 is completely defined inside the inner volume 3. The engagement between the first and second hooking portions 12, 13 is of a reversible type; in other words, after reaching the open configuration of the closure system 7, the first and second hooking portions 12, 13 can be repeatedly (reversibly) engaged to define the closed configuration of the closure system 7, corresponding to a safety condition of the safety device 11. The repeated switch between the closed configuration and the open configuration can be enabled by the first hooking portion 12, which can be engaged to and disengaged from the second hooking portion 13. In particular, upon switching between the closed configuration and the open configuration, the second hooking portion 13 is not removed or disconnected from the compartment 2 but remains engaged to a lateral wall 4 of the compartment 2 itself inside its volume. Following each open configuration of the closure system, the first and second hooking portions 12, 13 are configured for defining a safety condition (e.g., closed configuration) wherein such portions are firmly engaged with each other.

The first hooking portion 12 is engaged, particularly directly carried, by the tab 8 of the closure system 7. Advantageously, the first hooking portion 12 is only carried, but not in a limiting way, by the inserting portion 10 of the tab 8: the two portions 12 and 10 are advantageously joined in one piece in order to form a single body, particularly a single paper material sheet. De facto, the first hooking portion 12 includes a flat sheet body emerging, particularly without interruptions, from the inserting portion 10 opposite to the closing portion 9: the inserting portion 10 is therefore interposed between the closing portion 9 and first hooking portion 12. The first hooking portion 12, in the closed configuration of the system 7 and therefore during the insertion of the inserting portion 10 into the compartment 2, is configured for being also inserted into the inner volume 3.

The sheet material body of the first hooking portion 12 extends between a first and second prevalent development surfaces 12*a*, 12*b* (FIG. 21) respectively facing the same direction of the first and second surfaces 10*a*, 10*b* of the inserting portion 10: the first surfaces 10*a*, 12*a* extend, without interruption, between them and directly face a same lateral wall 4 (the front wall 4*a*) of the compartment 2 opposite to the lateral wall 4 directly connected to the system 7 (rear wall 4*b*). The second surfaces 10*b*, 12*b* extend also, without interruption, between them and face the inner volume 3 of the compartment 2.

More particularly, the first hooking portion 12 exhibits at least one undercut 16 configured for firmly engaging the second hooking portion 13 arranged inside the compartment 2 in the closed configuration of the system 7. The undercut 16 is distinct and spaced from the free edge 6 of the compartment 2. As illustrated in FIG. 20, the undercut 16 includes at least one hook 16 having a seat 20*a* provided with a concavity. Preferably, the first hooking portion 12 includes two hooks 20 having respective seats 20*a*, the concavities thereof face away from each other. The undercut 16 is configured for engaging the second hooking portion 13.

The second hooking portion 13 is engaged, in a non-limiting way, to a lateral wall 4 of the compartment 2 (the front wall 4*a*) directly facing, in the closed configuration of the system 7, the inserting portion 10.

The sheet material body of the second hooking portion 13 extends between a first and second prevalent development surfaces 13*a*, 13*b* (FIG. 21). The first surface 13*a* is directly connected to an inner surface of the compartment 2 and faces, in the closed configuration of the system 7, the second surface 10*b* of the inserting portion 10.

Figure 22:
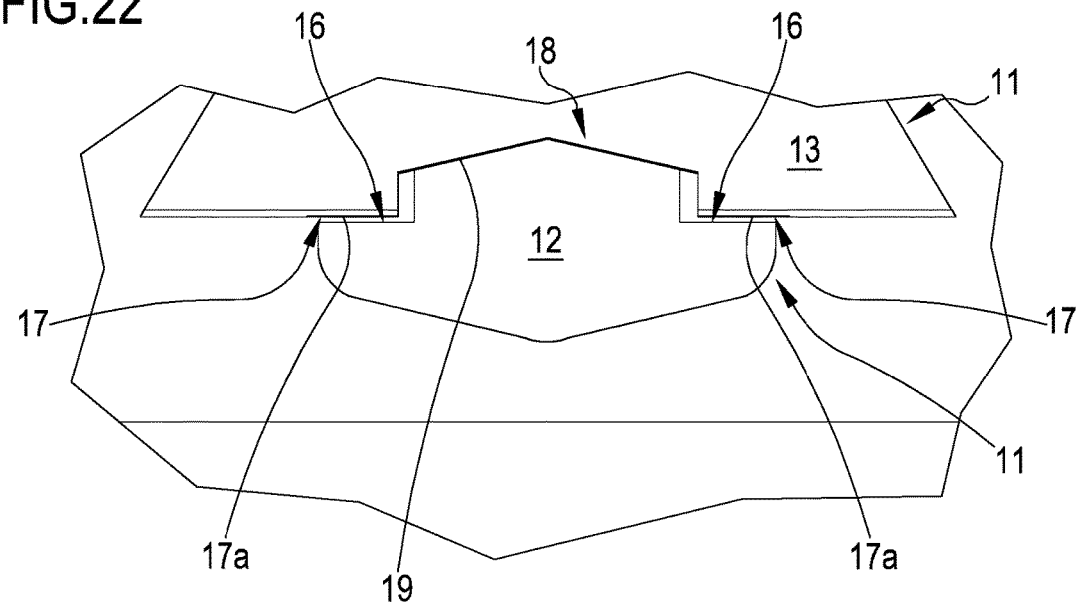

The second hooking portion 13 exhibits in turn at least one undercut 17, which is arranged inside the compartment 2 and is configured for engaging the undercut 16 of the first hooking portion 12 at least in the closed configuration of the system 7. As illustrated in FIG. 20, for example, the undercut 17 exhibits a gripping edge 17*a* distinct and separated from the free edge 6 of the compartment 2. The undercut 17 exhibits at least one hook 18, which defines a seat 19. The seat 19 exhibits a substantially "C" shape. Moreover, the seat 19 exhibits a concavity facing a lateral wall 4 of the compartment 2 (the front wall) and is configured for housing and engagingly holding the first hooking portion 12. In other words, in the closed configuration of the system 7, the first hooking portion 12 is engaged inside the seat 19, and the undercuts 16, 17 are engaged with each other (see FIG. 22, for example). In the safety condition (in other words in the closed configuration of the system 7), the concavity of the seat 19 of the hook 18 of the second hooking portion 13 faces the concavity of the seat 20*a* of the hook 20.

For being capable of opening the container 1, the same is provided with an opening device (or key) 14. The opening device 14 is configured for enabling the system 7 to switch from the closed configuration (safety condition of the container 1) to the open configuration and to therefore ensure to open the container 1.

The opening device 14 exhibits a gripping portion 30 from which one or more appendages 20 (FIG. 23) emerge. The appendages 26 can exhibit a polygonal shape, for example a substantially square or rectangular or trapezoidal shape. The appendages 26 are configured and sized for being inserted into the slot 15 in order to contact, in the closed configuration of the system 7, the first and second hooking portions 12, 13 and for disengaging them.

The opening device 14 could further include a plurality of appendages 26 or further projections or valleys which can be configured to functions alternative to the one of disengaging the first and second hooking portions 12, 13. For example, such appendages or projections or valleys can contribute to determine the control of the position of the opening device 14 upon inserting it inside the slot 15. Moreover, the opening device 14 can be configured (by its shape) for preventing other devices having a different shape from being used as a substitute for determining the opening of the container 1.

The attached figures illustrate, in a non-limiting way, a preferred embodiment of the opening device 14 exhibiting two appendages 26 projecting from the gripping portion 30 (see FIG. 23, for example). The appendages 26 develop away from an abutment edge 27 defined between them. According to such embodiment, the opening device 14 exhibits a substantially "C" or "H" or "A" shape.

Upon inserting the opening device 14 inside the slots 15, the abutment edge 27 of the opening device 14 abuts against an abutment edge 21 of the closure system 7 in order to limit the advancement of the opening device 14 inside the slots themselves and therefore for preventing it from completely entering inside the volume 3 of the compartment 2. If the opening device 14 is completely inside the volume 3 of the compartment 2, opening the container 1 could be difficult because it would be impossible for the user operating on the opening device 14 itself for opening the container 1. The abutment edge 21 can be defined on the closing portion 9 between the slots 15.

The opening device 14 is made of sheet material, particularly of paper sheet material. The opening device 14 can be made of the same material as the compartment 2 or container 1. The opening device 14 can be made in one piece with the container 1 and can be formed by a portion configured to be teared or separated from the container 1.

Advantageously, the container 1 can further include a case provided with a housing seat adapted to receive and support the opening device 14 under non operative conditions of this latter. The case is engaged outside the volume 3 of the compartment 2. According to a preferred embodiment, the case is made of a paper material sheet.

In the preferred embodiment of the package 100, the container 1 further includes a second passage opening 205 arranged at the second end portion 2*b* of the compartment 2. At the second end portion 2*b* of the compartment 2, the container 1 includes an occluding system 207 (as illustrated in FIG. 36, for example) of sheet material, particularly of paper sheet engaged to the free edge 206 of the second opening 205.

Therefore, the occluding system 207 is defined versus the closure system 7 and the associated safety device 11 with reference to the compartment 2. The occluding system 207 is configured for irreversibly closing the second passage opening 205 and therefore preventing from gaining access from the outside of the inner volume 3 of the compartment 2 through said second passage opening 205. In the preferred embodiment of the package 100, the container 1 is openable only at the first passage opening 5 of the compartment 2.

In particular, the occluding system is configured for preventing the access to the inner volume 3 of the compartment, through the opening 205, following a first closure condition of the occluding system 207. De facto, the system 207 following a first condition of the same, is configured for irreversibly blocking and therefore preventing the same from being reopened.

In order to a better understand the structure of the occluding system 207, Figures from 36 to 39 outline a step of the first closure of the occluding system, at the end of it, the system 207 irreversibly occludes the passage 205 of the compartment. FIGS. 38*a* and 38*b* outline the occluding system blocked inside the compartment 2.

As illustrated in FIG. 37, the occluding system 207 includes at least one tab 208 which exhibits a closing portion 209 directly engaged and joined in one piece to the free edge 206 of the compartment 2: the closing portion 209 is the component of the tab 208 configured for preventing the passage through the opening 205 of the system 207 itself. As illustrated for example in FIG. 37, the closing portion 209 includes substantially a flat body of sheet material counter shaped to the free edge 206 of the opening 205. The attached figures outline a preferred configuration of the closing portion 209 exhibiting a rectangular shape completely counter shaped to the free edge 206.

The tab 208 includes an inserting portion 210 (FIG. 36) arranged inside the volume 3 of the compartment 2. The inserting portion 10 is joined in one piece to the closing portion 9 and emerges from this latter: the inserting portion 210 substantially represents an extension of the closing portion 209. Particularly, the inserting portion 210, under an operative condition defined after the first closure condition of the occluding system 207, is positioned completely inside the volume 3 of the compartment 2. As illustrated in Figures from 36 to 38B, also the inserting portion 210 includes substantially a flat body of sheet material having, in a non-limiting way, a rectangular shape. As illustrated in the cross-section view in FIG. 38B, the inserting portion 210 extends between a first and second prevalent development faces 210*a*, 210*b* respectively facing the outside (directly facing the front wall 4*a* of the compartment 2) and facing the inner volume 3 of the compartment 2: at least a portion of the first development surface 210*a* of the inserting portion 210 faces, particularly contacts, directly a part of a lateral wall 4 of the compartment 2 (particularly of the front wall 4*a*). The surface 210*a* extends at least partially parallel to the front wall 4*a* of the compartment 2, particularly parallel to a wall of the compartment 2 opposite to the wall directly connected to the system 207, in other words the rear wall 4*b*.

The closed configuration 209 and inserting portion 210 exhibit an interconnection edge opposite to the free edge 206 of the compartment 2 with reference to the closing portion 209 itself. The inserting portion 210 is configured for defining, along a cross-section and in cooperation with the closing portion 209, a substantially "L" shape.

More particularly, the closing portion 209 of the tab 208 of the occluding system 207 exhibits a shape delimited by an outer closed perimeter counter shaped and substantially identical to the second passage opening 205 of the compartment 2: the closing portion 209 of the occluding system 207 covers completely the second passage opening 205 of the compartment 2. As illustrated in FIG. 37, the closing portion 209 of the occluding system 207 is devoid of through openings; particularly, the closing portion 209 is joined in one piece to the inserting portion 210 in order to define a single continuous body delimited by a single closed outer perimeter devoid of through openings defined inside said closed outer perimeter.

As illustrated in FIG. 37, the occluding system 7 can include at least one abutment portion 224 engaged to the free edge 206 of the compartment 2 adjacent the tab 208: the abutment portion 224 is configured for being interposed between the inner volume 3 and tab 208 in order to cooperate with this latter for enabling to better block the system 207. The abutment portion 224 substantially includes a flat tab of sheet material joined in one piece to the free edge 206 of the compartment 2 adjacent the closing portion 209. The abutment portion 224 exhibits, in a non-limiting way, a rectangular or trapezoidal shape.

More particularly, the abutment portion 224 is constrained to the free edge 206 in order to be able to engage at least partially the inserting portion 210 and/or a closing portion 209 for firmly holding the tab 208 in the closed configuration. Advantageously, the container 1 includes two abutment portions 224 opposite to each other with respect to the tab 208: this latter is interposed between the two abutment portions 224 (FIG. 37). In such configuration, the two abutment portions 224 symmetrically work on the tab 207 and with the occluding system 207 for firmly holding this latter.

Advantageously, the occluding system 207 is made of paper material sheet and is obtained by folding it; in particular, the system 207 is made in one piece with the compartment 2 and by the same paper material sheet.

More in particular, as illustrated in FIG. 37 for example, the occluding system 207 includes at least one first hooking portion 212 carried by the tab 208 and at least one second hooking portion 213 engaged to the compartment 2. The first and second hooking portions 212, 213 are firmly and irreversibly engaged with each other. Following the first closure condition of the system 207, the container 1 is substantially in a blocking condition in which the container 1 at the second passage opening 205 (at the second end portion 2*b* of the compartment 2) is prevented from being opened by the engagement between the first and second hooking portions 212, 213. The second hooking portion 213 is placed inside the compartment 2 and lies substantially in a plane parallel to one of the lateral walls 4. Particularly, the second hooking portion 213 includes a tab of sheet material, optionally of paper sheet material, extending along a development plane: the tab of the hooking portion 213 includes a body having a substantially "C" shape the concavity thereof faces away from the closing portion 209 of the occluding system 207. As illustrated in the cross-section view in FIG. 38B, the tab in the second hooking portion 213 of the closure system 207 is sloped with respect to the inserting portion 210 facing said second hooking portion 213; particularly, the tab of the second hooking portion 213 of the occluding system 207 exhibits an angle of inclination with respect to the inserting portion 210 facing said second hooking portion 213 less than 20°, optionally less than 10°.

The second hooking portion 213 develops completely inside the volume 3 (is completely arranged inside the inner volume of the compartment 2) of the compartment 2. The first hooking portion 212 is also arranged substantially completely inside the inner volume 3 of the compartment 2. In particular, the first hooking portion 212 is completely received inside the volume 3 of the compartment 2 and is spaced from the free edge 206 of the second passage opening: the engagement between the second hooking portion 213 and first hooking portion 212 is completely defined inside the inner volume 3. The engagement between the first and second hooking portions 12, 13 is of an irreversibly type; in other words, after reaching the first closure condition of the occluding system, the first and second hooking portions 212, 213 are configured to prevent disengagement and therefore define an open configuration of the container 1. The open configuration of the container 1 is associated to the characteristics of the closing portion 209 and the inserting portion 210, which include, as hereinbefore described, solid bodies devoid of openings, configured for covering the engagement between the portions 212 and 213. After closure, the characteristics of the closing portion 209 and the inserting portion 210 prevent a user from reaching the hooking portions 212 and 213 from the outside, such that hooking portions 212 and 213 cannot be unhooked.

More particularly, the first hooking portion 212 is engaged, particularly directly carried by, the tab 208 of 207. Advantageously, the first hooking portion 212 is only carried, but not in a limiting way, by the inserting portion 210 of the tab 208: the two portions 212 and 210 are advantageously joined in one piece for forming a single body, particularly a single paper material sheet. De facto, the first hooking portion 212 includes a flat sheet body emerging, particularly without interruption, from the inserting portion 210 opposite to the closing portion 209: the inserting portion 210 is therefore interposed between the closing portion 209 and first hooking portion 212.

The body of sheet material of the first hooking portion 212 extends between a first and second prevalent development surfaces 212*a*, 212*b* (FIG. 38B) respectively facing in the same direction of the first and second surfaces 210*a*, 210*b* of the inserting portion 210: the first faces 210*a*, 212*a* extend without interruption between them and directly face a same lateral wall 4 (the front wall 4*a*) of the compartment 2 opposite to the lateral wall 4 directly connected to the system 207 (the rear wall 4*b*). The second surfaces 210*b*, 212*b* extend also without interruption between them and face the inner volume 3 of the compartment 2.

More particularly, the first hooking portion 212 exhibits at least one undercut 216 firmly engaged to the second hooking portion 213 arranged inside the compartment 2. The undercut 216 is distinct and spaced from the free edge 206 of the compartment 2. As illustrated in FIG. 37, the undercut 216 includes at least one hook 220 having a seat 220*a* provided with a concavity. Preferably, the first hooking portion 212 includes two hooks 220 having respective seats 220*a* the concavities thereof face away from each other. The undercut 216 is engaged to the second hooking portion 213 (FIG. 38A).

The second hooking portion 213 is engaged, in a non-limiting way, to a lateral wall 4 of the compartment 2 (the front wall 4*a*) directly facing the inserting portion 210. The sheet material body of the second hooking portion 213 extends between a first and second prevalent development surfaces 213*a*, 213*b* (FIG. 38B). The first surface 213*a* is directly connected to an inner surface of the compartment 2 and faces the second surface 210*b* of the inserting portion 210.

The second hooking portion 213 exhibits in turn at least one undercut 217, which is arranged inside the compartment 2 firmly and irreversibly engaged to the undercut 216 of the first hooking portion 212. As illustrated in FIG. 38A for example, the undercut 217 exhibits a gripping edge 217*a* distinct and spaced from the free edge 206 of the compartment 2. The undercut 217 exhibits at least one hook 218, which defines a seat 219. The seat 219 exhibits a substantially "C" shape. Moreover, the seat 219 exhibits a concavity facing the lateral wall 4 of the compartment 2 (the front wall) inside which the first hooking portion 212 is housed (held). In other words, the first hooking portion 212 is engaged inside the seat 219 and the undercuts 216, 217 are engaged with each other (see FIG. 38A, for example). The concavity of the seat 219 of the hook 218 of the second hooking portion 213 faces the concavity of the seat 220*a* of the hook 220.

The package 100 of the preferred embodiment of the invention exhibits a container 1 including at least one stop element 80. Possible variants of the stop element are illustrated in a non-limiting way in Figures from 1 to 3, 5, 7, 13, 14.

The stop element 80 is placed inside the compartment 2 between the passage opening 5 and a longitudinal mid portion of the compartment 2 defined between the first and second end portions 2*a*, 2*b* of the compartment 2: the stop element 80 emerges, from at least one lateral wall 4 of the compartment 2, inside this latter in order to define a projection. Still more particularly, the stop element 80 extends from a lateral wall 4 of the compartment to a lateral wall 4 opposite to the compartment itself. The stop element 80 is connected, particularly directly connected, and joined in one piece, to two lateral walls 4 of the compartment 2, opposite and facing each other. The attached figures illustrate in a preferred embodiment of the invention the stop element 80 extending between and directly connected to the front wall 4*a* and rear wall 4*b* of the compartment.

Advantageously, the stop element 80 is arranged at the first end portion 2*a* of the compartment 2, spaced from the passage opening 5.

De facto, the stop element 80 is interposed between the first and second lateral walls 4*c*, 4*d* but spaced from these latter.

The stop element 80 includes a tab 81 of sheet material, particularly of paper sheet material, which extends along a plane parallel to the longitudinal development direction of the compartment 2. In particular, the tab 81 of the stop element 80 extends along a plane substantially parallel to the first and second lateral walls 4*c*, 4*d* of the compartment 2.

The tab 81 exhibits a predetermined extension along said longitudinal development direction of the compartment 2; the ratio of a predetermined longitudinal extension of the compartment 2—defined by a maximum distance between the first and second end portions 2*a*, 2*b*—to the predetermined longitudinal extension of the stop element 80, particularly of the tab 81, is greater than 2, particularly greater than 3, still more particularly included between 3 and 10.

Figures from 1 to 3 illustrate a first embodiment of the container 1 including a single stop element 80 arranged in proximity of the first lateral wall 4*c* of the compartment 2. The stop element 80 is near, but spaced from the lateral wall 4*c*. The stop element 80 exhibits a minimum distance from the first lateral wall 4*c* less than a minimum distance from the second lateral wall 4*d*. However, it is not excluded the possibility of making a single stop element 80 placed in proximity of the single second lateral wall 4*d* (condition not illustrated in the attached figures).

In a second embodiment of the container 1, the same exhibits a single stop element 80 arranged at a transversal mid portion of the compartment 2 defined between the first and second lateral walls 4*c*, 4*d* (see Figures from 5 to 7).

In a third embodiment of the container 1, the same exhibits a first stop element 80 defined at and spaced from the first lateral wall 4*c* of the compartment 2, and a second stop element 180 defined at and spaced from the second lateral wall 4*d* of the compartment 2 (see FIGS. 13 and 14). The first and second stop elements exhibiting a structure identical to the one above described with reference to the stop element 80 (the first and second stop elements are defined by respective tabs 81 and 181).

Moreover, the package 100 includes at least one wrapping 101 housed at least partially inside the compartment 2 and holding one or more products P. The wrapping 101 including a base portion 102 of sheet material, for example of plastic material, substantially extending along a plane transversal, particularly perpendicular, to the development (extension)

plane of the tab (81 and/or 181) of the stop element. Advantageously, the development plane of the base portion 102 is substantially parallel to the front and rear walls of the compartment 2.

The base portion 102 includes a plurality of reliefs 103 emerging from the development plane of the portion 102 itself; each relief 103 defines a seat adapted to contain at least one product P. Moreover, the package 101 includes at least one covering portion 104 of sheet material, arranged to close the seats containing the products P. The package 101 is configurable between a first operative position wherein the package 101 is completely housed in the compartment 2 of the container 1 (see FIGS. 1, 2, 5 and 6 for example) and a second operative position wherein part of the package 1 is arranged outside the volume 3 of the compartment 2; the package 101, in the second operative position, exhibits at least one portion housed in the inner volume of the compartment 2.

The attached figures illustrate a preferred embodiment of the package 101 which includes a blister back housing a plurality of products P; advantageously but not in a limiting way, the package 100 includes a plurality of wrappings 101 and particularly of blister packs.

As illustrated in FIG. 2, the package 101 includes at least one abutment element 105 directly carried by the base portion 102 and/or covering portion 104; the abutment element 105, in the second operative position of the package 101, is configured for abutting against the stop element 80 for preventing to completely extract the package 101 from the container 1.

In a first embodiment of the package 101, the same exhibits an abutment element 105 including a projection 105*a* laterally emerging from the base portion 102 towards the first lateral wall 4*c*. The projection 105*a* of the abutment element 105, in the second operative position of the package 101, is configured for abutting against the stop element 80 defined at and spaced from the first lateral wall 4*c* of the compartment 2 as illustrated in FIG. 3, for preventing to completely extract the package 101 from the container 1. Advantageously, the projection 105*a* is joined in one piece to the base portion 102 directly carrying said products P.

In particular, and as illustrated in FIG. 2, the abutment element 105—in its first embodiment, can further include a further projection 105*b* joined in one piece to the projection 105*a* and therefore to the base portion 102 and/or closing portion 104 of the package 101. The projections 105*a* and 105*b* laterally emerge from an outer perimeter of the base portion 102 for defining a body having a substantially "L" shape. The stop element 80 of the container 1, in the second operative position and as described in the first embodiment thereof, abuts against the projection 105*a* and is interposed between the base portion 102 and the further projection 105*b* of the abutment element 105.

As hereinbefore described, the container 1 includes a stop element 80 which, in the second embodiment, is interposed and substantially equidistant from the first and second lateral walls 4*c*, 4*d*. Such stop element 80 is configured for cooperating with a package in a second embodiment thereof as illustrated in FIG. 6.

De facto, the package 101, in the second embodiment thereof, includes a base portion 102 having a first and second longitudinal bodies 102*a*, 102*b* spaced and parallel to each other. The first and second longitudinal bodies 102*a*, 102*b* are arranged parallel to the longitudinal development direction of the compartment 2 and parallel to the front and rear walls of the compartment. The first and second longitudinal bodies 102*a*, 102*b* are engaged with each other at a longitudinal end portion, by a connecting body 102*c* facing the second end portion 2*b* of the compartment 2 (see FIG. 6). The first longitudinal body 102*a*, second longitudinal body 102*b*, and connecting body 102*c* are joined in one piece for defining a portion 102 exhibiting a substantially "C" shape. The connecting body 102*c* defines the abutment element 105, configured for abutting, in the second operative position of the package 101, against the stop element 80 interposed between the first and second longitudinal bodies 102*a*, 102*b* for preventing to completely extract the package 101 from the container 1 (see FIG. 7).

As hereinbefore described, the container 1 includes a first and second stop elements 80, 180 spaced from each other and placed respectively in proximity of the first and second lateral walls 4*c*, 4*d* of the compartment; in such configuration, the base portion 102 is interposed between the first and second stop elements 80, 180 (see FIGS. 13 and 14, for example). The abutment element 15 includes a first and second projections 105*a* emerging laterally from the base portion 102 respectively towards the first and second lateral walls 4*c*, 4*d*; the first and second projections of the abutment element 105 are opposite to each other with respect to the base portion 102 of the package 101 (see FIG. 14). The first and second projections of the abutment element 105, in the second operative position of the package 101, are configured for abutting respectively against said first and second stop elements 80, 180 for preventing the package 101 from being completely extracted from the container 1.

The package 100 described in the present preferred embodiment therefore provides a safety device 11 arranged at the first passage opening 5 of the compartment which is adapted to define a child-proof system: the closure system 7 of the container is indeed openable only under determined conditions and particularly upon inserting the device 14 into the slot 15 (or slots 15).

Moreover, the same package 100 carries an occluding system 207 placed at the second passage opening 205; the occluding system 207 is configured for irreversibly preventing the passage from the opening 205 following a first closure condition of the system 207 itself. The occluding system therefore ensures a stable closure of the second opening for preventing the extraction of the products from this latter.

Moreover, the same package 100 carries one or more stop elements adapted to cooperate with at least one abutment element 105 of the package 101 for preventing this latter from being completely extracted from the container 1. De facto, once the package has been opened, the package 101 can be extracted only for a determined distance for withdrawing one or more products P; in this way the wrapping and the associated products are prevented from being left outside the container.

1.2 Second Embodiment of a Package 100

Figures from 1 to 3, from 5 to 7, 13, 14 illustrate a second embodiment of a package according to the present invention. Such package 100, in the second embodiment thereof, includes a compartment 2 as described in the preferred embodiment of the above mentioned package 100. The package 100, in the second embodiment, further includes a closure system 7 defined at the first end portion 2*a* of the compartment 2 as hereinbefore described, while at the second end portion 2*b*, the compartment 2 includes at least one bottom wall 2*c* adapted to occlude the second passage opening 205 of the compartment (see FIG. 2, for example). In contrast to the preferred embodiment of the package, the closure system 7, in the second embodiment of the package 100, does not include the slot 15 (or slots 15) crossing the tab 8. In some implementations, it is not excluded the possibility of making a closure system as described with reference to the preferred embodiment of the package 100 (provided with one or more slots 15 on the tab 8) as described with reference to FIG. 36.

As an alternative, the package 100, in the second embodiment thereof, includes, at the second end portion 2*b* of the compartment 2, an occluding system 207 as described with reference to the preferred embodiment of the package 100.

As illustrated in Figures from 1 to 3, from 5 to 7, 13, 14, the package further includes at least one stop element as described in the preferred embodiment of the package 100 (in an embodiment, the first and second stop elements 80, 180 are present) as described with reference to FIG. 36.

De facto, in the second embodiment thereof, the package 100 includes a container 1 including the compartment 2, occluding system 7, at least one stop element 80 and a bottom wall 2*c* (optionally, the occluding system 207). Further, the package 100 includes at least one wrapping 101 as hereinbefore described with reference to the preferred embodiment of the package 100.

In contrast to the preferred embodiment of the package, the same in the second embodiment thereof, does not have the safety device 11 and opening device 14.

The package 100, in the second embodiment thereof, is configured for preventing the extraction of the second passage opening 205 by the presence of a bottom portion 2*c* or occluding system 207; further, the same package is configured for preventing the wrapping 101 from being completely extracted in order to prevent the package and the associated products from being left outside the container 1.

1.3 Third Embodiment of a Package 100

FIGS. 16, 17, from 19 to 28 illustrate a third embodiment of a package 100 according to the present invention. Such package 100, in the third embodiment thereof, includes a compartment 2 as described with reference to the preferred embodiment of the above mentioned package 100. The package 100, in the third embodiment thereof, further includes a closure system 7 defined at the first end portion 2*a* of the compartment 2 as hereinbefore described, while at the second end portion 2*b*, the compartment 2 includes at least one bottom wall adapted to occlude the second passage opening 205 of the compartment. In contrast to the preferred embodiment of the package, this latter, in the third embodiment does not include an occluding system arranged at the second opening 205: the second opening is occluded by two or more bottom walls overlapped on and constrained to each other, for example by pasting.

The package, in the third embodiment thereof, includes a safety device 11 and an opening device as hereinbefore described with reference to the preferred embodiment of the package 100.

The package, in the third embodiment thereof, further includes at least one stop element as described in the preferred embodiment of the package 100 (in an embodiment, the first and second stop elements 80, 180 are present).

De facto, in the third embodiment thereof, the package 100 includes a container 1 including the compartment 2, closure system 7, safety device 11, at least one stop element 80, and a bottom wall. Further, the package 100 includes at least one opening device 14 and at least one wrapping 101 as hereinbefore described with reference to the preferred embodiment of the package 100.

In contrast to the preferred embodiment of the package, the same in the third embodiment thereof, does not have the occluding system 207.

The package 100, in the third embodiment thereof, is configured for defining a child-proof system by the presence of the safety device 1 and opening device 14: the closure system 7 of the container 1 is de facto openable only under predetermined conditions and particularly after inserting the device 14 in the slot 15 (or slots 15).

The package 100, in the third embodiment thereof, is configured for preventing the wrapping from being extracted from the second passage opening 205 thanks to the presence of one or more bottom walls adapted to occlude the second opening 205; the same package 100 is further configured for preventing the wrapping 101 from being completely extracted from the opening 5 for preventing the wrapping and the associated products from being inadvertently left outside the container 1.

1.4 Fourth Embodiment of the Package

The package 100, according to a fourth embodiment, includes a compartment 2 as described with reference to the preferred embodiment of the above mentioned package 100. The package 100, in the fourth embodiment thereof, further includes the closure system 7 as hereinbefore described defined at the first end portion 2*a* of the compartment 2: such system 7 defines a first occluding system 7 of the container 1.

Figure 28:
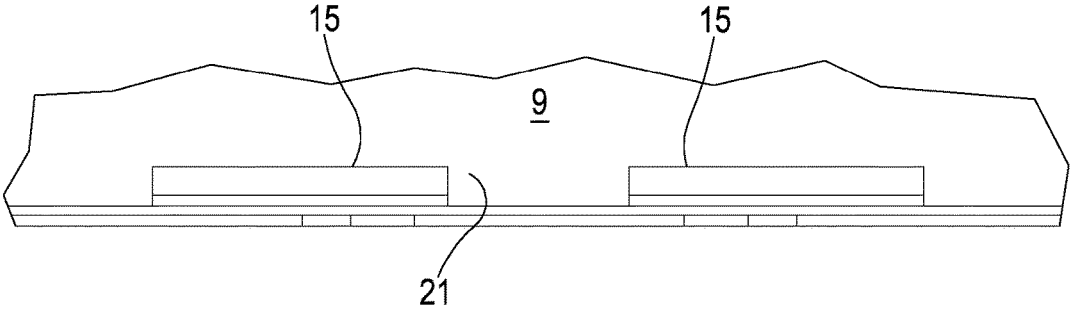

The container 1, in the fourth embodiment of the package 100, further includes a second closure system 307 (as illustrated in FIGS. 28A, 28B and 28C, for example) of sheet material, particularly of paper sheet, engaged at the free edge 206 and movable, particularly by rotation, with respect to the compartment 2: the system 307 is defined at the second end portion of the compartment 2. The second closure system 307 is configured for defining at least one closure condition in which the system 307 itself prevents the communication between the inner volume 3 of the compartment 2 and the outer environment; moreover, the system 307 is configured for defining at least one open configuration in which the closure system 307 itself enables the communication between the inner volume 3 and outer environment. The system 307 substantially embodies a lid adapted to cooperate with the compartment 2 for managing the access to the inner volume 3 through the second passage opening 205.

Advantageously, the second closure system 307 is identical to the system 7 defined at the first end portion 2*a* of the compartment 2. More particularly, the system 307 includes at least one tab 308 exhibiting a closing portion 309 directly engaged with and joined in one piece to the free edge 206 of the compartment 2: the closing portion 309 embodies the component of the tab 308 configured for preventing the passage through the opening 205 in the closed configuration of the system 307 itself. The closing portion 309 substantially includes a flat body of sheet material countershaped to the free edge 206 of the opening 205. The attached figures schematically show a preferred configuration of the closing portion 309 exhibiting a rectangular shape completely counter shaped to the free edge 206.

Moreover, the tab 308 exhibits at least one inserting portion 310 (see FIGS. 28B and 28C, for example) configured for being inserted, in the closed configuration of the system 307, inside the volume 3 of the compartment 2. The inserting portion 310 is joined in one piece to the closing portion 309 and emerges from this latter: the inserting portion 310 substantially represents an extension of the closing portion 309 adapted to be inserted, in the closed configuration of the system 307, inside the compartment 2. Particularly, in the closed configuration of the closure system 307, the inserting portion 310 is completely positioned inside the volume 3 of the compartment 2. As illustrated in the attached figures, also the inserting portion 310 substantially includes a flat body of sheet material having, in a non-limiting way, a rectangular shape. The inserting portion 310 extends between a first and second prevalent development surfaces 310*a*, 310*b* respectively facing the outside (directly facing the front wall 4*a* of the compartment 2) and the inner volume 3 of the compartment 2. In the closed configuration of the system 307, at least one portion of the first development surface 310*a* of the inserting portion 310 faces, particularly contacts, directly part of a lateral wall 4 of the compartment 2 (particularly the front wall 4*a*): the surface 310*a*, in the closed configuration of the system 307, extends at least partially parallel to the front wall 4*a* of the compartment 2, particularly parallel to a wall of the compartment 2 opposite to the wall directly connected to the system 307, in other words to the rear wall 4*b*.

The inserting portion 310 further includes an actuating portion 322, which is configured to be actuated for enabling to open the container 1.

As illustrated in the attached figures, the free edge 206 exhibits a recess 323 defining substantially a depression of the free edge 206 itself. The recess 323 exhibits an open outline exhibiting, in a non-limiting way, a concavity having a substantially "C" shape. The recess 323 is configured for enabling to see and grip at least part of the inserting portion 310 in the closed configuration of the system 307. Particularly, in the closed configuration of the system 307, the concavity of the recess 323 of the free edge 206 leaves exposed the actuating portion 322 of the inserting portion 310, which therefore can be accessed from the outside of the container 1 and is suitably movable.

The closing portion 309 and inserting portion 310 exhibit an interconnection edge opposite to the free edge 206 of the compartment 2 with respect to the closing portion 309 itself: the inserting portion 310 is movable by rotation with respect to the closing portion 9 around said reciprocal connecting edge. The inserting portion 310, in the closed configuration of the system 307, is configured for defining, along a cross-section and cooperatively with the closing portion 309, a substantially "L" shape: under such condition, the inserting portion 310 extends substantially parallel to wall 4*a* of the compartment 2.

The second closure system 307 further includes at least one slot 315, which enables the communication between the inner volume of the compartment 2, and the outer environment. The slot 315 can be defined at the inserting portion 310; alternatively, the slot 315 can be defined at the closing portion 309 or develop at both the inserting 310 and closing portions 309. As illustrated in the attached figures, the slot 315 can be defined at a folding line substantially interposed between the inserting portion 310 and closing portion 309. In the closed configuration of the closure system 307, the slot 315 is arranged at the free edge 206 of the compartment 2.

The closure system 307 can exhibit, in a non-limiting way, two slots 315, an abutment edge 321 being interposed between them. The abutment edge 321, as it will be described in the following, is configured to cooperate with the opening device 14.

The slots 315 can exhibit the same dimensions or, alternatively, different dimensions. From the dimensional point of view, each slot 315 can exhibit a width between 3 and 200 mm, particularly between 5 and 50 mm.

The slot 315 substantially consists of a cutout 315*a* carried by the system 307. The cutout 315*a* is carried by the system 307 and particularly is defined at the inserting portion 310 of the closure system 307 and, in the closed configuration, is arranged at the free edge 206. By folding the inserting portion 310 with respect to the closing portion 309, the cutout 315*a* enables to rotationally move a flap of the closing portion 309 defined by the cutout 315*a* itself and to expose a space or aperture forming just said slot 315. The cutout 315*a* exhibits a substantially "U" shape and the obtained slot 315 exhibits a substantially rectangular shape. Alternatively, the cutout 315*a* can consist in an aperture defined between the inserting portion 310 of the closure system 307 and a lateral wall 4 of the compartment 2.

As illustrated in FIG. 19 for example, the system 7 can further include at least one abutment portion 324 engaged to the free edge 206 of the compartment 2 adjacent the tab 308: the abutment portion 324, in the closed configuration, is configured for being interposed between the inner volume 3 and tab 308 for cooperating with this latter for firmly keeping it under said closure condition. The abutment portion 324 substantially includes a flat tab of sheet material joined in one piece to the free edge 206 of the compartment 2 adjacent to the closing portion 309. The abutment portion 324 exhibits, in a non-limiting way, a rectangular or trapezoidal shape. The abutment portion 324 is also configured for rotating around the free edge 206 for facing, at least in the closed configuration of the container 1, the inside of the compartment 2.

More particularly, the abutment portion 324 is constrained to the free edge 206 in order to be able to engage, in the closed configuration of the container 1, at least part of the inserting portion 310 and/or closing portion 309 for firmly holding the tab 308 in the closed configuration.

Advantageously, the container 1 includes two abutment portions 324 opposite to each other with respect to the tab 308, which is interposed between the two abutment portions 324 (FIG. 19). Under such a configuration, the two abutment portions 324 symmetrically work on the tab 308 to firmly hold it in the closed configuration.

Advantageously, the system 307 is made of a paper material sheet and is obtained by folding it; particularly, the closure system 307 is made in one piece with compartment 2 and by the same paper material sheet.

The container 1 of the package 100, in the fourth embodiment thereof, further includes at least one further safety device 311 made of a sheet material, particularly a paper sheet material; the further safety device 311 has a shape and/or size substantially identical to the ones of the safety device 11.

In particular, the device 311 includes at least one first hooking portion 312 carried by the tab 308, and at least one second hooking portion 313 engaged to the compartment 2. The first and second hooking portions 312, 312 are configured for firmly engaging with each other in the closed configuration of the system 307. In the closed configuration of the system 307, the container 1 is substantially in a safety condition in which the container 1 is prevented from being opened by the engagement between the first and second hooking portions 312, 313. As illustrated in FIGS. 28B and 28C for example, the second hooking portion 313 is placed inside the compartment 2 and substantially lies in a plane parallel to one of the lateral walls 4. The second hooking portion 313 develops completely inside the volume 3 (is placed inside the inner volume of the compartment 2) of the compartment 2 both in the closed and open configuration of the system 307. With reference to the first hooking portion 302, in the closed configuration of the system 307, it is configured for being inserted at least partially, particularly completely, in the inner volume 3 of the compartment 2 in order to firmly engage the second hooking portion 313. In the closed configuration of the system 307, the first hooking portion 312 is completely received inside the volume 3 of the compartment 2 and is spaced from the free edge 206. Moreover, in the closed configuration of the system 307, the engagement between the second hooking portion 313 and first hooking portion 312 is completely defined inside the inner volume 3. The engagement between the first and second hooking portions 312, 313 is of a reversible type; in other words, after reaching the open configuration of the system 307, the first and second hooking portions 312, 313 can be repeatedly (reversibly) engaged in order to define the closed configuration of the system 307, and then a new safety condition of the device 311. Upon switching between the closed configuration and open configuration, the first hooking portion 312 can be disengaged from the second hooking portion 313. Particularly, upon switching between the closed configuration and open configuration, the second hooking portion 313 is not removed or disconnected from the compartment 2 but stays engaged with a lateral wall 4 of the compartment 2 itself inside its volume 3. In this way, following each open configuration of the closure system, the first and second hooking portions 312, 313 are configured for defining a safety condition wherein such portions are firmly engaged with each other.

The first hooking portion 312 is engaged, particularly directly carried, with the tab 308 of the system 307. Advantageously, the first hooking portion 312 is carried only, but not in a limiting way, by the inserting portion 310 of the tab 308: the two portions 312 and 310 are advantageously joined in one piece for forming a single body of paper material. De facto, the first hooking portion 312 includes a flat sheet body emerging, particularly without interruption, from the inserting portion 310 opposite to the closing portion 309: the inserting portion 310 therefore is interposed between the closing portion 309 and the first hooking portion 312. The first hooking portion 312, in the closed configuration of the system 307, and therefore when inserting the inserting portion 310 in the compartment 2, is configured for being also inserted in the inner volume 3.

The body of sheet material of the first hooking portion 312 extends between a first and second prevalent development surfaces 312*a*, 312*b* (FIG. 28C) respectively facing towards the first and second surfaces 310*a*, 310*b* of the inserting portion 310: the first surfaces 310*a*, 312*a* extend without interruption between them and directly face a same lateral wall 4 (the front wall 4) of the compartment 2 opposite to the lateral wall 4 directly connected to the system 307 (rear wall 4*b*). The second surfaces 310*b*, 312*b* extend also without interruption between them and face the inner volume 3 of the compartment 2.

More particularly, the first hooking portion 312 exhibits at least one undercut 316 configured for firmly engaging the second hooking portion 313 arranged inside the compartment 2 in the closed configuration of the system 307. The undercut 316 is distinct and spaced from the free edge 206 of the compartment 2. The undercut 316 includes at least one hook 320 having a seat 320*a* provided with a concavity.

Preferably, the first hooking portion 312 includes two hooks 320 having respective seats 320*a*, the concavities thereof face away from each other. The undercut 316 is configured for engaging the second hooking portion 313.

The second hooking portion 313 is engaged, in a non-limiting way, to a lateral wall 4 of the compartment 2 (the front wall 4*a*) directly facing, in the closed configuration of the system 307, the inserting portion 310.

The sheet material body of the second hooking portion 313 extends between a first and second prevalent development surfaces 313*a*, 313*b* (FIG. 28C). The first surface 313*a* is directly connected to an inner surface of the compartment 2 and faces, in the closed configuration of the system 307, the second surface 310*b* of the inserting portion 310.

The second hooking portion 313 exhibits in turn at least one undercut 317 arranged inside the compartment 2 and configured for engaging the undercut 316 of the hooking portion 312 at least in the closed configuration of the system 307. The undercut 317 exhibits a gripping edge 317*a* distinct and spaced from the free edge 206 of the compartment 2. The undercut 317 exhibits at least one hook 318 defining a seat 319. The seat 319 exhibits a substantially "C" shape. Moreover, the seat 319 exhibits a concavity facing a lateral wall 4 of the compartment 2 (the front wall) and is configured for housing and engagingly holding the first hooking portion 312. In other words, in the closed configuration of the system 307, the first hooking portion 312 is engaged inside the seat 319 and the undercuts 316, 317 are engaged with each other. Under the safety condition (in other words in the closed configuration of the system 307), the concavity of the seat 319 of the hook 318 of the second hooking portion 313 faces the concavity of the seat 320*a* of the hook 320.

The package in the fourth embodiment thereof further includes an opening device 14 as hereinbefore described with reference to the preferred embodiment of the package 100. The opening device 14 is configured for being inserted into the slots 15, 315 of the devices 11 and 311 for respectively enabling to open the first closure system 7 and second closure system.

The container 1, in the fourth embodiment of the package 100, includes a first stop element 80 arranged inside the compartment 2 in the first end portion 2*a* of the compartment 2; the first stop element 80 is further spaced from, but arranged in proximity of the first lateral wall 4*c* of the compartment. The first stop element exhibits a structure as described for the stop element 80 of the first embodiment of the package 100.

As illustrated in FIG. 28A for example, the container 1 further includes a second stop element 180 arranged at the second end portion 2*b* of the compartment 2; the second stop element 180 is further spaced from, but arranged in proximity of the second lateral 4*d* of the compartment. The second stop element 180 exhibits a structure as described with reference to the stop element 80 of the preferred embodiment of the package 100. Each stop element emerges, from at least one lateral wall 4 of the compartment 2, inside this latter for defining a projection; particularly each stop element 80, 180 is directly connected to and extends between the front wall and rear wall of the compartment 2.

As illustrated in FIG. 28C, the package—in the fourth embodiment thereof—includes a wrapping 101 as hereinbefore described with reference to the preferred embodiment of the package 100 with the exception that the wrapping includes a first abutment element 105 directly carried by the base portion 102 and/or covering portion 104 of the wrapping 101 and at least one second abutment element 150 also directly carried by the base portion 102 and/or covering portion 104 of the wrapping 101: said first and second abutment elements 105, 150 are configured for respectively abutting against the first and second stop elements 80, 180 of the container 1 for preventing the wrapping 101 from being completely extracted from the container 1.

More particularly, the wrapping 101 is configurable between:

- a first operative position wherein the wrapping 101 is completely housed inside the compartment of the container 1,
- a second operative position wherein part of the wrapping 101 is arranged outside the inner volume of the compartment 2 through the first passage opening 5, the wrapping 101, in the second operative position, exhibiting at least one portion housed in the inner volume 3 of the compartment 2,
- a third operative position wherein part of the wrapping 1 is placed outside the inner volume 3 of the compartment 2 through the second passage opening 205, the wrapping 101, in the third operative position, exhibiting at least one portion housed in the inner volume 3 of the compartment 2.

The first abutment element 105, in the second operative position of the wrapping 101, is configured for abutting against the first stop element 80 of the container 1 for preventing the wrapping 101 from being completely extracted from the container through the first passage opening 5. The second abutment element 150, in the third operative position of the wrapping 101, is configured for abutting against the second stop element 180 of the container 1 for preventing the wrapping 101 from being completely extracted from the container 1 through the second passage opening 205.

The first abutment element 105 of the wrapping 101 includes a projection 105*a* emerging laterally from the base portion 102 towards the first lateral wall 4*c*; the projection 105*a* of the first abutment element 105, in the second operative position of the wrapping 101, is configured for abutting against said first stop element defined at and spaced from the first lateral wall of the compartment 2. The second abutment element 150 includes a respective projection 150*a* emerging laterally from the base portion 102 towards the second lateral wall 4*d*; the projection 150*a*, in the third operative position of the wrapping 101, is configured for abutting against the second stop element 180 defined at and spaced from the second lateral wall of the compartment 2.

The projection, respectively of the first and second abutment elements 105, 150, includes a tab joined in one piece to the base and/or closing portions of the wrapping. In particular, each projection 105*a*, 150*a* of the package, according to the fourth embodiment, exhibits a tab structure identical to the projection of the package as hereinbefore described with reference to the preferred embodiment of the package and therefore as illustrated in FIG. 28A.

De facto, the package 100, in the fourth embodiment thereof, includes a container 1 including the compartment 2, closure system 7, a second closure system 307 (analogous to the system 7), the safety device 11, a safety device (analogous to the device 11), a first and second stop elements 80, 180 (analogous to the stop element 80 as described with reference to the first embodiment of the package).

In contrast to the preferred embodiment of the package, the same, in the fourth embodiment of the package does not exhibit the occluding system 207.

The package 100, the in the third embodiment thereof, is configured for defining a child-proof system due to the presence of the safety devices 11 and 311 and opening device 14: the closure systems 7 and 307 of the container 1 are indeed openable only under determined conditions and particularly after inserting the device 14 in the slot 15 or 315. The package 100, in the fourth embodiment thereof, is further configured for preventing the wrapping 101 from being completely extracted from the passage openings 5, 205, in this way the wrapping and the associated products are prevented from being inadvertently left outside the container 1.

2. Container

Moreover, it is an object of the present invention to provide a container 1 which can find an advantageous application in the pharmaceutical and cosmetics field.

2.1 First Embodiment of the Container

In a first embodiment, the container 1 includes a compartment 2, a closure system 7, a safety device 11, an opening device 14, an occluding system 207 and at least one stop element 80 as described with reference to the preferred embodiment of the package 100. As described with reference to the preferred embodiment of the package, the container can include a single stop element—as illustrated in Figures from 1 to 3, from 5 to 7—or a first and second stop elements 80 as illustrated in FIGS. 13 and 14. The container 1 as illustrated in Figures from 1 to 3 does not include the wrapping element 101.

2.2 Second Embodiment of the Container

In a second embodiment, the container 1 includes a compartment 2 and a closure system 7 as described with reference to the preferred embodiment of the package 100. The container 1, in the second embodiment, further includes at least one stop element 80 as described with reference to the preferred embodiment of the package 100. As described with reference to the preferred embodiment of the package 100, the container can include a single stop element—as illustrated in Figures from 1 to 3, from 5 to 7—or a first and second stop elements 80 as illustrated in FIGS. 13 and 14. The container 1, in the second embodiment, does not include the safety device 11, the opening device 14, the occluding system 207 and wrapping 101.

2.3 Third Embodiment of the Container

In a third embodiment, the container 1 includes; the compartment 2, closure system 7, safety device 11, and opening device 14 as described with reference to the preferred embodiment of the package 100. The container 1, in the third embodiment, further includes at least one stop element 80 as described with reference to the preferred embodiment of the package 100. As described with reference to the preferred embodiment of the package 100, the container can include a single stop element—as illustrated in Figures from 1 to 3, from 5 to 7—or a first and second stop elements 80 as illustrated in FIGS. 13 and 14. The container 1, in the third embodiment, does not include the occluding system 207 and wrapping 101.

2.4 Fourth Embodiment of the Container

In a fourth embodiment, the container 1 includes the compartment 2, closure system 7 and occluding system 207 as hereinbefore described with reference to the preferred embodiment of the package 100. The container 1, in the fourth embodiment, does not comprise—in contrast to the preferred embodiment of the package: the safety device 11, opening device 14, stop element 80 (particularly the first and second stop elements) and wrapping 101.

2.5 Fifth Embodiment of the Container

In a fifth embodiment, the container 1 includes the compartment, closure system 7, occluding system 207 and at least one stop element as hereinbefore described with reference to the preferred embodiment of the package 100. The container 1, in the fifth embodiment, does not include—in contrast to the preferred embodiment of the package: the safety device 11, opening device 14 and wrapping 101.

2.6 Sixth Embodiment of the Container

In a sixth embodiment, the container 1 includes the compartment 2, closure system 7, safety device 11 and opening device 14 as hereinbefore described with reference to the preferred embodiment of the package 100. Moreover, the container includes the second closure system and the further safety device as described with reference to the fourth embodiment of the package 100. The container 1, in the sixth embodiment, does not include—in contrast to the preferred embodiment of the package: the stop element, occluding system 207 and wrapping 101.

2.7 Seventh Embodiment of the Container

In a seventh embodiment, the container 1 includes the compartment 2, occluding system 207 as hereinbefore described with reference to the preferred embodiment of the package 100. The container 1, in the seventh embodiment thereof, further includes a further occluding system analogous to the system 207 which is however arranged at the second end portion 2*b* of the compartment 2. In such configuration, the first and second openings 5, 205 of the container are irreversibly occluded respectively by the occluding system 207 and by the further occluding system. The container 1, in the seventh embodiment, does not include—in contrast to the preferred embodiment of the package: the closure system 7, stop element, safety device, opening device occluding and wrapping 101.

3. Process for Making a Package 3.1 Preferred Embodiment of the Process

Moreover, the present invention refers to a process for making a package according to the above described preferred embodiment, and particularly, according to one or more of the attached claims.

The process includes a step of making the container 1 obtainable from a single blank 500, such as a sheet material. The blank 500 extends between a first and second prevalent development surfaces adapted to define respectively an inner and outer surfaces of the container 1. The process can include a step of engaging a film of plastic material on at least part of the first and/or second prevalent development surfaces of the blank 500.

First of all, the process includes providing the compartment 2 which, as hereinbefore described, is made of sheet material, optionally a paper sheet.

The step of providing the compartment 2 includes providing at least one first sheet 51 including at least one first and one second portions 52, 54 interconnected by a central connecting portion 53. Moreover, the first sheet 51 includes at least one first and one second lateral connecting portions 55, 56. As illustrated in FIG. 29 for example, the central connecting portion 53 is interposed between the first and second portions 52, 54, the first portion 52 is interposed between the first lateral connecting portion 55 and central connecting portion 53, while the second portion 54 is interposed between the second lateral connecting portion 56 and central connecting portion 53. Each of said portions 52, 53, 54, 55, 56 includes at least two opposite longitudinal edges and two opposite end edges: the portions 52, 54, central connecting portion 53 and said lateral connecting portions 55, 56 are joined along the longitudinal edges and aligned along a single connecting direction. Particularly, each of the portions 52, 53, 54, 55, 56 of the first sheet includes a first and second end edges: joining the first end edge of the portions 52, 53, 54, 55, 56 defines a first end edge of the first sheet 51, while joining the second end edges of the portions 52, 53, 54, 55, 56 defines a second end edge of the first sheet 51.

In a preferred but non limiting arrangement of the invention, the first portion 52 of the first sheet 51 exhibits a rectangular shape with a perimeter delimited by a lower edge 52*a*, a first and second lateral edges 52*b*, 52*c* and an upper edge 52*d*. Analogously, the second portion 54 of the first sheet 51 exhibits a rectangular shape with a perimeter delimited by a lower edge 54*a*, a first and second lateral edges 54*b*, 54*c* and an upper edge 54*d*. Advantageously, the first and second portions 52, 54 include a sheet having substantially the same shape and size.

The central portion 53 and lateral connecting portions 55, 56 exhibit also a rectangular shape; such portions exhibit substantially the same shape and/or size and are joined in one piece to the portions 52 and 54 of the first sheet 51 at the lateral edges.

The step of providing the compartment 2 includes a step of folding the first sheet 51 at the lateral edges of the portions 52 and 54.

The step of forming the compartment 2 can include folding a lateral connecting portion, for example the portion 55, with respect to the first portion 52 and approaching it to the second portion 54: for example, it is possible to provide folding the lateral connecting portion 55 so that this latter can define, cooperatively with the first portion 52, a substantially "L" shape. Then, the process provides, for example, folding the central portion 53 with respect to a first portion 52 and approaching it to the already folded portion 55: for example, it is possible to provide the step of folding the central portion 53 so that this latter can define, cooperatively with the first portion 52, a substantially "L" shape. Still in the following, it is for example possible to provide the step of folding the second portion 54 with respect to the central portion 53 and approaching it to the first portion 52: for example, it is possible to provide the step of folding the second portion 54 so that this latter can define, cooperatively with the central portion 53, a substantially "L" shape. For a complete formation of the compartment 2, the process provides folding the remaining lateral connecting portion, for example the portion 56, with respect to the second portion 54 so that it is possible to join said lateral connecting portions 55, 56. The process, for holding the compartment 2 in the folded three-dimensional shape, can provide, in a non-limiting way, applying a predetermined quantity of paste on the lateral connecting portions 55, 56 adapted to abut against each other: joining said portions 55, 56 enables to hold the compartment 2 in the folded configuration.

In a preferred embodiment of the compartment 2, the process provides firstly folding the portions 53, 54 and 56 above the portions 52 and 55; particularly the portions 53 and 54 are overlapped on the portions 52 and 55 (FIG. 32). Then, the second lateral connecting portion 56 is folded below the first connecting portion 55: the portions 55 and 56 are constrained to each other for example by pasting. Then, the first sheet is folded along the longitudinal edges for defining said compartment 2 (FIG. 3).

Moreover, the process includes providing the closure system 7. Such step includes providing at least one second sheet 57, advantageously, joined in one piece to the first sheet 51, particularly at the first end edge of the first portion 52 of the first sheet. The second sheet 57 includes at least one first and second portions 58, 59 joined in one piece to each other: the first portion 58 of the second sheet 57 is connected to the first sheet 51 so that said first portion 58 is interposed between the second portion 59 of the second sheet 57, and the first sheet 51.

The step of providing the closure system 7 includes, before folding the portions of the first sheet 51, folding the first and second portions 58, 59 of the second sheet 57 for respectively forming the closing portion 9 and inserting portion 10 of the closure system 7.

Further, the step of providing the second sheet 57 includes a step of forming one or more slots 15 made at the first and/or second portions 58, 59 and configured to enable to insert the opening device 14. According to an embodiment of the invention, the step of forming one or more slots 15 provides making one or more cutouts 15*a* at the first and/or second portions 58, 59. Particularly, to each made cutout 15*a* corresponds a respective slot 15.

Moreover, the process includes a step of providing at least one stop element 80; such step includes at least one step of providing at least one first lateral sheet 90 connected to a longitudinal edge of the first lateral connecting portion 55 of the first sheet 51. The first lateral sheet 90 is joined in one piece to the first sheet 51 and is opposite to the first portion 52 of the first sheet with respect to the first lateral connecting portion 55. The first lateral sheet 90 includes at least one first, one second and one third portions 91, 92, 93 (FIG. 29) joined in one piece to each other; the first portion 91 of the first lateral sheet 90 is joined in one piece to the first lateral connecting portion 55 of the first sheet 51: the second portion 92 of the first lateral sheet is interposed between the first 91 and third portion 93 of the first lateral sheet 90 itself.

Figure 31:
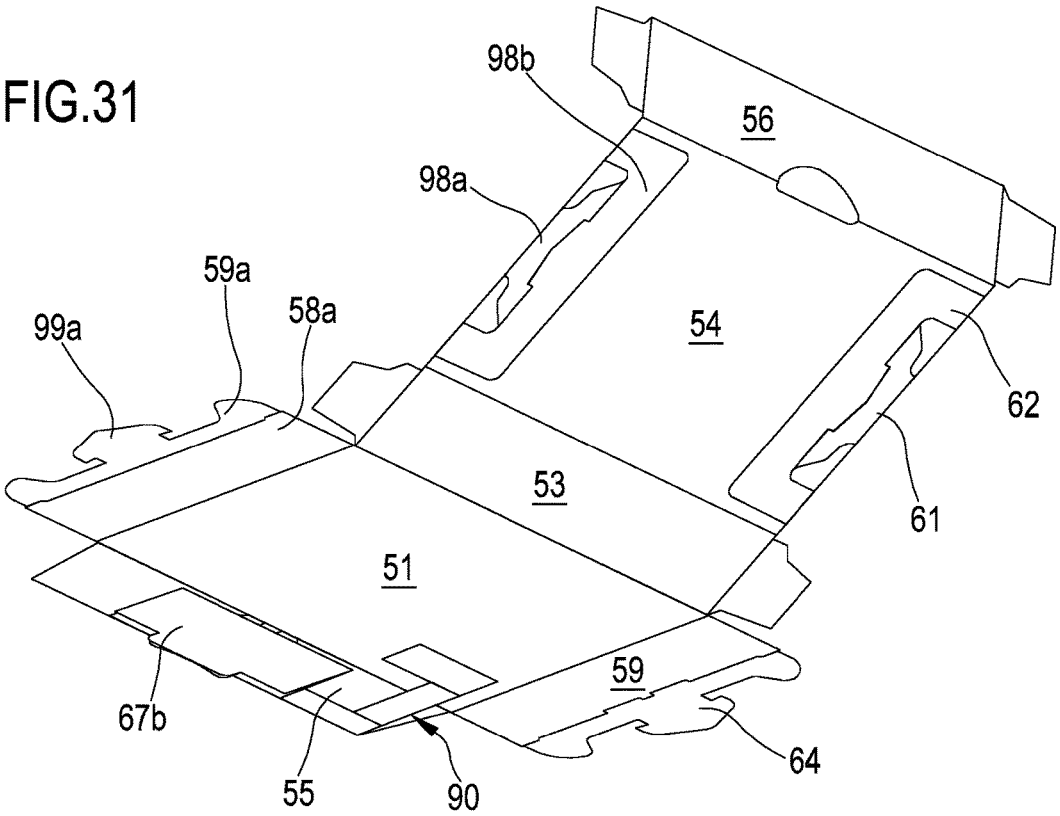

Before the step of folding the portions of the first sheet 51, the process provides folding the first lateral sheet 90 on the first sheet 51 so that at least the second and third portions of the first lateral sheet 90 are overlapped on and in contact with the first portion 52 of the first sheet 51 (FIG. 31). Next, the process provides a step of constraining, for example by pasting, the third portion 93 of the first lateral sheet 90 to the first portion 52 of the first sheet 51. Only after that, the central connecting portion 53 and second portion 54 of the first sheet 51 are folded on the first portion of the first sheet 51 and above the first lateral sheet 90.

At this point of the process, it is possible to constrain, for example by pasting, the first portion 91 of the first lateral sheet 90 to the second portion of the first sheet 51, and the second lateral connecting portion 56 to the first lateral connecting portion 55 of the first sheet.

Only after that, the first sheet 51 is folded along the longitudinal edges of the portions of the first sheet itself: when folding the first sheet 51, the same enables to fold the with respect to each other portions 91, 92, 93 of the first lateral sheet 90. After the step of folding the first sheet 51, this latter defines the compartment 2, while the first lateral sheet 90 defines the stop element 90 inside the compartment 2.

As illustrated in FIGS. 4 and 8, it is possible to determine the position of the stop element 80 as a function of the extension of the first portion 91 of the sheet 90. FIG. 4 illustrates a portion 91 having a small extension enabling to define the stop element 80 arranged at the lateral wall 4*c* of the compartment (FIG. 1). FIG. 8 illustrates a portion 91 having dimensions greater than the one in FIG. 1 and therefore enabling to define a stop element 80 arranged at a transversal midline of the compartment (FIG. 5).

As hereinbefore described, the package can provide a first and second stop elements 80, 180. Therefore, the process can further include a step of providing a second lateral sheet 94 connected to a longitudinal edge of the first lateral connecting portion 55 of the first sheet. The second lateral sheet 94 is joined in one piece to the first sheet 51 and is opposite to the first portion 52 of the first sheet itself with respect to the first lateral connecting portion 55. The second lateral sheet 94 includes at least one first, one second and one third portions 95, 96, 97 joined in one piece to each other: the first portion 95 is joined in one piece to the first lateral connecting portion 55, while the second portion 96 is interposed between the first 95 and third portions 97. The first portion 95 of the second lateral sheet 94 is arranged at least partially around an outer perimeter of the first lateral sheet 90.

Before the step of folding the portions of the first sheet 51, the process includes folding the second lateral sheet 94 on the first sheet 51 so that the second and third portions of the second lateral sheet 94 are overlapped on and in contact with the first portion 52 of the first sheet 51. Then, the process includes a step of constraining, for example by pasting, the third portion 97 of the second lateral sheet 90 to the first portion 52 of the first sheet 51. Only after the connecting central portion 53 and second portion 54 of the first sheet 51 are folded above the first portion of the first sheet 51 and above the second lateral sheet 94.

At this point of the process, it is possible to constrain, for example by pasting, a first portion 95 of the second lateral sheet 94 to the second portion of the first sheet 51 and the second lateral connecting portion 56 to the first lateral connecting portion 55 of the first sheet 51.

Only after the first sheet 51 is folded along the longitudinal edges of the portions of the first sheet 51 itself: when folding the first sheet 51, the same enables to fold, with respect to each other, the portions 95, 96, 97 of the second lateral sheet 90. After the step of folding the first sheet 51, this latter defines the compartment 2 while the second lateral sheet 90 defines the stop element 180 inside the compartment 2. Moreover, the process includes providing the safety device 11. Such step includes providing at least one first and one second upper sheets 60, 63.

The first upper sheet 60 is advantageously joined in one piece to the first sheet 51, particularly at the first end edge of the second portion 54 of the first sheet. The first upper sheet 60 includes a first portion 61 and second portion 62; the first portion 61 is configured to form the second hooking portion 13. The first upper sheet 60, before the step of folding the portions of the first sheet 51, is folded on the second portion 54 of the first sheet 51 and is advantageously joined in one piece, at least partially. The process can provide, in a non-limiting way, the application of a predetermined quantity of paste on the second portion 62 of the second upper sheet 60 and/or on a part of the second portion 64 of the first sheet 51 adapted to abut against each other:

joining said portions enables to constrain at least partially the first upper sheet to the first sheet; then, the process provides a step of folding the first portion 61 of the first upper sheet 60 with respect to said second portion 62 of the same end sheet away from the first sheet for defining the second hooking portion 13 of the safety device 11. As illustrated in FIG. 29 for example, the first portion 61 is engaged to the second portion 62 of the sheet 60 itself by two folding lines 61, 61*b* adapted to ensure the rotation of the first portion 61 with respect to the second portion 62 constrained to the first sheet 51. A cutout 61*c* is further defined on the first upper sheet 60, which is configured for delimiting the first portion 61 and more particularly for defining a second hooking portion 13 of the device 11.

On the contrary, the second upper sheet 63 is joined in one piece to the second sheet 57, particularly at an end edge of the second portion 59 of the second sheet 57. The second upper sheet 63 includes a portion 64 joined in one piece to the second portion 59 of the second sheet 57. The portion 64 substantially forms the first hooking portion 12 of the safety device 11; particularly, the portion 64 includes at least one shaped portion 64*a* adapted to define the undercut 16 of the first hooking portion 12. Advantageously, the second upper sheet 63 is joined in one piece to the second sheet 57 for defining a single sheet; particularly, also the second upper sheet 63 is made of paper material, particularly of a paper material sheet having substantially the same characteristics of the first sheet 51, second sheet 57 and of the first upper sheet 60.

Moreover, the process can include a step of providing at least one third upper sheet 65. The third upper sheet 65 is advantageously joined in one piece to the central connecting portion 53 and/or to the second lateral connecting portion 56. The third upper sheet 65 includes a portion 66, which is configured to form an abutment portion 24. The attached figures illustrate an example but non limiting configuration of the invention wherein two third upper sheets 65 respectively engaged to the first end edge of the portions 53 and 56 of the first sheet 51 are provided. The upper sheets 65 are laterally arranged with respect to the first upper sheet 60: the first upper sheet 60 is interposed between the portions 66 of the sheets 65 (FIG. 29). Advantageously, the third upper sheet 65 is formed in a single piece with the first sheet 51 for defining a single sheet; particularly, also the third upper sheet 65 is made of paper material, particularly of a paper material sheet having substantially the same characteristics of the first sheet 51, second sheet 57, third upper sheet 60 and second upper sheet 63.

Moreover, the process includes a step of providing the opening device 14; such step includes a step of defining, on the first lateral connecting portion 55 of the first sheet 51, a cutout or weakening line 55*a* defining a third lateral sheet 67: the third lateral sheet 67 is shaped in order to define a single portion 68 defining the gripping portion 30 from which the appendage 26 of the opening device 14 emerges. The step of providing said device 14 further provides defining a through opening 56*a* at the longitudinal edge of the second lateral portion 56 in contact with a second portion 54 of the first sheet 51: the through opening 56*a* is adapted to define a pocket 14*a* on the lateral wall of the compartment, adapted to enable to extract the opening device 14. De facto, the pocket 14*a* after the step of defining the compartment 2, enables to reach the third lateral sheet 67 and tear such sheet for defining the device 14.

In a preferred but non limiting embodiment of the invention, the step of providing the device 14 further includes the following steps:

providing a further lateral sheet 67*a* in a flat configuration and joined in one piece to the first lateral connecting portion 55 of the first sheet 51, the first lateral sheet 67*a* includes a first and second portions 67*b*, 67*c* joined in one piece to each other, the first portion 67*b* of the fourth sheet 67*a* being joined in one piece to the first connecting portion 55 of the first sheet and being interposed between the second portion of the fourth lateral sheet 67*a* and the first connecting portion 55 of the first sheet, folding the fourth lateral sheet 67*a*, before the step of folding the portions of the first sheet 51, in order to overlap the first portion 67*b* of the fourth lateral sheet on the portion 55 of the first sheet 51, providing the second portion 67*c* of the fourth lateral sheet above and in contact with the first portion of the fourth lateral sheet 67*a* itself, then, folding the portions of the first sheet 51 for bringing in contact the second lateral connecting portion 56 of the first sheet 51 with the first lateral connecting portion 55, then, constraining, particularly by pasting, the second lateral connecting portion 56 of the first sheet 51 to the first lateral connecting portion 55 of the first sheet 51.

After folding the first sheet 51, the fourth lateral sheet 67*a* is configured for defining a kind of case adapted to contain the opening device 14 (FIG. 34). The first portion 67*b* of the fourth lateral sheet 67*a* includes a through opening (see FIG. 29) which, in the folded condition of the first sheet, is aligned with the through opening 56*a* of the portion 56 for defining said packet 14*a*.

Moreover, the process includes providing the occluding system 207. Such step includes providing at least one third sheet 57*a*, advantageously, joined in one piece to the first sheet 51, particularly at the second end edge of the first portion 52 of the first sheet 51. The third sheet 57*a* includes at least one first and one second portions 58*a*, 59*a* joined in one piece to each other: the first portion 58*a* is connected to the first sheet 51 so that said first portion 58*a* is interposed between the second portion 59*a* of the third sheet 57*a* and the first sheet 51. The third sheet is arranged oppositely to the second sheet 57 with respect to the first sheet 51 (see FIG. 29). Providing the occluding system further provides a step of providing at least one first and one second lower sheets 98, 99.

The first lower sheet 98 is advantageously joined in one piece to the first sheet 51, particularly at the second end edge of the second portion 54 of the first sheet. The first lower sheet 98 includes a first portion 98*a* and second portion 98*b*; the first portion 98*a* is configured to form the second hooking portion 213. The first lower sheet 98, before the step of folding the portions of the first sheet 51, is folded on the second portion 54 of the first sheet 51 and advantageously is at least partially joined to it. The process can provide, in a non-limiting way, the application of a predetermined quantity of paste on the second portion 98*b* of the first lower sheet 98 and/or on a part of the second portion 54 of the first sheet 51 adapted to abut against each other: joining said portions enables to at least partially constrain part of the first lower sheet to the first sheet; then the process provides a step of folding the first portion 98*a* of the first lower sheet 98 with respect to said second portion 98*b* of the same sheet away from the first sheet 51 for defining the second hooking portion 213 of the occluding system. As illustrated in FIG. 29 for example, the first portion 98*a* is engaged to the second portion 98*b* of the same sheet 98 by two folding lines 98*c*, 98*d* adapted to ensure the rotation of the first portion 98*a* with respect to the second portion 98*b* constrained to the first sheet 51. Moreover, on the first upper sheet 98 it is defined a cutout 98*f* configured for delimiting the first portion 98*a* and more particularly for defining the second hooking portion 213 of the system 207.

On the contrary, the second lower sheet 99 is joined in one piece to the third sheet 57*a*, particularly at an end edge of the second portion 59*a*. The second lower sheet 99 includes a portion 99*a* joined in one piece to the second portion 59*a* of the third sheet 57*a*. The portion 99*a* substantially forms the first hooking portion 212 of the system 207; in particular, the portion 99*a* includes at least one shaped portion 99*b* adapted to define the undercut 17 of the first hooking portion 212. Advantageously, the second lower sheet 99 is formed in a single piece with the third sheet 57*a* for defining a single sheet; particularly, also the second lower sheet 99 is made of paper material, particularly of a paper material sheet having substantially the same characteristics of the first sheet 51, second sheet 57, third sheet 57*a*, first upper sheet 60 and second upper sheet 63.

The third sheet 57*a* and second lower sheet 99 are joined in one piece for defining a single body and, in contrast to the second sheet 57, are devoid of through openings. Particularly, the third sheet 57*a* and second lower sheet 99 delimit a single closed outer perimeter: the third sheet 57*a* and second lower sheet 99 are devoid of openings crossing the thickness of the sheet inside said closed outer perimeter.

After folding the sheet 51, the second portion 59*a* of the third sheet 57*a* is folded with respect to the first portion 58*a* which is then rotated with respect to the free edge 206 for enabling to insert the second lower sheet 99 of the compartment 2 in order to define a first closure condition of the occluding system. During such step, the hooking portions 212, 213 are irreversibly engaged.

Moreover, the process can include a step of providing at least one third lower sheet 65*a*. The third lower sheet 65 is advantageously joined in one piece to the central connecting portion 53 and/or second lateral connecting portion 56. The third upper sheet 65 includes a portion 66, which is configured to form an abutment portion 24. The attached figures illustrate an example but non limiting configuration of the invention wherein two third upper sheets 65 respectively engaged to the first end edges of the portions 53 and 56 of the first sheet 51, are provided. The upper sheets 65 are laterally arranged with respect to the upper sheet 60; the first upper sheet 60 is interposed between the portions 66 of the sheets 65 (FIG. 29). Advantageously, the third upper sheet 65 is formed in a single piece with the first sheet 51 for defining a single sheet; particularly, also the third upper sheet 65 is made of paper material, particularly in a paper material sheet having substantially the same characteristics of the first sheet 51, second sheet 57, first upper sheet 60 and second upper sheet 63.

The process includes a step of providing at least one wrapping 101.

Moreover, the process provides the following steps:

- defining the compartment 2 wherein the first and second passage openings 5, 205 enable the communication between the inner volume 3 of the compartment and the outer environment,
- completely inserting the wrapping 101 into the inner volume of the compartment through the second passage opening 205,
- providing the closure system 7 in the closed configuration,
- defining the occluding system 207 adapted to irreversibly close the second passage opening 205.

3.2 Second Embodiment of the Process for Making a Package

In a second embodiment, the process includes only the step of providing the compartment 2, closure system 7, stop element 80 and wrapping 101 as hereinbefore described with reference to the preferred embodiment of the process. Particularly, the process of the second embodiment thereof provides only the step of providing a blank 500 exhibiting: the first sheet 51, second sheet 57, first lateral sheet 90, optionally the third sheet 57*a*, and optionally the second lateral sheet 94 (see FIGS. 4, 8 and 15, for example). Figures from 9 to 12 schematically illustrate the step of folding said sheets as hereinbefore described with reference to the preferred embodiment of the process. After defining the compartment 2, the process provides inserting the wrapping into the inner volume 3.

3.3 Third Embodiment of the Process for Making a Package

In a third embodiment, the process includes only the step of providing the compartment 2, stop element, safety device 11, opening device 14, wrapping 101 and optionally the occluding system 107 as hereinbefore described with reference to the preferred embodiment of the process. Particularly, the process of the third embodiment thereof provides only the step of providing a blank 500 exhibiting: the first sheet 51, second sheet 57, first lateral sheet 90, first upper sheet 61, second upper sheet 63 (see FIG. 18 for example).

After defining the compartment 2, the process provides inserting the wrapping into the inner volume 3.

3.4 Fourth Embodiment of the Process for Making a Package

In a fourth embodiment, the process includes only the step of providing the compartment 2, safety device 11, opening device 14, wrapping 101 as hereinbefore described with reference to the preferred embodiment of the process.

In the fourth embodiment thereof, the process provides making a further safety device 311 as hereinbefore described with reference to the fourth embodiment of the package. The further safety device is provided by providing and folding the first and second lower sheets 98, 99 as described with reference to the embodiment of the process. In the fourth embodiment of the process, the first and second lower sheets 98, 99 are identical to the first and second upper sheets and define therefore a first hooking portion 312, a second hooking portion 313 and one or more slots 315.

After defining the compartment 2, the process provides inserting the wrapping into the inner volume 3.

4. Process for Making a Container

It is a further object of the present invention a process for making a container 1 according to one or more of the attached claims and/or according to one or more of the attached aspects.

4.1 First Embodiment of a Process for Making a Container

In a first embodiment, it is provided a process for making a container 1 according to the above described first embodiment. Such process includes only the step of providing the compartment 2, safety system 11, opening device 14, occluding system 207, stop element as hereinbefore described with reference to the preferred embodiment of the process for making the package 100.

4.2 Second Embodiment of a Process for Making a Container

In a second embodiment, it is provided a process for making a container 1 according to the above described second embodiment. Such process includes only the step of providing the compartment 2, stop element, optionally the occluding system 207, as hereinbefore described with reference to the preferred embodiment of the process for making the package 100.

4.3 Third Embodiment of a Process for Making a Container

In a third embodiment, it is provided a process for making a container 1 according to the above described third embodiment. Such process includes only the step of providing the compartment 2, safety system 11, opening device 14, stop element as hereinbefore described with reference to the preferred embodiment of the process for making the package 100.

4.4 Fourth Embodiment of a Process for Making a Container

In a fourth embodiment, it is provided a process for making a container 1 according to the above described fourth embodiment. Such process includes only the step of providing the compartment 2, closure system 7, occluding system 207, as hereinbefore described with reference to the preferred embodiment of the process for making the package 100.

4.5 Fifth Embodiment of a Process for Making a Container

In a fifth embodiment, it is provided a process for making a container 1 according to the fifth above described embodiment. Such process includes only the step of providing the compartment 2, closure system 7, occluding system 207, stop element, as hereinbefore described with reference to the preferred embodiment of the process for making the package 100.

4.6 Sixth Embodiment of a Process for Making a Container

In a sixth embodiment, it is provided a process for making a container 1 according to the above described sixth embodiment. Such process includes only the step of providing the compartment 2, closure system 7, safety system 11, opening device 14, as hereinbefore described with reference to the preferred embodiment of the process for making the package 100. Moreover, such process includes the step of providing the second closure system 307 and the further safety device 311 as described in the fourth embodiment of the process for making the package 100.

4.7 Seventh Embodiment of a Process for Making a Container

In a seventh embodiment, it is provided a process for making a container 1 according to the above described seventh embodiment. Such process includes only the step of providing the compartment 2, occluding system 207, as hereinbefore described with reference to the preferred embodiment of the process for making the package 100. Moreover, such process includes providing a further occluding system identical to the occluding system 207, defined at the first longitudinal end portion 2*a* of the compartment 2.

The invention claimed is:

1. A container comprising:

a compartment of a sheet material defining an inner volume configured for housing a product, the compartment extending between a first and second longitudinal end portions along a longitudinal development direction of the compartment, the compartment having a predetermined number of lateral walls defining at least one first passage opening delimited by a free edge and arranged at the first longitudinal end portion of the compartment, at least one second passage opening delimited by a respective free edge and arranged at the second longitudinal end portion of the compartment; and at least one occluding system of the sheet material engaged at the free edge of the at least one second passage opening of the compartment, the at least one occluding system being configured for irreversibly closing the at least one second passage opening and for preventing access from the outside into the inner volume of the compartment through the at least one second passage opening, wherein the at least one occluding system comprises at least one tab having a closing portion engaged with the free edge of the compartment and at least one inserting portion inserted inside the inner volume of the compartment, the at least one occluding system further comprising:

at least one first hooking portion supported by the tab and arranged inside the compartment, and at least one second hooking portion engaged with the compartment and arranged inside the inner volume, the second hooking portion being firmly engaged with the first hooking portion, the first and second hooking portions of the at least one occluding system being firmly engaged with each other inside the compartment and being configured for irreversibly occluding the at least one second passage opening of the compartment, wherein the first hooking portion of the at least one occluding system has at least one undercut comprising at least one hook and defining a first seat having a first concavity, the first hooking portion being devoid of weakening portions, wherein the second hooking portion of the at least one occluding system comprises at least one hook and defines a second seat having a second concavity that faces a lateral wall of the compartment directly connected to the second hooking portion, the second hooking portion being devoid of weakening portions, the hook of the first hooking portion of the at least one occluding system is firmly engaged inside the second seat of the hook of the second hooking portion of the at least one occluding system, the first concavity faces the second concavity of the second hooking portion of the at least one occluding system, wherein the at least one occluding system is configured for defining a starting initial condition wherein the at least one occluding system enables a communication between the inner volume of the compartment and an outer environment through the second passage opening, defining a first closed configuration, wherein the first and second hooking portions of the at least one occluding system, devoid of weakening portions, irreversibly close the second passage opening prevent a change to an open configuration of the same occluding system following the first closed configuration.

2. The container of claim 1, wherein the container is configured to be openable at the at least one first passage opening of the compartment.

3. The container of claim 1, wherein the closing portion of the tab of the at least one occluding system has a shape delimited by a closed outer perimeter counter shaped and substantially identical to the at least one second passage opening of the compartment, the closing portion of the at least one occluding system covering the at least one second passage opening of the compartment, and wherein the closing portion of the at least one occluding system is devoid of through openings.

4. The container of claim 1, wherein the closing portion is integrally joined to the at least one inserting portion, the closing portion and the at least one inserting portion defining a body of sheet material having a substantially "L" shape, the closing portion and the at least one inserting portion defining a single continuous body delimited by a single closed outer perimeter devoid of through openings defined inside the closed outer perimeter.

5. The container of claim 1, wherein the first hooking portion of the at least one occluding system is directly supported and integrally joined to the at least one inserting portion of the at least one occluding system, the first hooking portion is arranged oppositely to the closing portion of the tab with respect to the at least one inserting portion, and wherein the second hooking portion of the at least one occluding system is directly engaged to the one of the lateral walls of the compartment, directly facing the at least one inserting portion of the at least one occluding system.

6. The container of claim 1, wherein the second hooking portion comprises a tab of sheet material extending along a development plane, the tab of the second hooking portion comprising a body having a substantially "C" shape having concavity faces away from the closing portion of the at least one occluding system, and wherein the tab of the second hooking portion of the at least one occluding system is inclined with respect to the at least one inserting portion facing the second hooking portion.

7. The container of claim 6, wherein the tab of the second hooking portion of the at least one occluding system has an angle of inclination with respect to the at least one inserting portion facing the second hooking portion less than 20°.

8. The container of claim 1, comprising at least one closure system also of sheet material engaged at the free edge of the at least one first passage opening, the closure system being rotationally movable with respect to the compartment, the closure system being configured for defining at least one closed configuration, in which the closure system substantially occludes the at least one first passage opening of the compartment and prevents a communication between the inner volume of the compartment and the outer environment, the closure system further being configured for defining an open configuration in which the at least one closure system enables the communication between the inner volume and the outer environment.

* * * * *